US010315812B1

(12) United States Patent
Kosierkiewicz

(10) Patent No.: US 10,315,812 B1
(45) **Date of Patent: *Jun. 11, 2019**

(54) CONTAINER TIME INDICATOR WITH A DEVICE FOR INHIBITING THE REMOVAL OF THE CAP

(71) Applicant: Tomasz Andrzej Kosierkiewicz, Mount Vernon, IL (US)

(72) Inventor: Tomasz Andrzej Kosierkiewicz, Mount Vernon, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/964,301

(22) Filed: Apr. 27, 2018

Related U.S. Application Data

(63) Continuation of application No. 15/468,053, filed on Mar. 23, 2017, now Pat. No. 9,963,280, which is a continuation-in-part of application No. 14/485,936, filed on Sep. 15, 2014, now Pat. No. 9,630,746, which is a continuation-in-part of application No. 13/975,866, filed on Aug. 26, 2013, now Pat. No. 9,199,766, which is a continuation-in-part of application No. 12/772,188, filed on May 1, 2010, now abandoned, which is a continuation-in-part of (Continued)

(51) Int. Cl.

| | |
|---|---|
| ***B65D 83/04*** | (2006.01) |
| ***B65D 50/06*** | (2006.01) |
| ***B65D 43/02*** | (2006.01) |
| ***B65D 55/14*** | (2006.01) |
| ***B65D 55/02*** | (2006.01) |
| ***B65D 45/32*** | (2006.01) |

(52) U.S. Cl.
CPC ..... *B65D 50/066* (2013.01); *B65D 43/0225* (2013.01); *B65D 45/325* (2013.01); *B65D 55/022* (2013.01); *B65D 55/145* (2013.01)

(58) Field of Classification Search
CPC .... B65D 83/04; B65D 55/10; B65D 55/0872; B65D 55/022; B65D 55/02; B65D 50/062; B65D 50/00; B65D 41/04; A61J 1/03; A61J 1/1437; A61J 7/04; A61J 7/0409; A61J 7/0427; A61J 7/0436; A61J 7/0445; G09F 11/23; G09F 11/24
USPC ..... 206/534, 459.1, 540; 215/230
See application file for complete search history.

(56) References Cited

U.S. PATENT DOCUMENTS 6,386,367 B1 * 5/2002 Bayliss, IV ..... A61J 1/03 206/459.5
8,915,371 B2 * 12/2014 Giocastro ..... B65D 83/04 206/538

(Continued)

*Primary Examiner* — Robert Poon
(74) *Attorney, Agent, or Firm* — Craig Hoersten

(57) ABSTRACT

A time programmable container that includes a base, a reversible lid, and a spacer positioned intermediate the lid and the base. The spacer is positionable in a select one of a plurality of positions on the base. The spacer and the base contain time indicia such that each of the plurality of positions that the spacer can be placed upon the base corresponds to a different of time indication. The reversible lid includes a cavity on the bottom surface of a lip which mates with a tab on the spacer, such that when the spacer is placed upon the base and the lid is threaded onto the base, the tab secures prevents the removal of the lid from the base without first removing the tab from the cavity, and when the lid is reversed, the tab does not inhibit the removal of the lid from the base.

6 Claims, 48 Drawing Sheets

Related U.S. Application Data application No. 12/541,942, filed on Aug. 15, 2009, now abandoned.

(60) Provisional application No. 62/311,998, filed on Mar. 23, 2016, provisional application No. 61/787,581, filed on Mar. 15, 2013.

(56) References Cited

U.S. PATENT DOCUMENTS

| | | | | |
|---|---|---|---|---|
| 9,963,280 | B1 * | 5/2018 | Kosierkiewicz ..... | B65D 50/066 |
| 2009/0050514 | A1 * | 2/2009 | Devaux-Day ..... | A61J 1/03 206/538 |

* cited by examiner

CONTAINER TIME INDICATOR WITH A DEVICE FOR INHIBITING THE REMOVAL OF THE CAP

TECHNICAL FIELD

The present application is generally related to a container having programmable time indicator and more particular to a container or bottle having a programmable time indicator integrated with a device to inhibit or substantially inhibit the opening of the container or bottle by a targeted group of people or users.

BACKGROUND

Often concentrated substances need to be preserved, usually in the form of a liquid or powder, which are dissolved in a solvent, generally composed of water, only at the time they are used. Typically this occurs, for example, in the domestic area for advance preparation of fertilizers, medicines, herbicides or other similar solutions.

The fact that these substances can be kept in sealed containers enables the following advantages: first, a bottle or similar container can be filled with the desired solution only when there is an actual need to use it, and second, many of the substances mentioned above tend to deteriorate over time once they are put in solution, but retain their quality for extremely long periods of time if kept in an essentially airtight package.

These containers may also apply to children's beverage containers. Once these containers have been filled with a liquid such as milk or juice, these beverage containers have to be consumed within a certain timeframe. Furthermore, caregivers within institutions often find a multitude of these containers within a refrigerator in various stages of use. These containers may be full, partially full or near empty so that there is a need for an indication as to when the container was originally filled.

SUMMARY

A time programmable container for timing an object may include a base for containing the object, a lid for sealing the base member, and a spacer which may rotate on the base in a first position and may lock onto the base in a second position.

The spacer may include time indicia adapted to be aligned to a marker of the base member.

The base may include a locking device to lock the spacer after it is aligned.

The locking device may include a finger to cooperate with a depression of the spacer member.

The base may be threadably connected to the lid member.

The lid and spacer may include a device or mechanism, that when engaged, substantially inhibits the opening of the lid member.

DETAILED DESCRIPTION

Figure 1:
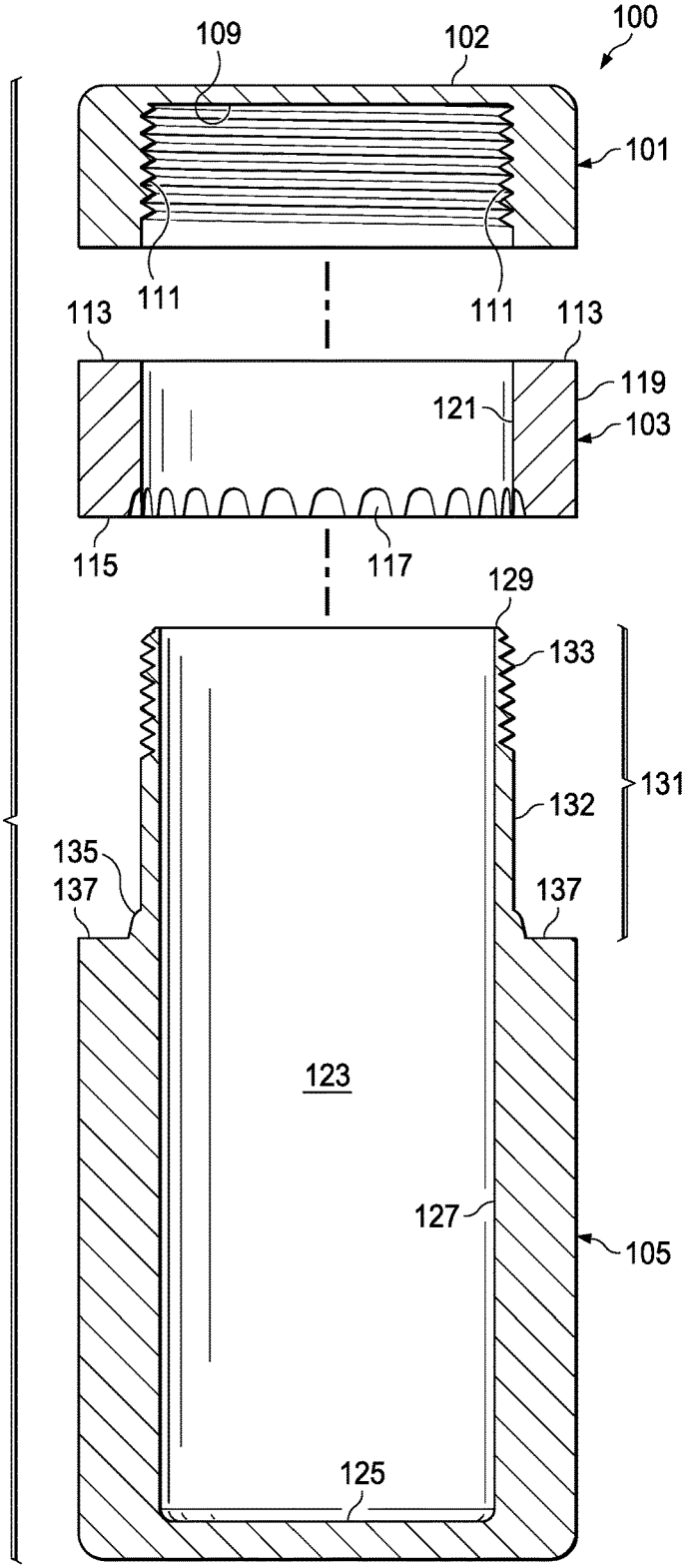
FIG. 1 illustrates an exploded cross-sectional view of the time programmable container of the present invention.

As used herein, the use of the word "a" or "an" when used in conjunction with the term "comprising" in the claims and/or the specification may mean "one", but it is also consistent with the meaning of "one or more," "at least one", and "one or more than one". Still further, the terms "having", "including", "containing" and "comprising" are interchangeable and one of skill in the art is cognizant that these terms are open-ended terms. Some embodiments of the invention may consist of or consist essentially of one or more elements, method steps, and/or methods of the invention. It is contemplated that any method or composition described herein can be implemented with respect to any other method or composition described herein.

Referring now to the drawings, wherein various elements depicted therein are not necessarily drawn to scale and wherein through the various views and figures like elements may be referenced with identical or similar references numerals, there is illustrated embodiments of a time programmable container according to the principles of the present invention.

Referring now to FIGS. 1-6, there is illustrated an embodiment of a time programmable container 100. As illustrated time programmable container 100 includes a lid 101, a spacer 103 and a base 105. Lid 101 is used to seal the time programmable container 100. Spacer 103 cooperates with the lid 101 and base 105 and is used to provide an indication of time (see for example FIGS. 6, 14 and 24), which may be selected or programmed from a plurality of indications. Base 105 is configured with a storage region 123 and is used to contain time sensitive material such as solids, liquids, medicines, food and other appropriate materials.

Spacer 103 and the corresponding time indicia may be programmed to indicate various properties of the materials contained within base 105, such as but not limited to: the time that the container was filled; the last time the container was either opened or closed; an expiration time for the materials stored therein. As can be appreciated the materials from which the elements of time programmable container 100 can be any of a number of rigid and flexible materials, such as, but not limited to various plastics, glass, and metals, or other appropriate material. Although, the time programmable container 100 is illustrated as an elongated cylinder, it is contemplated that other shapes such as rectangle, oval or other shapes and combinations of shapes could be used.

The lid 101 includes an upper exterior surface 102 which is in a spaced relationship with the upper interior surface 109. Upper interior surface 109 extends to the side interior surface 111. Side interior surface 111 extends around the inner periphery of the lid 101. The side interior surface 111 is a threaded surface and used to mate with threads 133 of base 105.

The spacer 103 is ringed shaped and includes a central aperture which extends through the spacer 103. The spacer 103 includes a top surface 113 which extends around the periphery of the spacer 103. The top surface 113 is intermediate and connects to the exterior surface 119 and the interior surface 121 of spacer 103. The exterior surface 119 and the interior surface 121 define a bottom surface 115.

Bottom surface 115 includes a plurality of depressions or indentations 117 which extend around the interior surface 121 and extend from bottom surface 115 up into spacer 103 and include an arcuate top portion distal from bottom surface 115. It is contemplated that the number of depressions 117 utilized will depend upon the number of alignments for spacer 103 as desired by the user.

As illustrated, the base 105 is an elongated cylinder having a central storage region 123 to hold articles or liquids. The storage region 123 is defined by a base inner bottom surface 125 and a base inner side surface 127 which extends around the periphery of the base 105. The base 105 includes a base top surface 129 which extends around the periphery of the base 105 and cooperates with the upper inner surface 109 of lid 101 to form a seal. The base 105 includes a neck portion 131 which extends around the periphery of the base 105 and includes a threaded portion 133 which are configured to cooperate or mate with the threads of the side interior surface 111 of lid 101. The neck portion 131 also includes an unthreaded portion 132 which is configured to slidably engage the spacer 103. A shoulder 137 extends around the periphery of base 105 and is located at the bottom portion of the neck portion 131 opposite top surface 129.

The base 105 further includes a radial finger 135 which extends from the shoulder 137 and up neck portion 131 into the unthreaded portion 132, with the top portion of each of the radial fingers including an arcuate portion that is complementary of the arcuate portion of depression 117. The radial finger 135 is configured to only cooperate with a single depression 117 at a time of the plurality of depressions so that when the spacer 103 is placed over the neck 131 and onto the shoulder 137, the radial finger 135 will be positioned within a single depression 117, such that when the lid 101 is threadably engaged with the base 105 and the interior surface 109 of lid 101 is engaging top surface 129 of base 105, the finger 135 is inserted or engaged with depression 117 and will prevent the spacer 103 from rotating about base 105. As illustrated the shape and size of radial fingers 135 is a complement of the shape and size of depressions 117.

Figure 6:
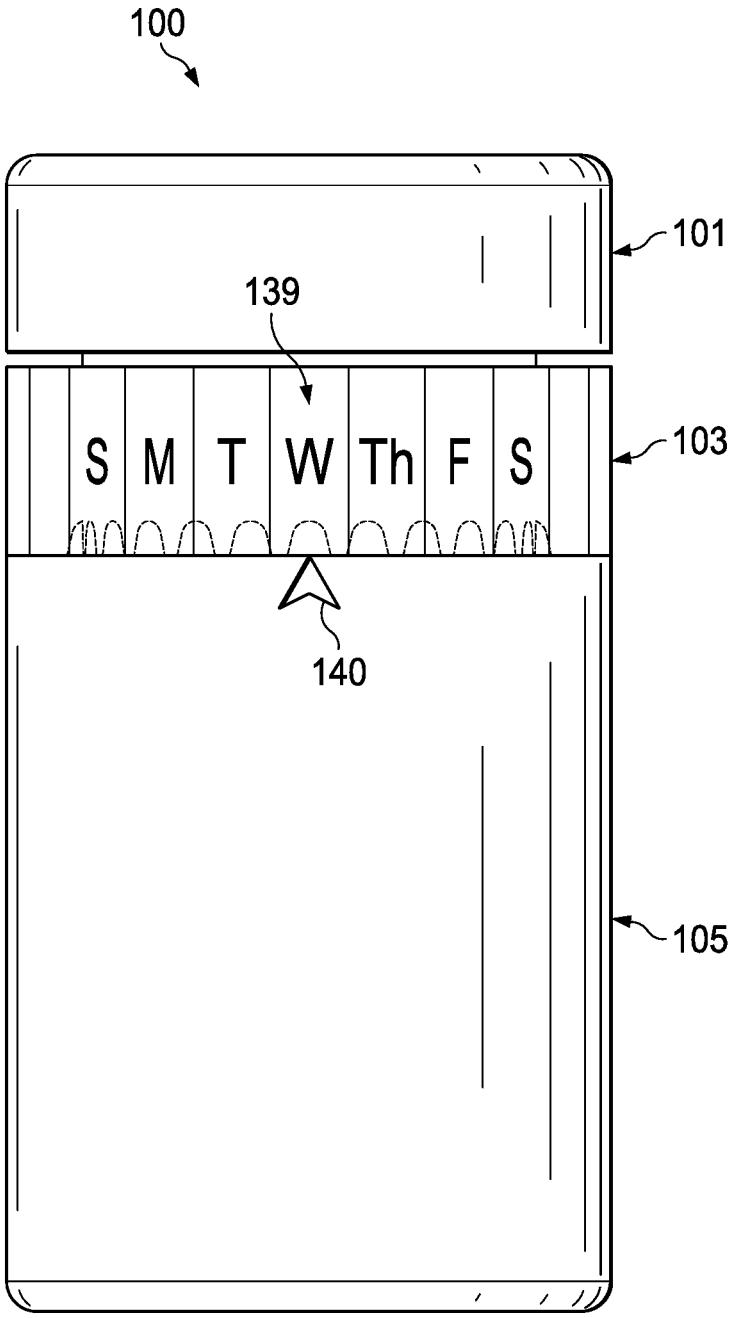
FIG. 6 illustrates a front view of the time programmable container of the present invention.
Figure 7:
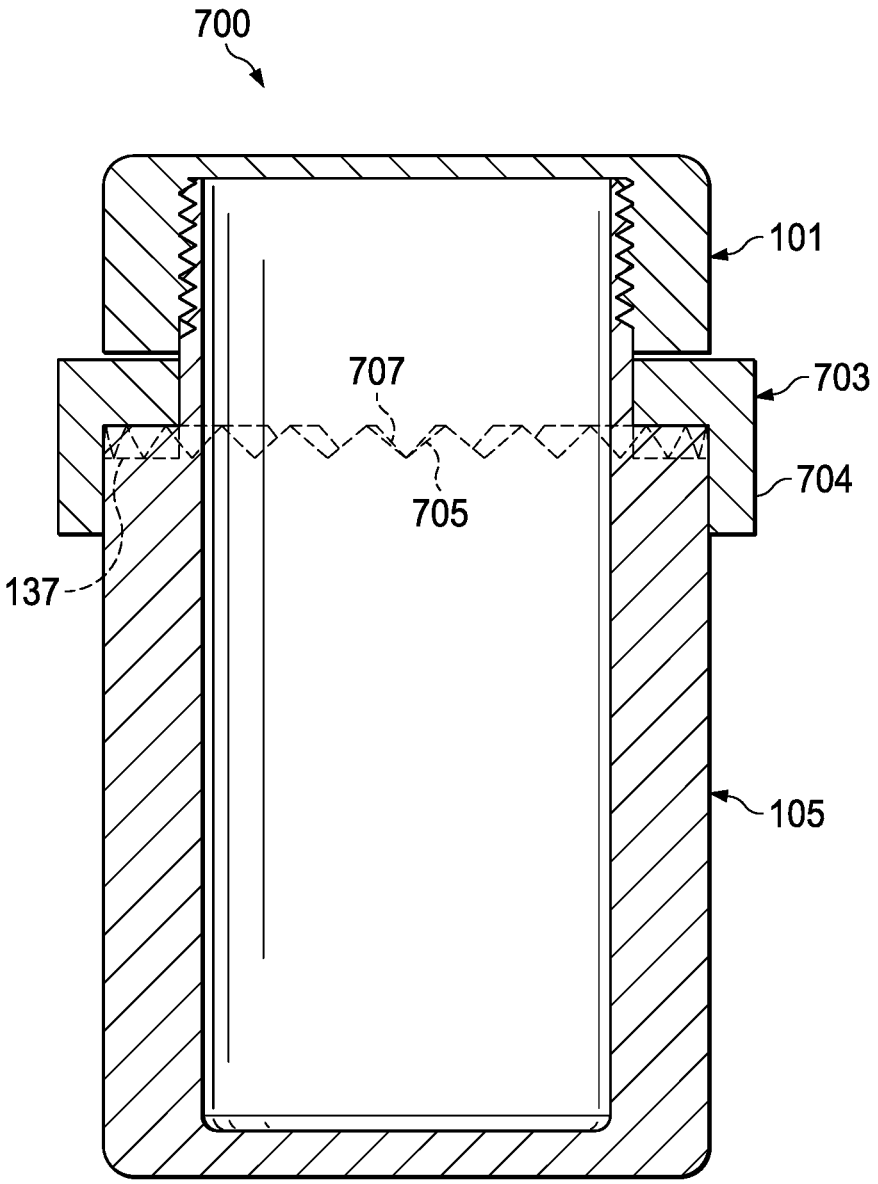
FIG. 7 illustrates a cross-sectional view of an alternative embodiment of a time programmable container of the present invention.
Figure 8:
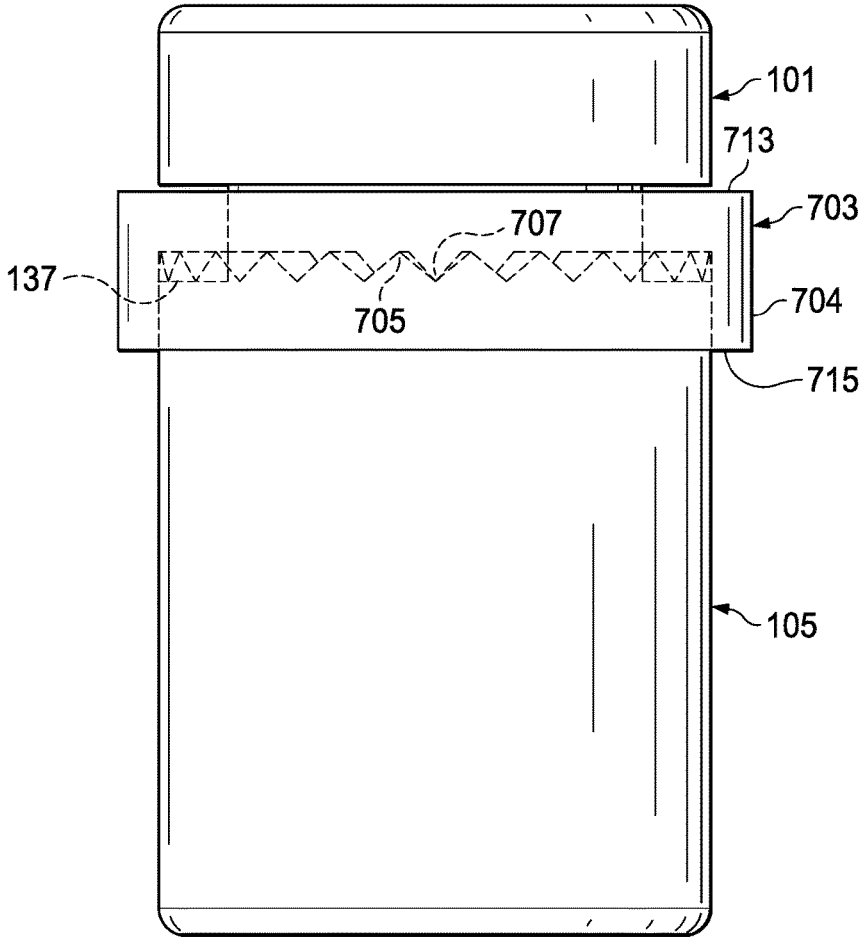
FIG. 8 illustrates a front view of the time programmable container of the present invention as similarly shown in FIG. 7.
Figure 9:
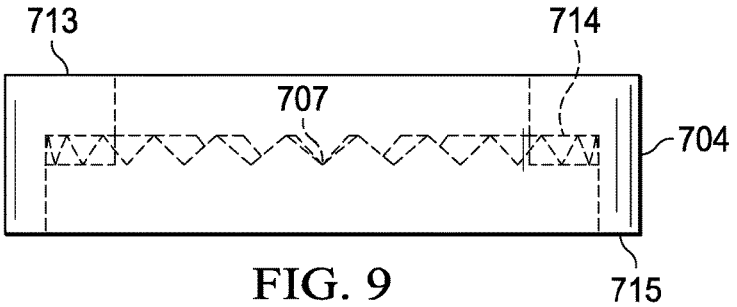
FIG. 9 illustrates the spacer of the time programmable container of the present invention as similarly shown in FIG. 8.
Figure 10:
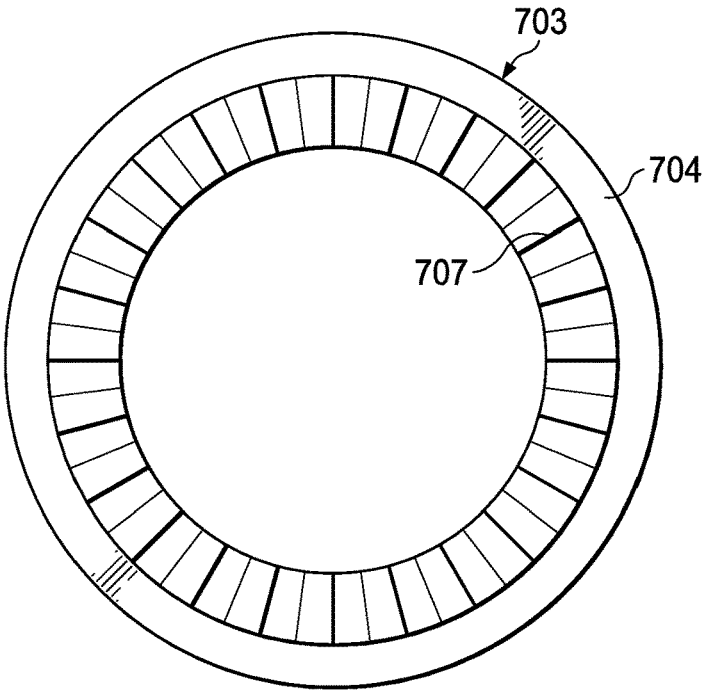
FIG. 10 illustrates a bottom view of the spacer of the present invention as similarly shown in FIGS. 7-9.

As illustrated in FIG. 6 (and FIGS. 14, 15 and 25), the spacer 103 and base 105 include time indicia 139 (and 161 and 165). The time indicia may correspond to various types of time indications, such as, but not limited to days of the week, and periods of time such as minutes, hours, days, weeks, months or years. These indicia may be utilized to indicate the period of time to associate with the articles or liquids within the central storage region 123. Additionally, an arrow or pointer 140 and 163 can be placed on the base 105 and used to cooperate with any of the used time indicia.

In operation, a user will identify a desired time indicator on spacer 103. With the lid 101 and spacer 103 removed from base, the user will take spacer 103 and start to place it over the neck 131. Prior to the radial finger 135 engaging any of the depressions 117, the user will rotate the spacer 103 clockwise or counterclockwise, sequentially or non-sequentially about the neck 131 of the base 105 until the desired time indicator is in alignment with the arrow 140. Upon alignment, the user will then proceed to slide spacer 103 over the neck 131 until the bottom surface 115 engages shoulder 137 and finger 135 is inserted into a corresponding aligned indentation 117. Subsequent to the placement of the spacer 103 onto the shoulder 137, the user places the lid 101 onto the top of neck 131 such that the threads of interior surface 111 engage with the threads of threaded portion 133. The user then rotates the lid 101 down onto the neck 131 until the upper surface 129 of base 105 engages upper surface 109 of lid 101. When positioned as such, the lid 101 is positioned close to or proximate with or even engaged with, the spacer 103 so as to prevent the spacer 103 from moving in an upward motion along neck 131. Additionally, when the lid is in such position, the finger 135 is engaged with indentation 117, this locks or prevents the rotation of space 103 about the neck 131 of base 105. Once spacer 103 is placed onto shoulder 137, the arrow 140 will be in alignment with the selected time indicator. (See for example FIGS. 5, 6, 19, 20 and 24).

Figure 2:
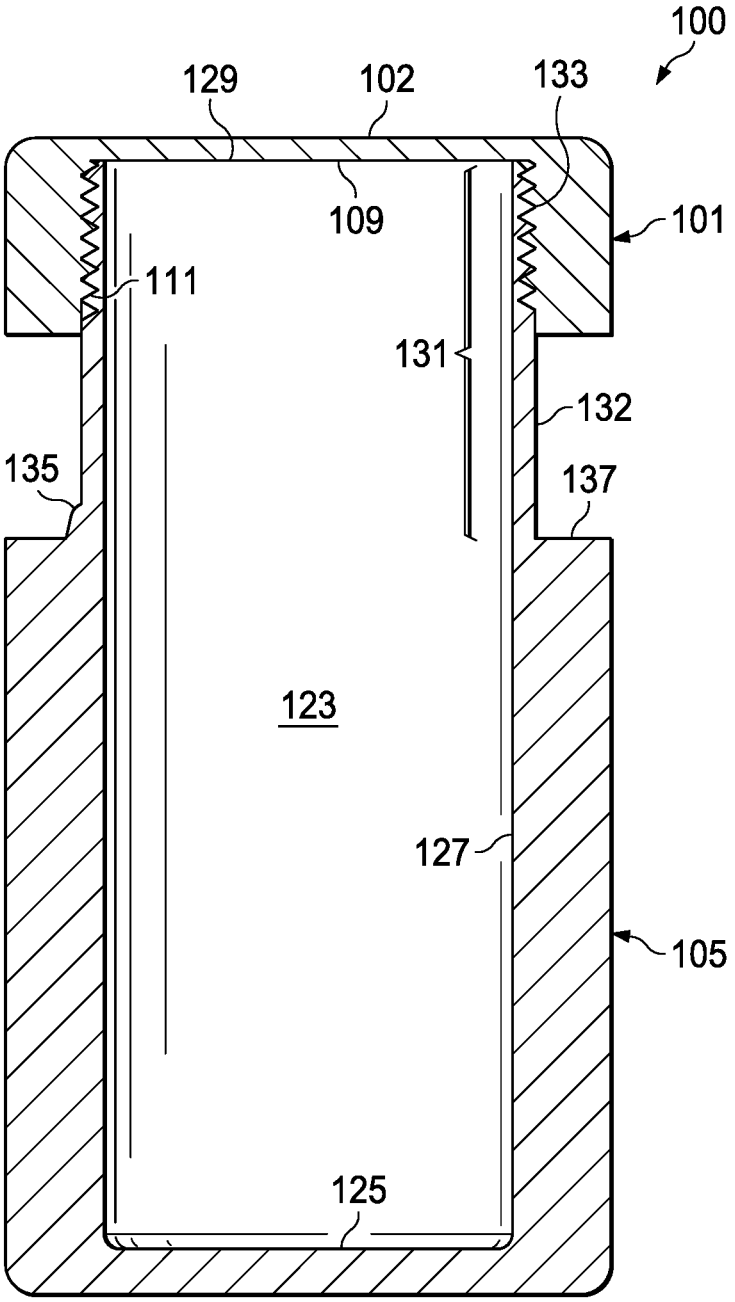
FIG. 2 illustrates a cross-sectional view of the time programmable container of the present invention without the spacer member.

Referring now in particular to FIG. 2, there is illustrated the programmable container 100 as illustrated in FIG. 1 with the spacer 103 removed and the lid 101 secured to base 105. As described with reference to FIG. 1, time programmable container 100 includes a lid 101 and a base 105. Lid 101 is used to seal the time programmable container 100. Base 105 is configured with a storage region 123 and is used to contain time sensitive material such as solids, liquids, medicines, food and other appropriate materials.

The lid 101 includes an upper exterior surface 102 which is in a spaced relationship with the upper interior surface 109. Upper interior surface 109 extends to the side interior surface 111. Side interior surface 111 extends around the inner periphery of the lid 101. The side interior surface 111 is a threaded surface and used to mate with threads 133 of base 105.

As illustrated, the base 105 is an elongated cylinder having a central storage region 123 to hold articles or liquids. The storage region 123 is defined by a base inner bottom surface 125 and a base inner side surface 127 which extends around the periphery of the base 105. The base 105 includes a base top surface 129 which extends around the periphery of the base 105 and cooperates with the upper inner surface 109 of lid 101 to form a seal. The base 105 includes a neck portion 131 which extends around the periphery of the base 105 and includes a threaded portion 133 which are configured to cooperate or mate with the threads of the side interior surface 111 of lid 101. The neck portion 131 also includes an unthreaded portion 132 which is configured to slidably engage the spacer 103. A shoulder 137 extends around the periphery of base 105 and is located at the bottom portion of the neck portion 131 opposite top surface 129. The base 105 further includes a radial finger 135 which extends from the shoulder 137 and up neck portion 131 into the unthreaded portion 132.

Figure 3:
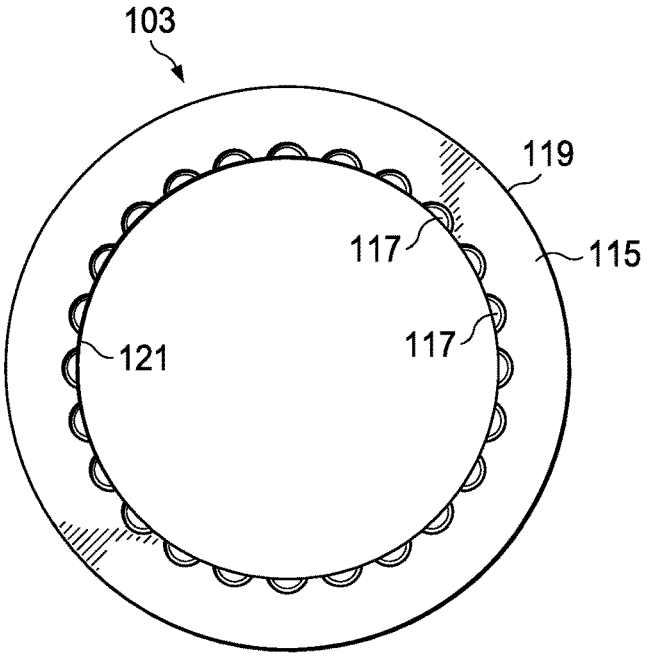
FIG. 3 illustrates a bottom view of the spacer of the present invention.
Figure 4:
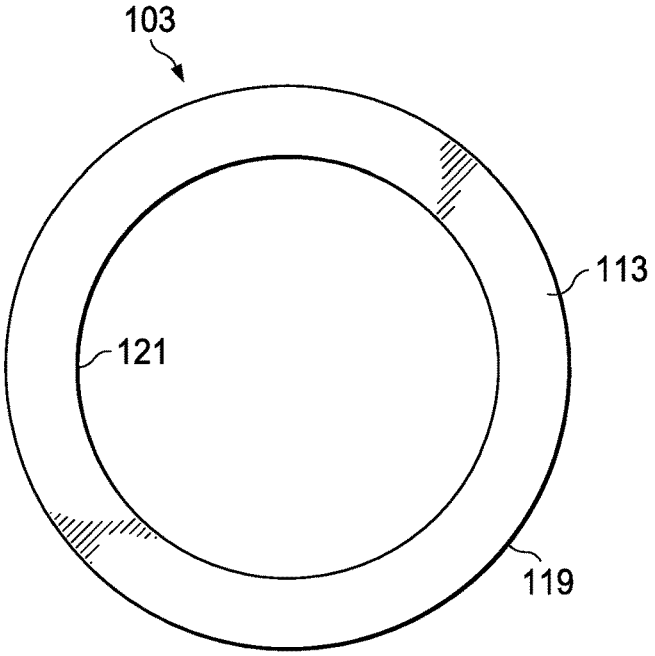
FIG. 4 illustrates a top view of the spacer of the present invention.

Referring now to FIGS. 3 and 4, there is illustrated more detailed view of the spacer 103, with FIG. 3 being a bottom view of the spacer 103 and FIG. 4 illustrating a top view of the spacer 103.

As illustrated, there is a plurality of indentations 117 which extend around the interior perimeter of spacer 103 proximate to the bottom surface 115. As described herein above, the indentations 117 are configured to receive therein a radial finger 135 of base 105, such that when the spacer 103 is placed over the neck 131 of base 105 in a particular alignment of the user choosing, the radial finger 135 will mate with or be inserted into the corresponding indentations 117 of the plurality of indentations. Further, subsequent to a user placing the spacer 103 over the neck 131 of base 105, the lid 101 can be secured to base 105 via threads 133. When the lid 101 has been rotated to completion, i.e. top surface 129 of base 105 engages with the upper inner surface 109 of lid 101, lid 101 prevents the removal of spacer 103 from base 105, while the mating of finder 135 and indentation 117 prevent the rotation of spacer 103 about the neck 131 of base 105.

Figure 5:
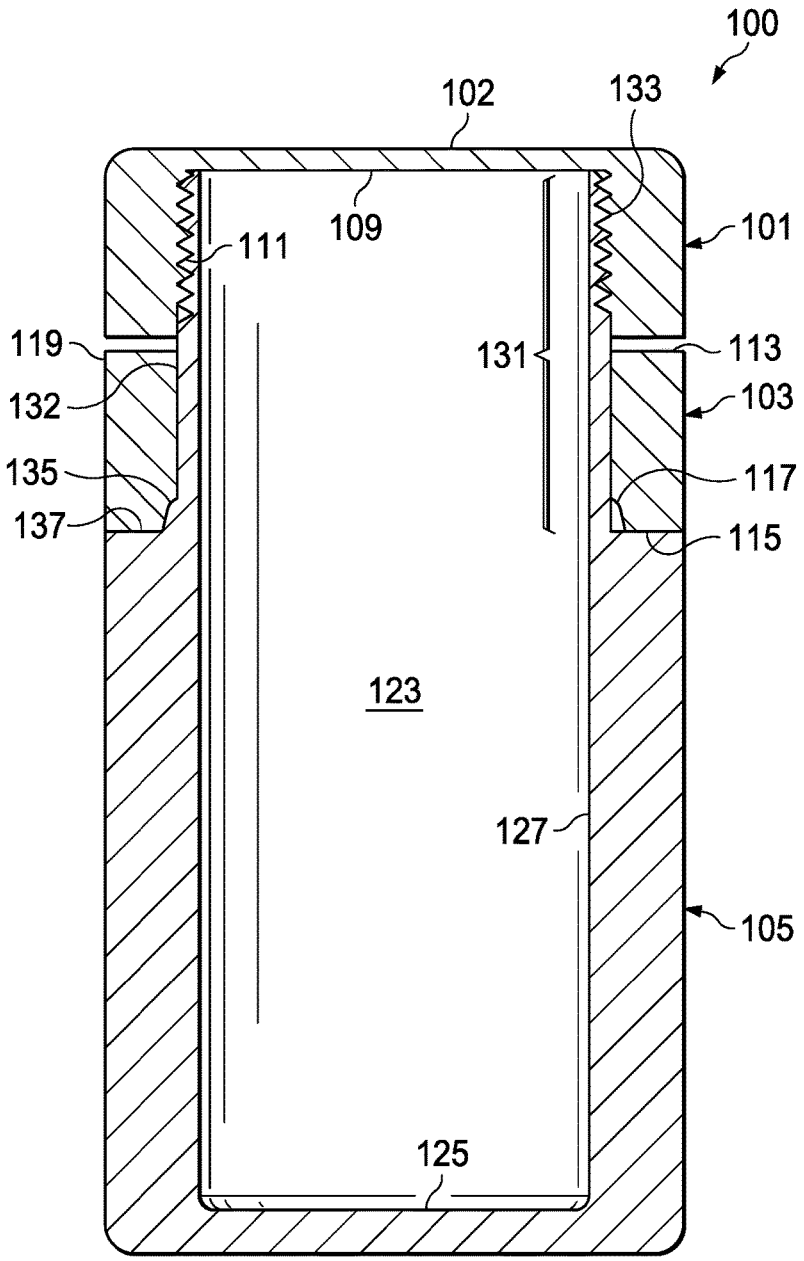
FIG. 5 illustrates a cross-sectional view of the time programmable container of the present invention.

Referring now to FIG. 5, there is illustrated a cross-sectional view of the time programmable container 100 with the spacer 103 placed over the neck 131 of base 105 and the lid 101 threaded onto base 105 with the top surface 129 of base 105 engaging the upper inner surface 109 of lid 101, this being the closed position of the present invention. Although illustrated with a small gap between the lid 101 and spacer 103, it is contemplated that no gap could be present, or if present, the gap would be small enough to prohibit sufficient movement of spacer 103 along neck 131 of base 105 and would maintain radial finger 135 in indentation 117, thereby preventing the rotation of spacer 103 around neck 131 of base 105.

Referring now to FIG. 6, there is illustrated the programmable time container 100 as similarly shown in FIGS. 1-5 in the closed position. As illustrated spacer 103 includes indicia of time 139 and a corresponding arrow or pointer 140. As illustrated in the exemplary embodiment, the indicia of time 139 are initials representing the days of the week. However, it is contemplated that the indicia of time 139 could be letters, number, symbols, shapes, colors or any combination thereof to give the user a reference of the selected indicia of time. As described above, in use, prior to placing spacer 103 onto base 105, the user will rotate spacer 103 until the selected indicia of time is in alignment with the pointer 140, here the W is in alignment with pointer 140. The spacer 103 is placed over neck 131 of base 105 until the corresponding finger 135 and indentation match up and mate, keeping the selected indicia of time 139 in alignment with pointer 140. Subsequent to the placement of spacer 103 onto base 105, lid 101 is then threaded upon base 105, thus securing any contents within base 105 and further preventing the rotation of spacer 103 about neck 131 of base 105.

Referring now to FIGS. 7-10, there is illustrated another embodiment of a time programmable container 700 in accordance with the principles of the present invention. As illustrated, time programmable container 700 includes a lid 101, base 105 and spacer 703. The spacer 703 includes a flange 704 which extends around the perimeter of spacer 703 and is configured to cooperate with the outer side surface of the base 105 when spacer 703 is placed upon base 105. Shoulder 137 of base 105 includes a plurality of upward extending projections 705 extending around the circumference of base 105 with the projections 705 being saw-toothed or serrated shaped upward projections. Similarly, spacer 703 includes a plurality of downward extending projections 707 with the projections 707 being saw-toothed or serrated shaped downward projections and are configured in size and shape to mate with projections 705. The downward extending projections 707 extend around the inner circumference of spacer 703 and from an intermediate surface 714, with the intermediate surface 714 being between or intermediate the top surface 713 of spacer 703 and the bottom surface 715 of spacer 703.

In operation, spacer 703 operates in a similar manner as spacer 103 described herein above. A user will place spacer 703 over the neck of base 105 and rotate spacer 703 about the neck of base 105 until a desired location or alignment of spacer 703 with respect to base 105 is achieved. Spacer 703 is then lowered onto base 105 such that projections 705 of base 105 mate with projections 707 of spacer 703. Subsequent thereto, lid 101 is threadably engaged with base 105 and rotated thereon. Once lid 101 is completely threaded onto base 105, the location of lid 101 will prevent the movement of spacer 703 off of the neck of base 105 and will, in addition to the engagement of projections 707 and 705, prevent the rotation of spacer 703 about base 105.

Figure 11:
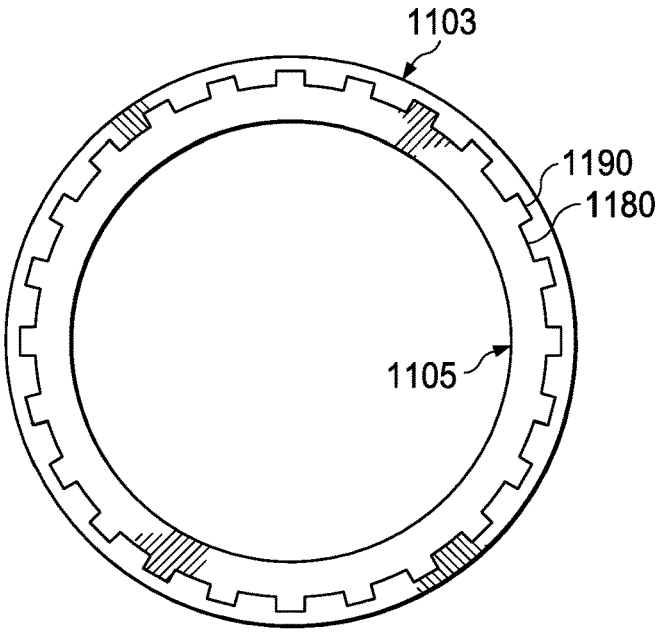
FIG. 11 illustrates a top view of an embodiment of a spacer of the present invention placed onto the neck of a container.
Figure 12:
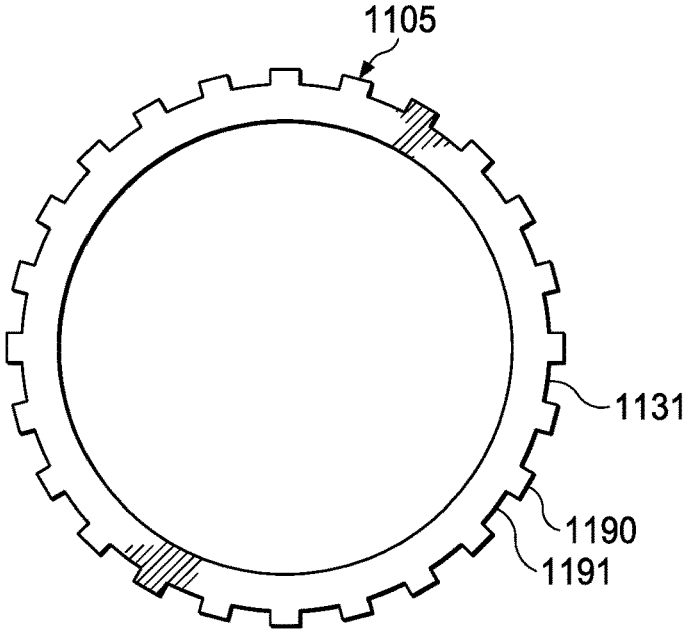
FIG. 12 illustrates a top view of an embodiment of a neck of the base of the present invention as similarly shown in FIG. 11.
Figure 13:
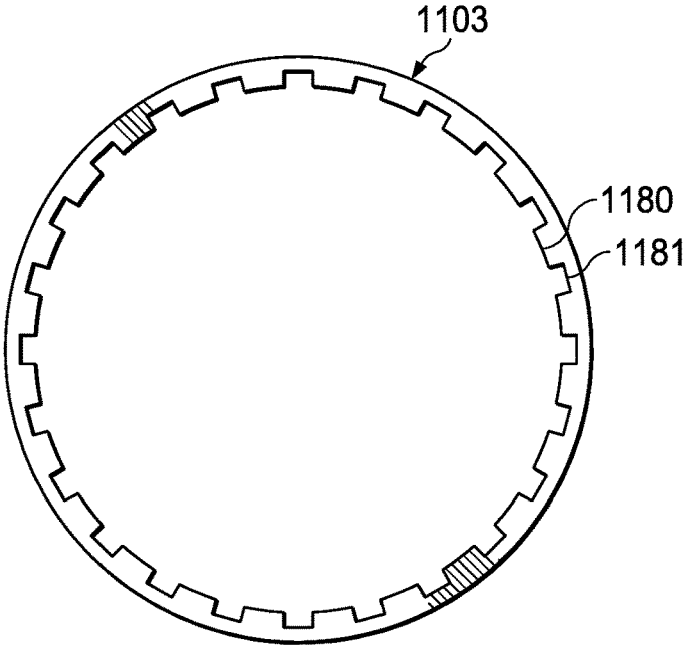
FIG. 13 illustrates a tope view of an embodiment of a spacer of the present invention as similarly shown in FIG. 11.

Referring now to FIGS. 11, 12 and 13, there is illustrated another embodiment of the present invention with FIG. 11 illustrating a top view of spacer 1103 placed upon base 1105 about neck 1131. As can be appreciated, base 1105 and spacer 1103 are similar to base 105 and spacer 1032 described herein above except that, as illustrated spacer 1103 includes a plurality of rectangular teeth 1180 that extend inward toward the center of spacer 1103 with a gap 1181 positioned between each of the plurality of teeth 1180, with teeth 1180 and gaps 1181 extending around the inner perimeter of spacer 1103. Similarly, base 1105 includes a plurality of rectangular teeth 1190 that extend outward from neck 1131 with a gap 1191 positioned between each of the plurality of teeth 1190, with teeth 1190 and gaps 1191 extending around the outer perimeter of neck 1131. As illustrated, teeth 1180 and 1190, and gaps 1181 and 1191 are sized to permit the mating of spacer 1103 upon base 1105 about neck 1131.

In operation, spacer 1103 operates in a similar manner as the spacers described herein above. A user will place spacer 1103 over the neck of base 1105 and rotate spacer 1103 about the neck of base 1105 until a desired location or alignment of spacer 1103 with respect to base 1105 is achieved. Spacer 1103 is then lowered onto base 1105 such that teeth 1190 of base 1105 mate with gaps 1181 of spacer 1103 and teeth 1180 of spacer 1103 mate with gaps 1191 of base 1105. Subsequent thereto, a lid (not shown) is threadably engaged with base 1105 and rotated thereon. Once lid is completely threaded onto base 1105, the location of lid will prevent the movement of spacer 1103 off of the neck of base 1105 and will, in addition to the engagement of the teeth 1180 with gaps 1191 and teeth 1190 with gaps 1182, prevent the rotation of spacer 1103 about base 1105.

Figure 14:
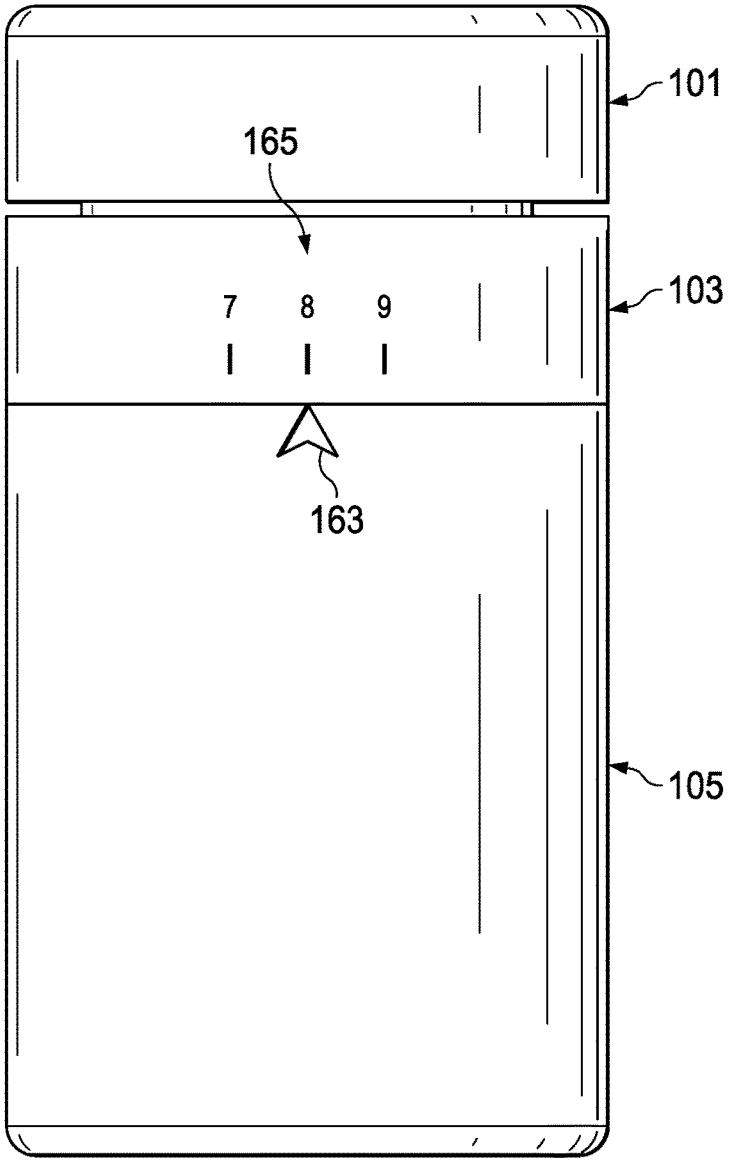
FIG. 14 illustrates a front view of an embodiment of a time programmable container of the present invention.

As illustrated in FIG. 14, the spacer 103 and base 105 include time indicia 165. The time indicia may correspond to various types of time indications, such as, but not limited to days of the week, and periods of time such as minutes, hours, days, weeks, months or years. These indicia may be utilized to indicate the period of time to associate with the articles or liquids within the central storage region 123. Additionally, an arrow or pointer 163 can be placed on the base 105 and used to cooperate with any of the selected time indicia by the user selecting a desired time indicia 165 and aligning the selected indicia 165 with arrow 163.

Figure 15:
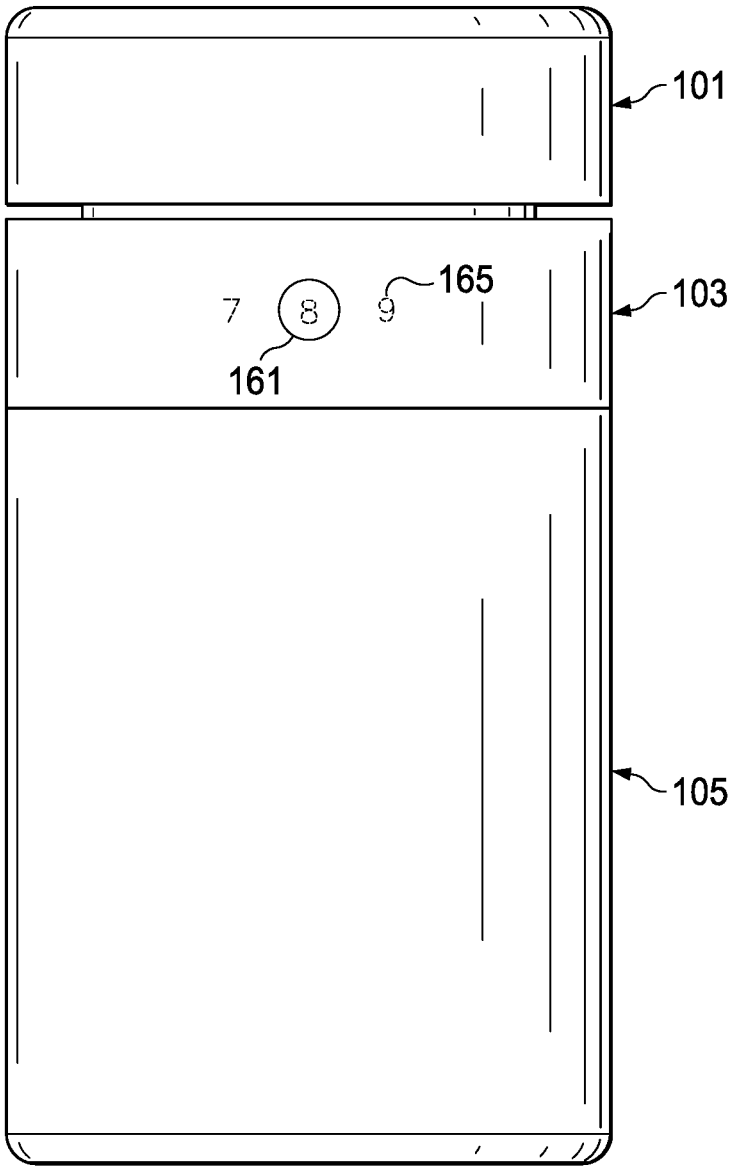
FIG. 15 illustrates a front view on an embodiment of a time programmable container of the present invention.

As illustrated in FIG. 15, the spacer 103 and base 105 include time indicia 165. The time indicia may correspond to various types of time indications, such as, but not limited to days of the week, and periods of time such as minutes, hours, days, weeks, months or years. These indicia may be utilized to indicate the period of time to associate with the articles or liquids within the central storage region 123. In this embodiment, the time indicia 165 are on neck 131 of base 105. Spacer 103 includes a target ring 161 or gap that is aligned over the selected time indicia to be displayed.

Referring now to FIGS. 16-20, there is illustrated an alternative embodiment of a time programmable container 100 as similarly illustrated in FIGS. 1-6 and having device or mechanism that inhibits the removal of the cap or lid 101 from the base 105 and spacer 103.

As illustrated in FIGS. 16-20, time programmable container 100 includes a lid 101, a spacer 103 and a base 105. Lid 101 is used to seal the time programmable container 100. Spacer 103 cooperates with the lid 101 and base 105 and is used to provide an indication of time (see for example FIGS. 6, 14 and 24), which may be selected or programmed from a plurality of indications. Base 105 is configured with a storage region 123 and is used to contain time sensitive material such as solids, liquids, medicines, food and other appropriate materials.

Spacer 103 and the corresponding time indicia may be programmed to indicate various properties of the materials contained within base 105, such as but not limited to: the time that the container was filled; the last time the container was either opened or closed; an expiration time for the materials stored therein. As can be appreciated the materials from which the elements of time programmable container 100 can be any of a number of rigid and flexible materials, such as, but not limited to various plastics, glass, and metals, or other appropriate material. Although, the time programmable container 100 is illustrated as an elongated cylinder, it is contemplated that other shapes such as rectangle, oval or other shapes and combinations of shapes could be used.

The lid 101 includes an upper exterior surface 102 which is in a spaced relationship with the upper interior surface 109. Upper interior surface 109 extends to the side interior surface 111. Side interior surface 111 extends around the inner periphery of the lid 101. The side interior surface 111 is a threaded surface and used to mate with threads 133 of base 105. A lip or rim 170 circumscribes the bottom portion of the outer perimeter of lid 101. Rim 170 includes cavities 172 on the bottom portion of rim 170 and are configured in shape and size to receive therein, tab 182 of spacer 103. The shape and configuration of each of the cavities 172 ensures the receipt therein of locking tab 182 when lid 101 is secured onto base 105 regardless of the initial alignment of spacer 103 with respect to base 105 and act as a stop to prevent the turning of lid 101 when secured onto the base 105.

The spacer 103 is ringed shaped and includes a central aperture which extends through the spacer 103. The spacer 103 includes a top surface 113 which extends around the periphery of the spacer 103. The top surface 113 is intermediate and connects to the exterior surface 119 and the interior surface 121 of spacer 103. The exterior surface 119 and the interior surface 121 define a bottom surface 115. Bottom surface 115 includes a plurality of depressions or indentations 117 which extend around the interior surface 121 and bottom surface 115. It is contemplated that the number of depressions 117 utilized will depend upon the number plurality of alignments for spacer 103 as desired by the user.

The spacer 103 includes a rigid lip or rim 180 that circumscribes a portion of the top portion of the outer perimeter of spacer 103 (see FIG. 18) and extends between the ends 180*a* and 180*b* of rim 180. Spacer 103 further includes a flexible tab 184 that connects between ends 180*a* and 180*b* of rim 180. Intermediate the two ends of flexile tab 184 is a locking tab 182. Locking tab 182 is a curved, elongated tab that is connected at one end thereof to flexible tab 184. Locking tab 182 is connected to flexible tab 184 in a manner that permits locking tab 182 to move in an up and down motion but is normally biased in a upwardly extending position with a portion of the end of locking tab 182 extending above the upper surfaces of flexible tab 184 and rim 180.

As illustrated, the base 105 is an elongated cylinder having a central storage region 123 to hold articles or liquids. The storage region 123 is defined by a base inner bottom surface 125 and a base inner side surface 127 which extends around the periphery of the base 105. The base 105 includes a base top surface 129 which extends around the periphery of the base 105 and cooperates with the upper inner surface 109 of lid 101 to form a seal. The base 105 includes a neck portion 131 which extends around the periphery of the base 105 and includes a threaded portion 133 which are configured to cooperate or mate with the threads of the side interior surface 111 of lid 101. The neck portion 131 also includes an unthreaded portion 132 which is configured to slidably engage the spacer 103. A shoulder 137 extends around the periphery of base 105 and is located at the bottom portion of the neck portion 131 opposite top surface 129.

The base 105 further includes a radial finger 135 which extends from the shoulder 137 and up neck portion 131 into the unthreaded portion 132. The radial finger 135 and depressions 117 are configured such that only one finger 135 can cooperate with a single depression 117 at a time of the plurality of depressions so that when the spacer 103 is placed over the neck 131 and onto the shoulder 137, the radial finger 135 will be positioned within a single depression 117, such that when the lid 101 is threadably engaged with the base 105 and the interior surface 109 of lid 101 is engaging top surface 129 of base 105, the finger 135 is inserted into and engaged with depression 117 and will prevent the spacer 103 from rotating about base 105.

Figure 20:
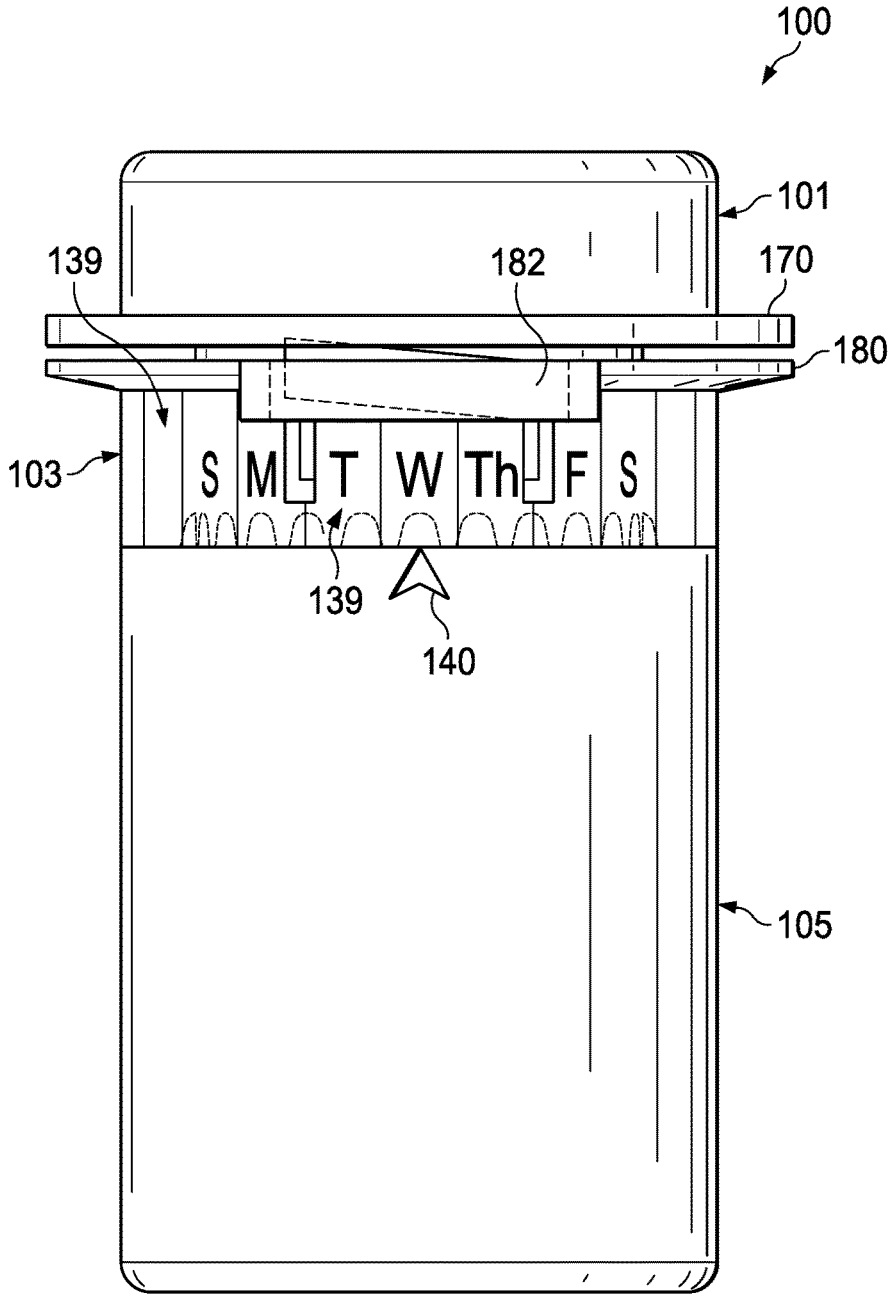
FIG. 20 illustrates a front view of an embodiment of a time programmable container as similarly shown in FIG. 6 with a device to inhibit the opening of the cap.

As illustrated in FIG. 20, the spacer 103 and base 105 include time indicia 139. The time indicia 139 may correspond to various types of time indications, such as, but not limited to days of the week, and periods of time such as minutes, hours, days, weeks, months or years. These indicia may be utilized to indicate the period of time to associate with the articles or liquids within the central storage region 123. Additionally, an arrow or pointer 140 can be placed on the base 105 and used to cooperate with any of the used time indicia 139.

In operation, a user will identify a desired time indicator on spacer 103. With the lid 101 and spacer 103 removed from base, the user will take spacer 103 and start to place it over the neck 131. Prior to the radial finger 135 engaging any of the depressions 117, the user will rotate the spacer 103 clockwise or counterclockwise, sequentially or non-sequentially about the neck 131 of the base 105 until the desired time indicator is in alignment with the arrow 140. Upon alignment, the user will then proceed to slide spacer 103 over the neck 131 until the bottom surface 115 engages shoulder 137 and finger 135 is inserted into a corresponding aligned indentation 117. Subsequent to the placement of the spacer 103 onto the shoulder 137, the user places the lid 101 onto the top of neck 131 such that the threads of interior surface 111 engage with the threads of threaded portion 133.

The user then rotates the lid 101 down onto the neck 131 until the upper surface 129 of base 105 engages upper surface 109 of lid 101. As the lid 101 is being rotated down neck 131 of base 105 and approaches spacer 103, a portion of the end of locking tab 182 will extend upward into a cavity 172 as the cavity 172 passes over locking tab 182. Locking tab 182 will flex downward as lid 101 is rotated and locking tab 182 exits cavity 172. As described above, the number, size and shape of cavity 172 is such that regardless of the orientation of spacer 103 with respect to 105, when the upper surface 129 of base 105 engages the upper surface 109 of lid 101, at least a portion of the end of locking tab 182 will extend into a cavity 172 of lid 101. Locking tab 182 is configured to permit the rotation of lid 101 in only one direction when locking tab 182 extends into a cavity 172 and prevents the rotation of lid 101 in the opposite direction.

When positioned as such, the lid 101 is positioned close to or proximate with or even engaged with, the spacer 103 so as to prevent the spacer 103 from moving in an upward motion along neck 131. Additionally, when the lid is in such position, the finger 135 is engaged with indentation 117, this locks and prevents the rotation of spacer 103 about the neck 131 of base 105. Once spacer 103 is placed onto shoulder 137, the arrow 140 will be in alignment with the selected time indicator. (See for example FIG. 20).

In order to remove spacer 103 and lid 101 from base 105, the user will depress flexible tab 184 in a downward motion. This motion removes locking tab 182 from engaged cavity 172. Maintaining the downward depression of flexible tab 184, the lid 101 can then be rotated in a direction opposite from the installation of lid 101 onto base 105 as described above. When the lid 101 has been sufficiently rotated such that the cavity 172 and the locking tab 182 cannot further engage when the locking tab 182 is in the normal biased position, the user may release the depression of flexible tab 184 and continue rotating lid 101 until removed from base 105.

Figure 16:
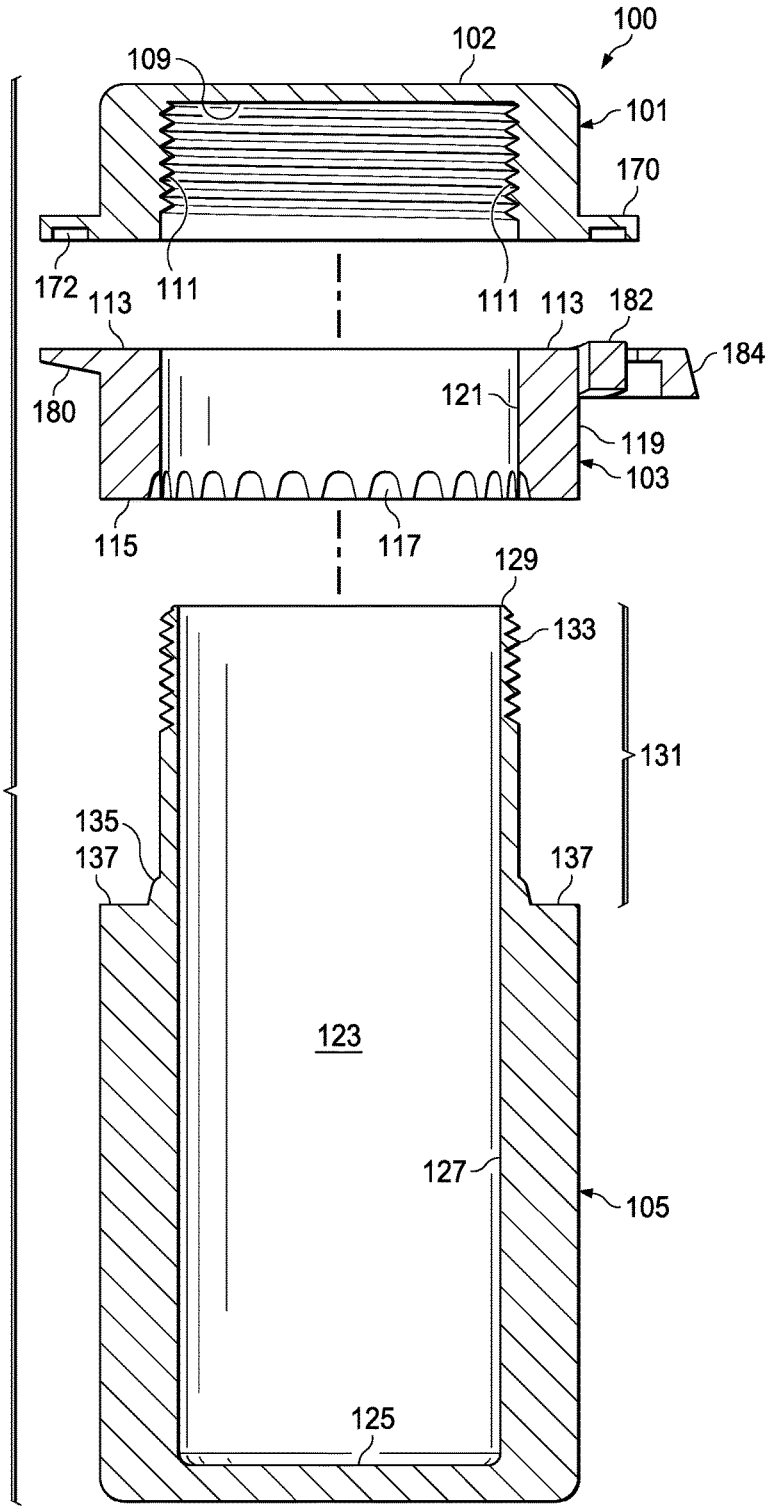
FIG. 16 illustrates an exploded cross-sectional view of an embodiment of a time programmable container as similarly shown in FIG. 1 with a device to inhibit the opening of the cap.
Figure 17:
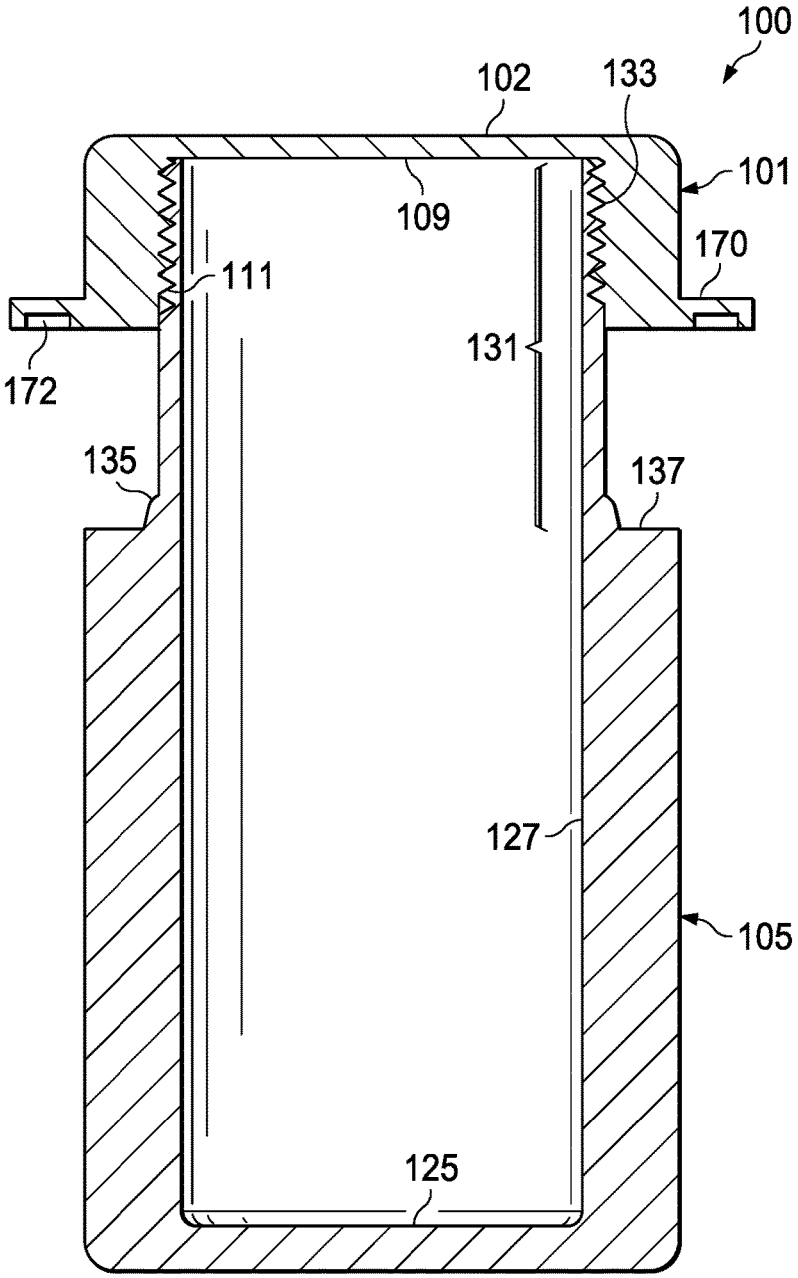
FIG. 17 illustrates a cross-sectional view of an embodiment of a time programmable container as similarly shown in FIG. 16 without the spacer member.

Referring now in particular to FIG. 17, there is illustrated the programmable container 100 as illustrated in FIG. 16 with the spacer 103 removed and the lid 101 secured to base 105. As described with reference to FIG. 16, time programmable container 100 includes a lid 101 and a base 105. Lid 101 is used to seal the time programmable container 100. Base 105 is configured with a storage region 123 and is used to contain time sensitive material such as solids, liquids, medicines, food and other appropriate materials.

The lid 101 includes an upper exterior surface 102 which is in a spaced relationship with the upper interior surface 109. Upper interior surface 109 extends to the side interior surface 111. Side interior surface 111 extends around the inner periphery of the lid 101. The side interior surface 111 is a threaded surface and used to mate with threads 133 of base 105.

As illustrated, the base 105 is an elongated cylinder having a central storage region 123 to hold articles or liquids. The storage region 123 is defined by a base inner bottom surface 125 and a base inner side surface 127 which extends around the periphery of the base 105. The base 105 includes a base top surface 129 which extends around the periphery of the base 105 and cooperates with the upper inner surface 109 of lid 101 to form a seal. The base 105 includes a neck portion 131 which extends around the periphery of the base 105 and includes a threaded portion 133 which are configured to cooperate or mate with the threads of the side interior surface 111 of lid 101. The neck portion 131 also includes an unthreaded portion 132 which is configured to slidably engage the spacer 103. A shoulder 137 extends around the periphery of base 105 and is located at the bottom portion of the neck portion 131 opposite top surface 129. The base 105 further includes a radial finger 135 which extends from the shoulder 137 and up neck portion 131 into the unthreaded portion 132.

Figure 18:
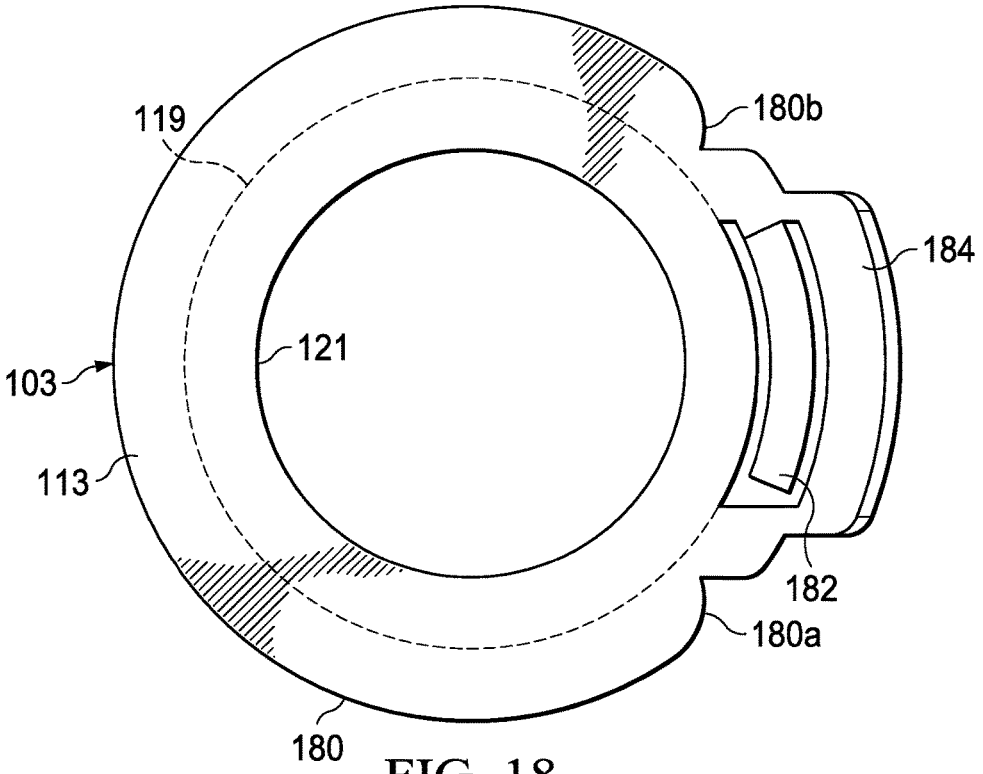
FIG. 18 illustrates a top view of the cap of the embodiment as similarly shown in FIGS. 17 and 18.

Referring now to FIG. 18, there is illustrated more detailed top view of the spacer 103. As illustrated, locking tab 182 is attached at one end to flexible tab 184. Flexible tab 184 is positioned between ends 180*a* and 180*b* of rim 180.

Figure 19:
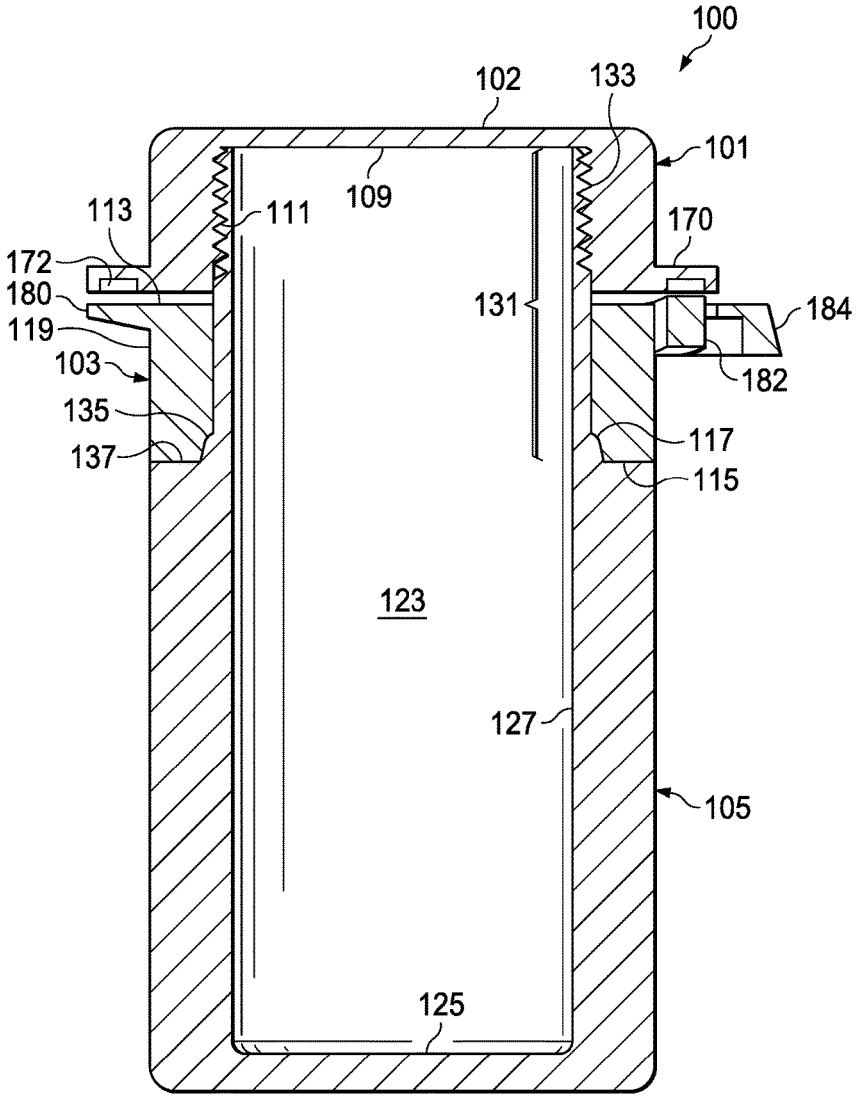
FIG. 19 illustrates a cross-sectional view of an embodiment of a time programmable container as similarly shown in FIGS. 16-18.

Referring now to FIG. 19, there is illustrated a cross-sectional view of the time programmable container 100 with the spacer 103 placed over the neck 131 of base 105 and the lid 101 threaded onto base 105 with the top surface 129 of base 105 engaging the upper inner surface 109 of lid 101, this being the closed position of the present invention. Although illustrated with a small gap between the lid 101 and spacer 103, it is contemplated that no gap could be present, or if present, the gap would be small enough to prohibit sufficient movement of spacer 103 along neck 131 of base 105 and would maintain radial finger 135 in indentation 117, thereby preventing the rotation of spacer 103 around neck 131 of base 105.

Referring now to FIG. 20, there is illustrated the programmable time container 100 as similarly shown in FIGS. 16-19 in the closed and locked position. As illustrated spacer 103 includes indicia of time 139 and a corresponding arrow or pointer 140. In the exemplary embodiment, the indicia of time 139 are initials representing the days of the week. However, it is contemplated that the indicia of time 139 could be letters, number, symbols, shapes, colors or any combination thereof to give the user a reference of the selected indicia of time. As described above, in use, prior to placing spacer 103 onto base 105, the user will rotate spacer 103 until the selected indicia of time is in alignment with the pointer 140, here the W is in alignment with pointer 140. The spacer 103 is placed over neck 131 of base 105 until the corresponding finger 135 and indentation match up and mate, keeping the selected indicia of time 139 in alignment with pointer 140. Subsequent to the placement of spacer 103 onto base 105, lid 101 is then threaded upon base 105 and when complete a portion of the end of locking tab 182 extends upward into one of the cavities 172 of lid 101, thus securing any contents within base 105 and further preventing the rotation of spacer 103 about neck 131 of base 105 and further locking lid 101 onto base 105.

Figure 21:
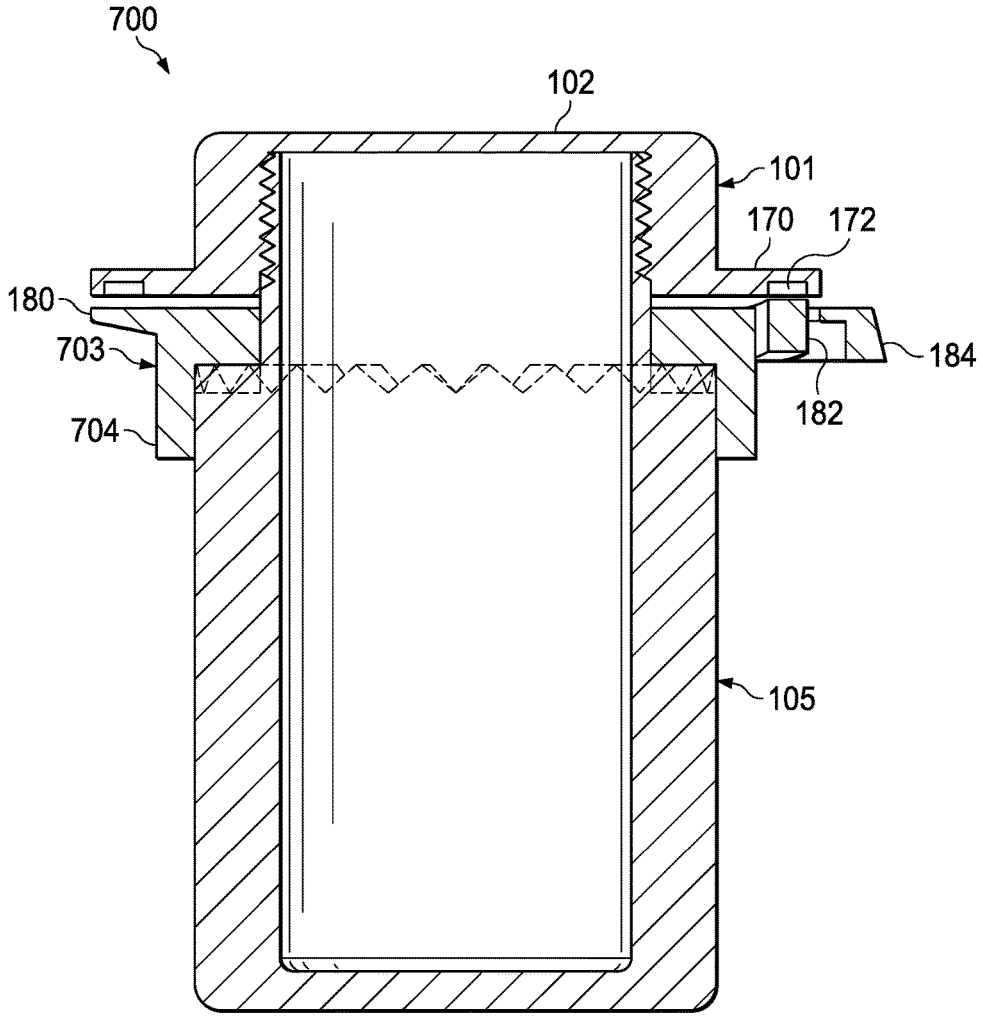
FIG. 21 illustrates a cross-sectional view of another embodiment of a time programmable container as similarly shown in FIG. 7 with a device to inhibit the opening of the cap.
Figure 22:
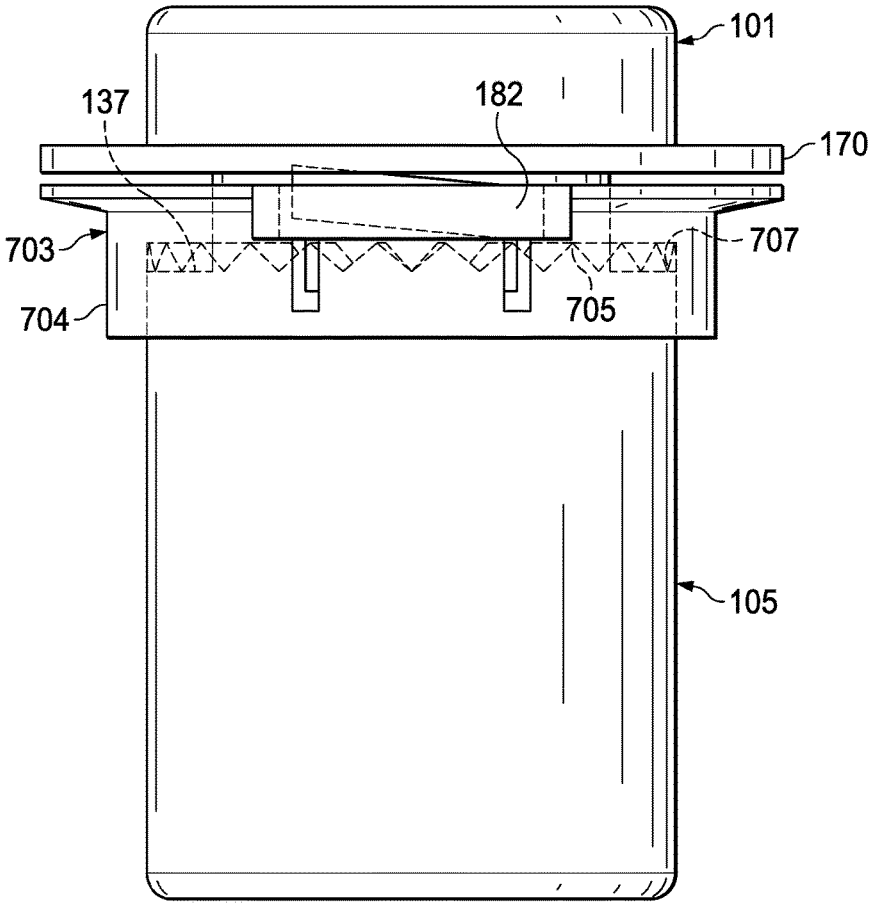
FIG. 22 illustrates a front view of an embodiment of a time programmable container as similarly shown in FIG. 21.

Referring now to FIGS. 21 and 22, there is illustrated another embodiment of a time programmable container 700 in accordance with the principles of the present invention. As illustrated, time programmable container 700 includes a lid 101, base 105 and spacer 703. The spacer 703 includes a flange 704 which extends around the perimeter of spacer 703 and is configured to cooperate with the outer side surface of the base 105 when spacer 703 is placed upon base 105. Shoulder 137 of base 105 includes a plurality of upward extending projections 705 extending around the circumference of base 105 with the projections 705 being saw-toothed or serrated shaped upward projections. Similarly, spacer 703 includes a plurality of downward extending projections 707 with the projections 707 being saw-toothed or serrated shaped downward projections and are configured in size and shape to mate with projections 705. The downward extending projections 707 extend around the inner circumference of spacer 703 and from an intermediate surface 714, with the intermediate surface 714 being between or intermediate the top surface 713 of spacer 703 and the bottom surface 715 of spacer 703.

In operation, spacer 703 operates in a similar manner as spacer 103 described herein above. A user will place spacer 703 over the neck of base 105 and rotate spacer 703 about the neck of base 105 until a desired location or alignment of spacer 703 with respect to base 105 is achieved. Spacer 703 is then lowered onto base 105 such that projections 705 of base 105 mate with projections 707 of spacer 703.

Subsequent thereto, the user then rotates the lid 101 down onto the neck 131 until the upper surface 129 of base 105 engages upper surface 109 of lid 101. As the lid 101 is being rotated down neck 131 of base 105 and approaches spacer 703, a portion of the end of locking tab 182 will extend upward into one of a plurality of cavities 172 as the cavities 172 pass over locking tab 182. Locking tab 182 will flex downward as lid 101 is rotated and locking tab 182 exits cavities 172. As described above, the number, size and shape of cavities 172 is such, that regardless of the orientation of spacer 703 with respect to 105, when the upper surface 129 of base 105 engages the upper surface 109 of lid 101, at least a portion of the end of locking tab 182 will extend into one of a cavity 172 of lid 101. Locking tab 182 is configured to permit the rotation of lid 101 in only one direction when locking tab 182 extends into cavity 172 and prevents the rotation of lid 101 in the opposite direction.

When the lid 101 is positioned close to or proximate with or even engaged with the spacer 703, spacer 703 is prevented from moving in an upward motion along neck 131. Additionally, when the lid is completely threaded onto base 105, the location of lid 101 will prevent the movement of spacer 703 off of the neck of base 105 and along with the engagement of projections 707 and 705, will prevent the rotation of spacer 703 about base 105.

In order to remove spacer 703 and lid 101 from base 105, the user will depress flexible tab 184 in a downward motion. This motion removes locking tab 182 from engaged cavity 172. Maintaining the downward depression of flexible tab 184, the lid 101 can then be rotated in a direction opposite from the installation of lid 101 onto base 105 as described above. When the lid 101 has been sufficiently rotated such that the cavity 172 and the locking tab 182 cannot further engage when the locking tab 182 is in the normal biased position, the user may release the depression of flexible tab 184 and continue rotating lid 101 until removed from base 105.

Referring now to FIGS. 24-30, there is illustrated another embodiment of a time programmable container 100 as similarly illustrated in FIGS. 16-20 and having device or mechanism that inhibits the removal of the cap or lid 101 from the base 105 and spacer 103.

As illustrated in FIGS. 24-30, time programmable container 100 includes a lid 101, a spacer 103 and a base 105. Lid 101 is used to seal the time programmable container 100. Spacer 103 cooperates with the lid 101 and base 105 and is used to provide an indication of time, which may be selected or programmed from a plurality of indications 165. Base 105 is configured with a storage region 123 and is used to contain time sensitive material such as solids, liquids, medicines, food and other appropriate materials.

Spacer 103 and the corresponding time indicia 165 may be programmed to indicate various properties of the materials contained within base 105, such as but not limited to: the time that the container was filled; the last time the container was either opened or closed; an expiration time for the materials stored therein. As can be appreciated the materials from which the elements of time programmable container 100 can be any of a number of rigid and flexible materials, such as, but not limited to various plastics, glass, and metals, or other appropriate material. Although, the time programmable container 100 is illustrated as an elongated cylinder, it is contemplated that other shapes such as rectangle, oval or other shapes and combinations of shapes could be used.

The lid 101 includes an upper exterior surface 102 which is in a spaced relationship with the upper interior surface 109. Upper interior surface 109 extends to the side interior surface 111. Side interior surface 111 extends around the inner periphery of the lid 101. The side interior surface 111 is a threaded surface and used to mate with threads 133 of base 105. A lip or rim 170 circumscribes the bottom portion of the outer perimeter of lid 101. Rim 170 includes a plurality of cavities 172 on the bottom portion of rim 170 and are spaced apart a determined distance, and are configured in shape and size to receive therein, tab 182 of spacer 103 (see FIGS. 27-29). The spacing and shape configuration of cavities 172 ensure the receipt therein of locking tab 182 when lid 101 is secured onto base 105 regardless of the user's alignment of spacer 103 with respect to base 105.

The spacer 103 is ringed shaped and includes a central aperture which extends through the spacer 103. The spacer 103 includes a top surface 113 which extends around the periphery of the spacer 103. The top surface 113 is intermediate and connects to the exterior surface 119 and the interior surface 121 of spacer 103. The exterior surface 119 and the interior surface 121 define a bottom surface 115. Bottom surface 115 includes a plurality of depressions or indentations 117 which extend around the interior surface 121 and bottom surface 115. It is contemplated that the number of depressions 117 utilized will depend upon the number plurality of alignments for spacer 103 as desired by the user.

The spacer 103 includes a rigid lip or rim 180 that circumscribes a portion of the top portion of the outer perimeter of spacer 103 and extends between the ends 180*a* and 180*b* of rim 180 (as shown and described in relation to FIG. 18). Spacer 103 further includes a flexible tab 184 that connects between ends 180*a* and 180*b* of rim 180. Intermediate the two ends of flexile tab 184 is a locking tab 182. Locking tab 182 is a curved, elongated tab that is connected at one end thereof to flexible tab 184. Locking tab 182 is connected to flexible tab 184 in a manner that permits locking tab 182 to move in an up and down motion but is normally biased in a upwardly extending position with a portion of the end of locking tab 182 extending above the upper surfaces of flexible tab 184 and rim 180.

As described herein above, the base 105 is an elongated cylinder having a central storage region 123 to hold articles or liquids. The storage region 123 is defined by a base inner bottom surface 125 and a base inner side surface 127 which extends around the periphery of the base 105. The base 105 includes a base top surface 129 which extends around the periphery of the base 105 and cooperates with the upper inner surface 109 of lid 101 to form a seal. The base 105 includes a neck portion 131 which extends around the periphery of the base 105 and includes a threaded portion 133 which are configured to cooperate or mate with the threads of the side interior surface 111 of lid 101. The neck portion 131 also includes an unthreaded portion 132 which is configured to slidably engage the spacer 103. A shoulder 137 extends around the periphery of base 105 and is located at the bottom portion of the neck portion 131 opposite top surface 129.

The base 105 further includes a radial finger 135 which extends from the shoulder 137 and up neck portion 131 into the unthreaded portion 132. The radial finger 135 and depressions 117 are configured such that only one finger 135 can cooperate with a single depression 117 at a time of the plurality of depressions so that when the spacer 103 is placed over the neck 131 and onto the shoulder 137, the radial finger 135 will be positioned within a single depression 117, such that when the lid 101 is threadably engaged with the base 105 and the interior surface 109 of lid 101 is engaging top surface 129 of base 105, the finger 135 is inserted into and engaged with depression 117 and will prevent the spacer 103 from rotating about base 105.

Figure 24:
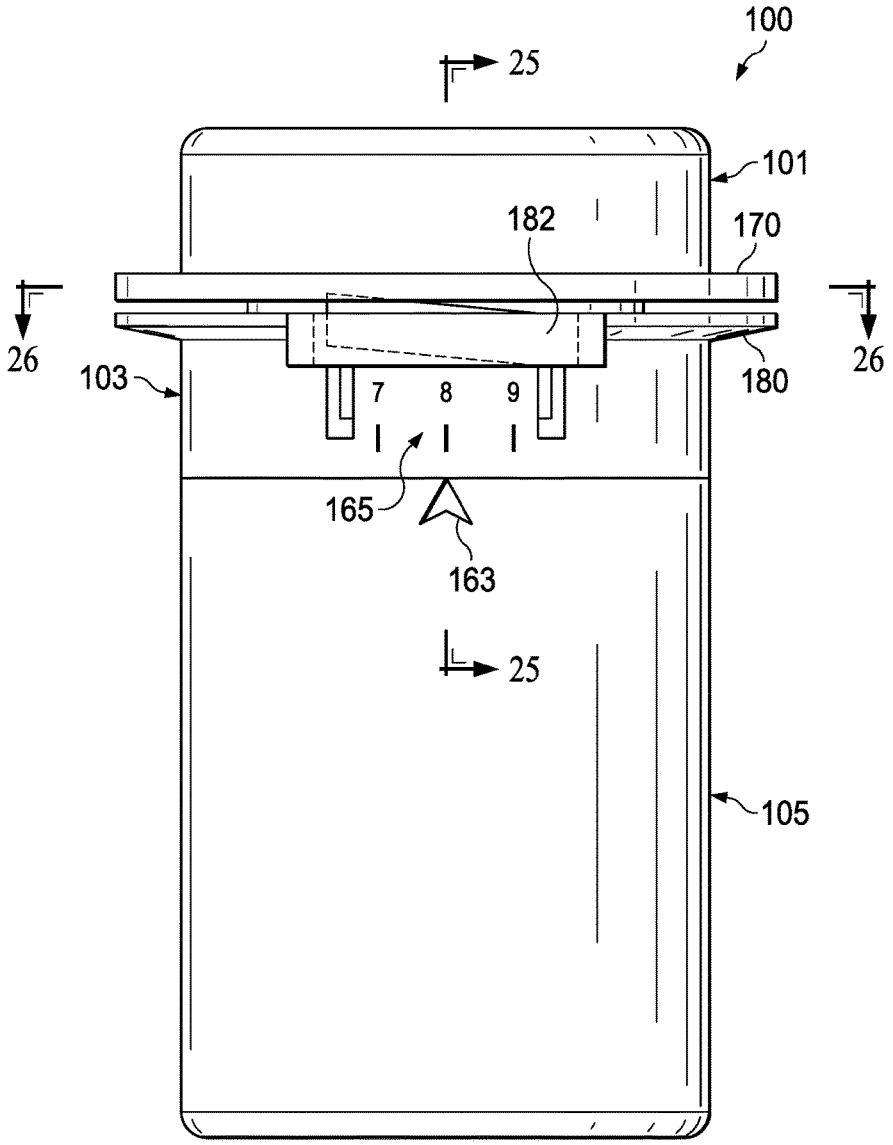
FIG. 24 illustrates a front view of an alternative embodiment of a time programmable container as similarly shown in FIG. 14 with a device to inhibit the opening of the cap.

As illustrated in FIG. 24, the spacer 103 includes time indicia 165. The time indicia 165 may correspond to various types of time indications, such as, but not limited to days of the week, and periods of time such as minutes, hours, days, weeks, months or years. These indicia may be utilized to indicate the period of time to associate with the articles or liquids within the central storage region 123. Additionally, an arrow or pointer 163 can be placed on the base 105 and used to cooperate with any of the used time indicia 165.

In operation, a user will identify a desired time indicator on spacer 103. With the lid 101 and spacer 103 removed from base, the user will take spacer 103 and start to place it over the neck 131. Prior to the radial finger 135 engaging any of the depressions 117, the user will rotate the spacer 103 about the neck 131 of the base 105 until the desired time indicator is in alignment with the arrow 163. Upon alignment, the user will then proceed to slide spacer 103 over the neck 131 until the bottom surface 115 engages shoulder 137 and finger 135 is inserted into a corresponding aligned indentation 117. Subsequent to the placement of the spacer 103 onto the shoulder 137, the user places the lid 101 onto the top of neck 131 such that the threads of interior surface 111 engage with the threads of threaded portion 133.

The user then rotates the lid 101 down onto the neck 131 until the upper surface 129 of base 105 engages upper surface 109 of lid 101. As the lid 101 is being rotated down neck 131 of base 105 and approaches spacer 103, a portion of the end of locking tab 182 will extend upward into one of the plurality of cavities 172 as the cavity 172 passes over locking tab 182. Locking tab 182 will flex downward as lid 101 is rotated and locking tab 182 exits from a particular cavity 172. As described above, the spacing, size and shape of each of the plurality of cavities 172 are such that regardless of the orientation of spacer 103 with respect to 105, when the upper surface 129 of base 105 engages the upper surface 109 of lid 101, at least a portion of the end of locking tab 182 will extend into one of the plurality of cavities 172 of lid 101. Locking tab 182 is configured to permit the rotation of lid 101 in only one direction. When locking tab 182 extends into one of the cavities 172, locking tab 182 prevents the rotation of lid 101 in one direction while permitting rotation in the opposite direction.

When positioned as such, the lid 101 is positioned close to or proximate with or even engaged with, the spacer 103 so as to prevent the spacer 103 from moving in an upward motion along neck 131. Additionally, when the lid is in such position, the finger 135 is engaged with indentation 117, this locks or prevents the rotation of spacer 103 about the neck 131 of base 105. Once spacer 103 is placed onto shoulder 137, the arrow 163 will be in alignment with the selected time indicator 165. (See FIG. 24).

In order to remove spacer 103 and lid 101 from base 105, the user will depress flexible tab 184 in a downward motion. This motion removes locking tab 182 from the engaged cavity 172. Maintaining the downward depression of flexible tab 184, the lid 101 can then be rotated in a direction opposite from the installation of lid 101 onto base 105 as described above. When the lid 101 has been sufficiently rotated such that the cavities 172 and the locking tab 182 cannot further engage when the locking tab 182 is in the normal biased position, the user may release the depression of flexible tab 184 and continue rotating lid 101 until removed from base 105.

Figure 25:
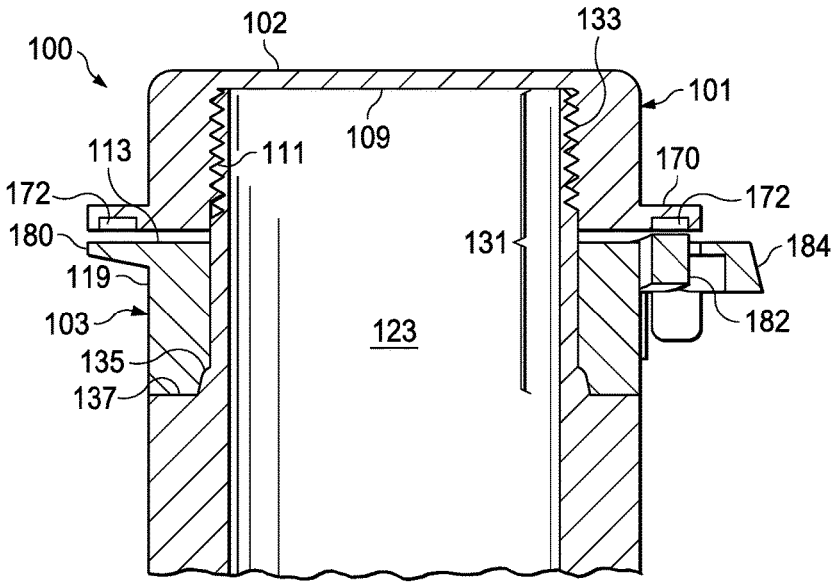
FIG. 25 illustrates a partial cross-sectional view of a time programmable container taken along line 25-25 of FIG. 24.

Referring now to FIG. 25, there is illustrated a partial cross-sectional view taken along line 25-25 of FIG. 24. Although illustrated with a small gap between the lid 101 and spacer 103, it is contemplated that no gap could be present, or if present, the gap would be small enough to prohibit sufficient movement of spacer 103 along neck 131 of base 105 and would maintain radial finger 135 in indentation 117, thereby preventing the rotation of spacer 103 around neck 131 of base 105.

Figure 26:
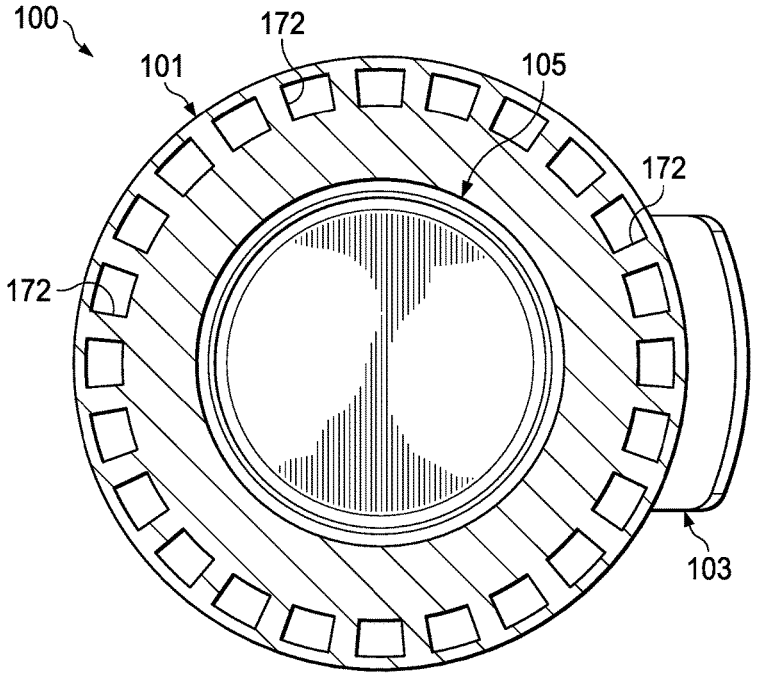
FIG. 26 illustrates a top cross-sectional view of the cap of the time programmable container taken along line 26-26 of FIG. 24.

Referring now to FIG. 26, there is illustrated a cross-sectional view taken along line 26-26 of FIG. 24 illustrating in more detail the plurality of cavities 172 of lid 101.

Figure 27:
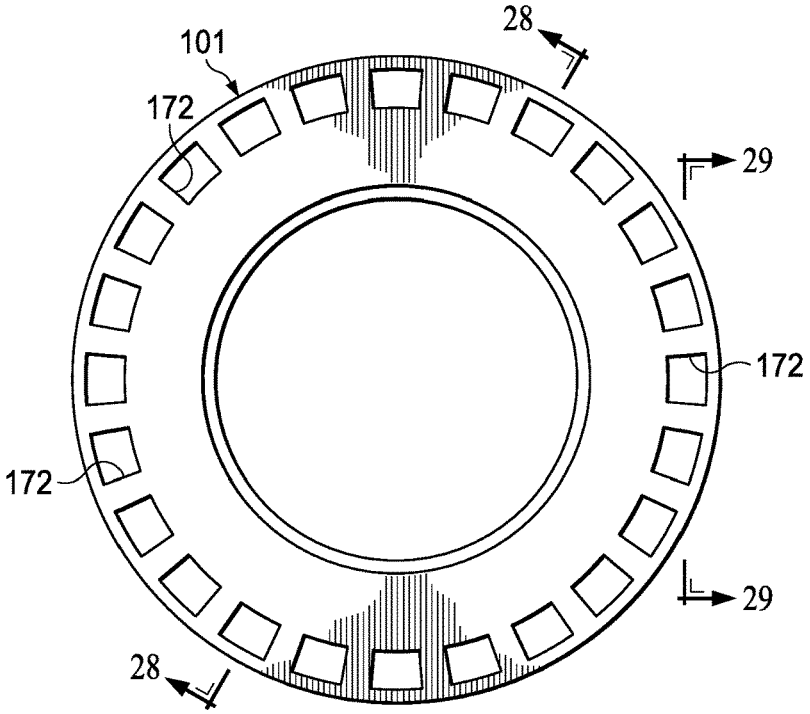
FIG. 27 illustrates a bottom view of the cap of the time programmable container as similarly shown in FIGS. 23-26.

Referring now to FIG. 27, there is illustrated a bottom view of lid 101 as similarly shown in FIG. 24, illustrating in more detail the plurality of cavities 172 circumventing the bottom surface of lip 170.

Figure 28:
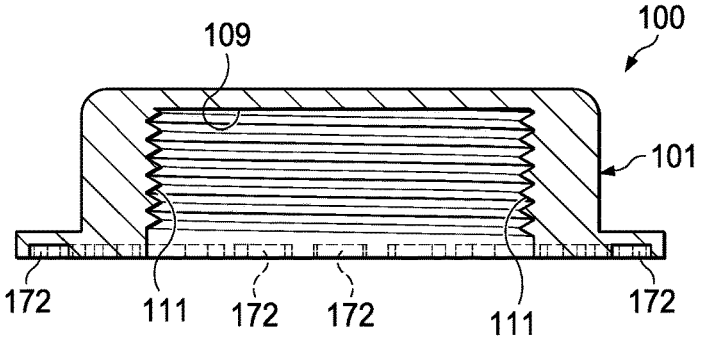
FIG. 28 illustrates a cross-sectional view of the cap of the time programmable container taken along line 28-28 of FIG. 27.
Figure 29:
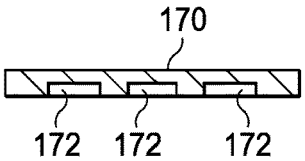
FIG. 29 illustrates a cross-sectional view of the cap of the time programmable container taken along line 29-29 of FIG. 27.

Referring now to FIG. 28, there is illustrated a cross-sectional view of lid 101 taken along line 28-28 of FIG. 27, while FIG. 29 illustrates a cross-sectional view of lid 101 taken along line 29-29 of FIG. 27.

Figure 30:
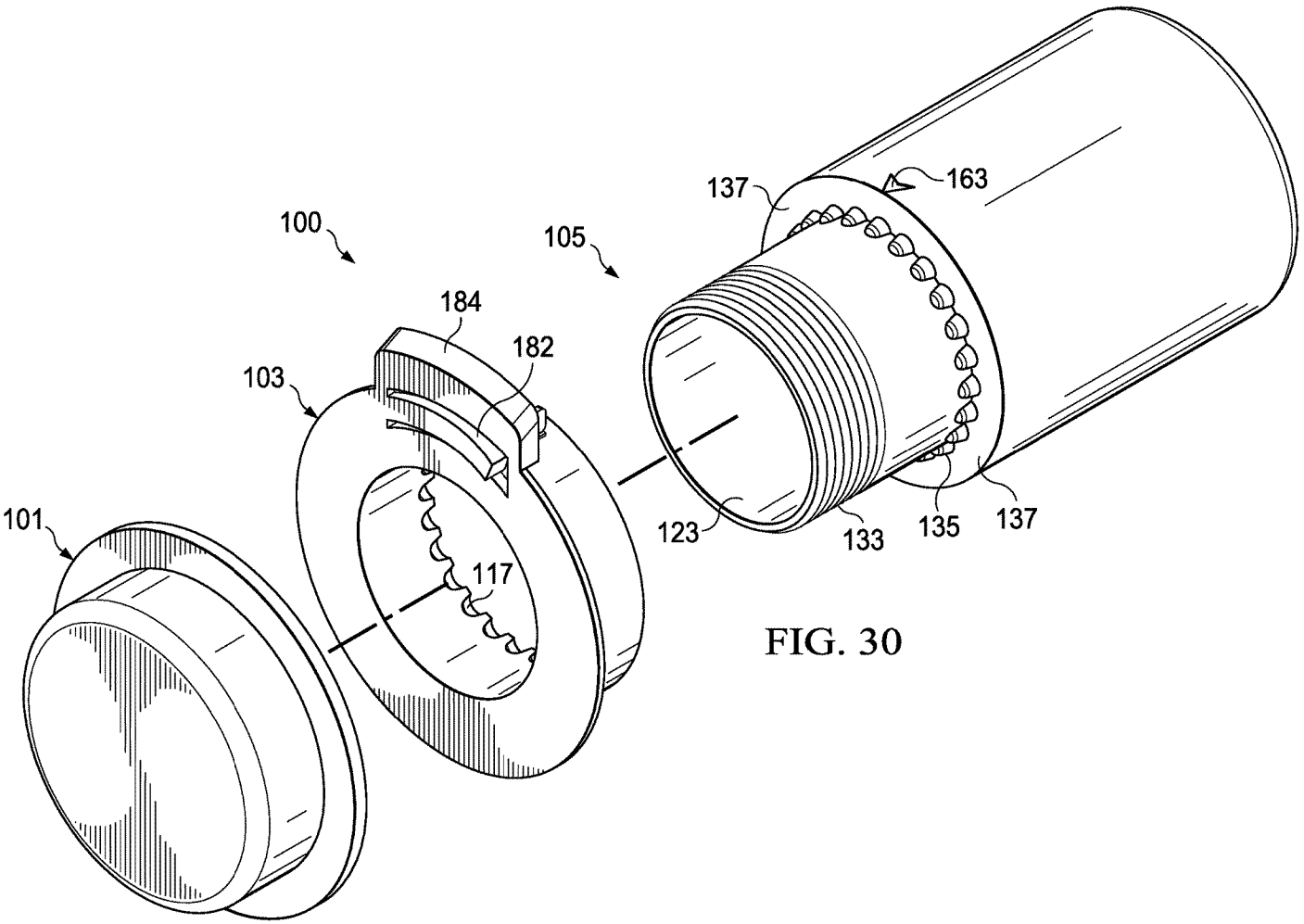
FIG. 30 illustrates an exploded perspective view of a time programmable container with a device for inhibiting the opening of the cap as similarly shown in FIG. 24.

Referring now to FIG. 30, there is illustrated an exploded perspective view of time programmable container 100 as similarly shown in FIG. 24.

Figure 23:
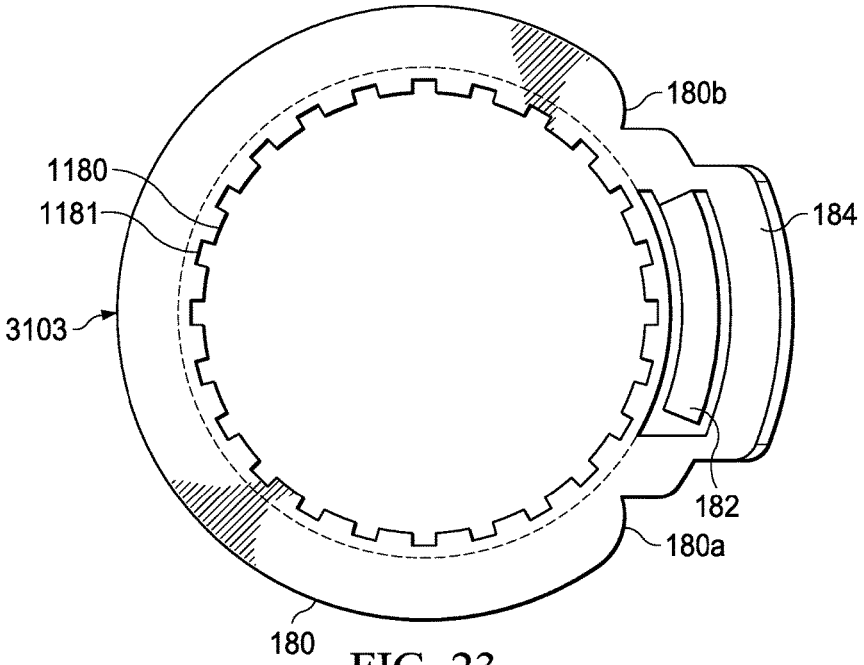
FIG. 23 illustrates a top view of a spacer for an alternative embodiment of a time programmable container with a device to inhibit the opening of the cap as similarly shown in FIG. 24.
Figure 31:
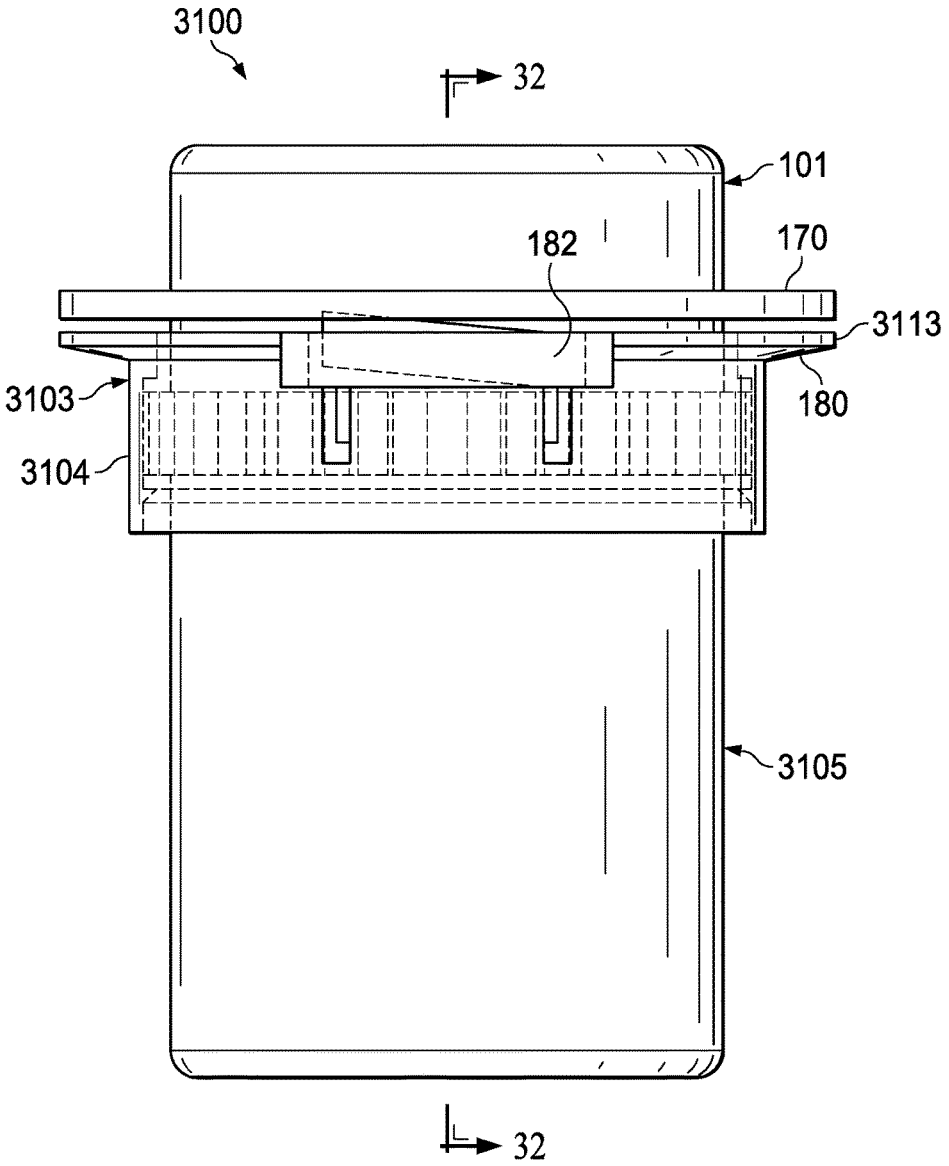
FIG. 31 illustrates a front view of yet another embodiment of a time programmable container with a device for inhibiting the opening of the cap.
Figure 32:
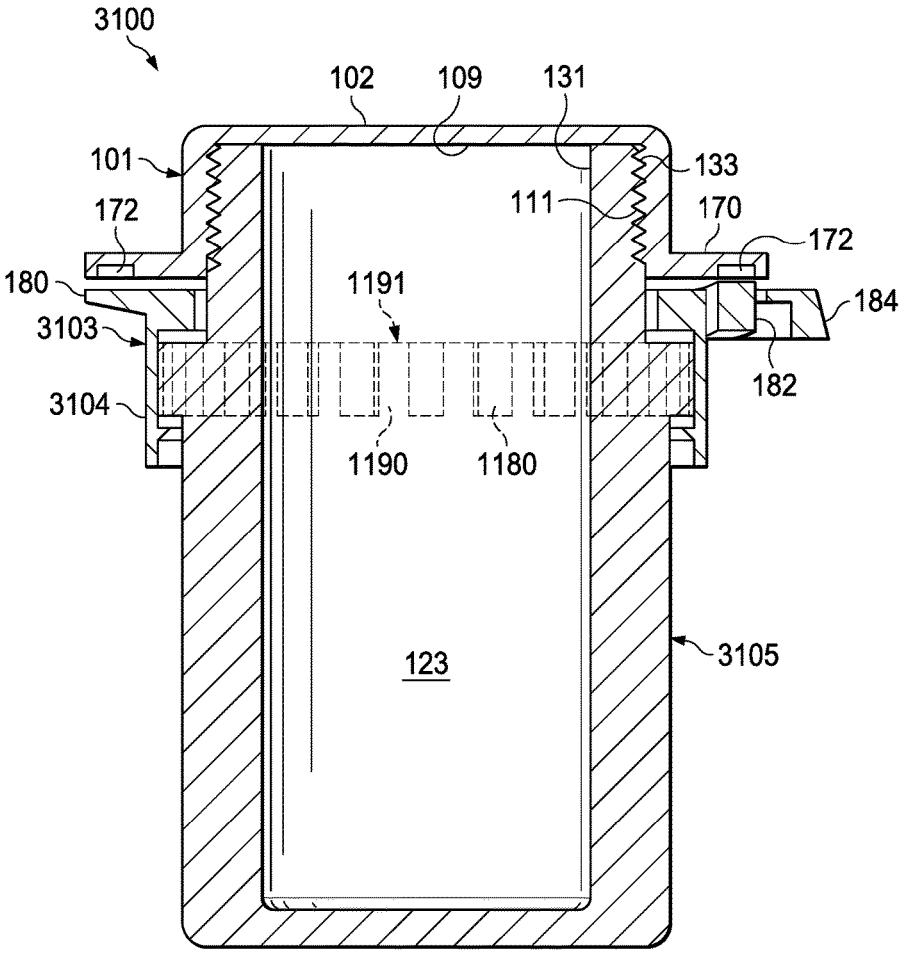
FIG. 32 illustrates a cross-sectional view of the cap of the time programmable container taken along line 32-32 of FIG. 31.

Referring now to FIGS. 31, 32 and 23, there is illustrated another embodiment of a time programmable container 3100 as similarly illustrated and described herein and having device or mechanism that inhibits the removal of the cap or lid 101 from the base 105 and sleeve 103.

As illustrated in FIGS. 23, 31 and 32, time programmable container 3100 includes a lid 101, a concentric, coaxial sleeve 3103 and a base 105. Lid 101 is used to seal the time programmable container 3100. Sleeve 3103 cooperates with the lid 101 and base 105 and is used to provide an indication of time, which may be selected or programmed from a plurality of indications (as described herein above). Base 3105 is configured with a storage region 123 and is used to contain time sensitive material such as solids, liquids, medicines, food and other appropriate materials.

Although not illustrated, sleeve 3103 may include time indicia as described herein above and may be programmed to indicate various properties of the materials contained within base 3105, such as but not limited to: the time that the container was filled; the last time the container was either opened or closed; an expiration time for the materials stored therein. As can be appreciated the materials from which the elements of time programmable container 3100 can be any of a number of rigid and flexible materials, such as, but not limited to various plastics, glass, and metals, or other appropriate material. Although, the time programmable container 3100 is illustrated as an elongated cylinder, it is contemplated that other shapes such as rectangle, oval or other shapes and combinations of shapes could be used.

The lid 101 includes an upper exterior surface 102 which is in a spaced relationship with the upper interior surface 109. Upper interior surface 109 extends to the side interior surface 111. Side interior surface 111 extends around the inner periphery of the lid 101. The side interior surface 111 is a threaded surface and used to mate with threads 133 of base 3105. A lip or rim 170 circumscribes the bottom portion of the outer perimeter of lid 101. Rim 170 includes a plurality of cavities 172 on the bottom portion of rim 170 and are spaced apart a determined distance, and are configured in shape and size to receive therein, tab 182 of sleeve 3103. The spacing and shape configuration of cavities 172 ensure the receipt therein of locking tab 182 when lid 101 is secured onto base 3105 regardless of the user's alignment of sleeve 3103 with respect to base 3105.

As illustrated sleeve 3103 includes a plurality of rectangular teeth 1180 that extend inward toward the center of sleeve 3103 with a gap 1181 positioned between each of the plurality of teeth 1180, with teeth 1180 and gaps 1181 extending around the inner perimeter of sleeve 3103. Similarly, base 3105 includes a plurality of rectangular teeth 1190 that extend outward from the outer perimeter of base 3105 with a gap 1191 positioned between each of the plurality of teeth 1190, with teeth 1190 and gaps 1191 extending around the outer perimeter. As illustrated, teeth 1180 and 1190, and gaps 1181 and 1191 are sized to permit the mating of sleeve 3103 upon base 3105. The sleeve 3103 further includes a skirt portion or flange 3104 which extends around the perimeter of the bottom portion of sleeve 3103 and is configured to cooperate with the outer side surface of the base 3105 when sleeve 3103 is placed upon base 3105.

The sleeve 3103 includes a rigid lip or rim 180 that circumscribes a portion of the top portion of the outer perimeter of sleeve 3103 and extends between the ends 180*a* and 180*b* of rim 180 (see FIG. 23). Sleeve 3103 further includes a flexible tab 184 that connects between ends 180*a* and 180*b* of rim 180. Intermediate the two ends of flexile tab 184 is a locking tab 182. Locking tab 182 is a curved, elongated tab that is connected at one end thereof to flexible tab 184. Locking tab 182 is connected to flexible tab 184 in a manner that permits locking tab 182 to move in an up and down motion but is normally biased in a upwardly extending position with a portion of the end of locking tab 182 extending above the upper surfaces of flexible tab 184 and rim 180.

In operation, a user will place sleeve 3103 over neck of base 3105 and rotate sleeve 3103 about the neck of base 3105 until a desired location or alignment of sleeve 3103 with respect to base 3105 is achieved. Sleeve 3103 is then lowered onto base 3105 such that teeth 1190 of base 3105 mate with gaps 1181 of sleeve 3103 and teeth 1180 of sleeve 3103 mate with gaps 1191 of base 3105. Subsequent thereto, a lid 101 is threadably engaged with base 3105 and rotated thereon. As the lid 101 is being rotated down neck 131 of base 3105 and approaches sleeve 3103, a portion of the end of locking tab 182 will extend upward into one of the plurality of cavities 172 as the cavity 172 passes over locking tab 182. Locking tab 182 will flex downward as lid 101 is rotated and locking tab 182 exits from a particular cavity 172. As described above, the spacing, size and shape of each of the plurality of cavities 172 are such that regardless of the orientation of sleeve 3103 with respect to base 3105, when the upper surface 129 of base 3105 engages the upper surface 109 of lid 101, at least a portion of the end of locking tab 182 will extend into one of the plurality of cavities 172 of lid 101. Locking tab 182 is configured to permit the rotation of lid 101 in only one direction. When locking tab 182 extends into one of the cavities 172, locking tab 182 prevents the rotation of lid 101 in one direction while permitting rotation in the opposite direction. Once lid is completely threaded onto base 3105, the location of lid 101 will prevent the movement of sleeve 3103 off of the neck of base 3105 and will, in addition to the engagement of the teeth 1180 with gaps 1191 and teeth 1190 with gaps 1182, prevent the rotation of sleeve 3103 about base 3105.

In order to remove sleeve 3103 and lid 101 from base 3105, the user will depress flexible tab 184 in a downward motion. This motion removes locking tab 182 from the engaged cavity 172. Maintaining the downward depression of flexible tab 184, the lid 101 can then be rotated in a direction opposite from the installation of lid 101 onto base 3105 as described above. When the lid 101 has been sufficiently rotated such that the cavities 172 and the locking tab 182 cannot further engage when the locking tab 182 is in the normal biased position, the user may release the depression of flexible tab 184 and continue rotating lid 101 until removed from base 3105.

Figure 33:
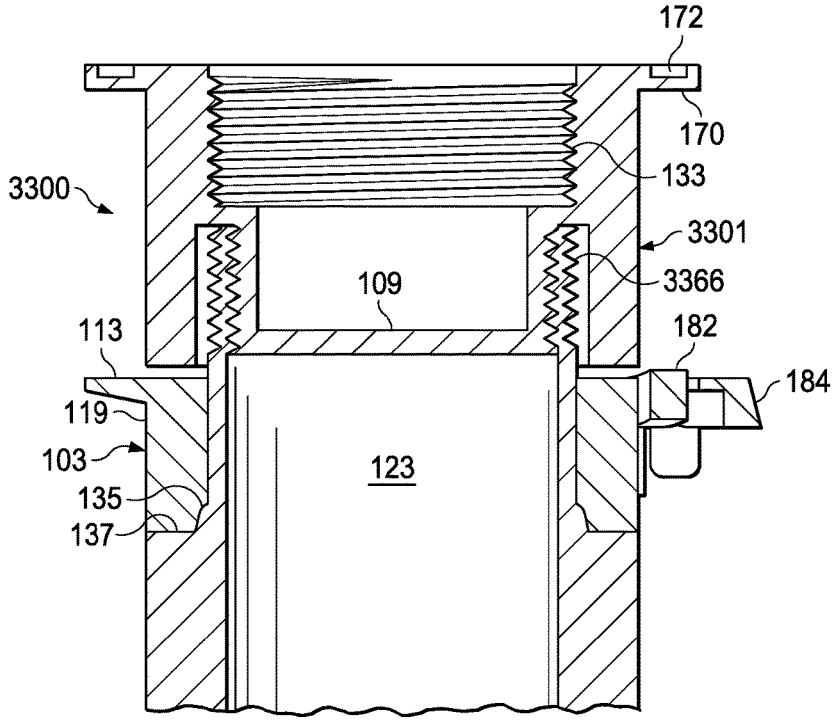
FIG. 33 illustrates a partial cross-sectional view of a programmable container with a cap operable in a locking configuration and a non-locking configuration.

Referring now to FIG. 33, there is illustrated a partial cross-section of an alternative embodiment of a time container 3300 with a reversible lid 3301. As illustrated the top portion of lid 3301 is configured and operates similar to the lid as described herein in relation to at least FIGS. 16-20. However, lid 3301 includes a threaded cavity 3366 on the end opposite threaded portion 133. Lid 3301 is configured such that either threaded end can be placed upon base 105. When threaded end 133 is placed and threaded upon 105 (as described herein above with respect to FIGS. 16-20), lid 3301 will be locked upon base 105 through the interactions of tab 182 and cavity 172. When threaded end 3366 is place and threaded upon base 105, there is no engagement of a locking mechanism to lock lid 3301 onto base 105. The permits the easy removal of lid 3301 from base 105. As can be appreciated, this embodiment gives a user a choice as to whether the lid 3301 should be lock upon base 105 or not.

Referring now to FIGS. 34-37, there is illustrated another embodiment of a time programmable container 100 as similarly illustrated herein and having device or mechanism that inhibits the removal of the cap or lid 101 from the base 3405 and spacer 3403.

As illustrated in FIGS. 34-37, time programmable container 100 includes a lid 101, a spacer 3403 and a base 3405. Lid 101 is used to seal the time programmable container 100. Spacer 3403 cooperates with the lid 101 and base 3405 and is used to provide an indication of time, which may be selected or programmed from a plurality of indications 165. Base 3405 is configured with a storage region 123 and is used to contain time sensitive material such as solids, liquids, medicines, food and other appropriate materials.

Spacer 3403 and the corresponding time indicia 165 may be programmed to indicate various properties of the materials contained within base 3405, such as but not limited to: the time that the container was filled; the last time the container was either opened or closed; an expiration time for the materials stored therein. As can be appreciated the materials from which the elements of time programmable container 100 can be any of a number of rigid and flexible materials, such as, but not limited to various plastics, glass, and metals, or other appropriate material. Although, the time programmable container 100 is illustrated as an elongated cylinder, it is contemplated that other shapes such as rectangle, oval or other shapes and combinations of shapes could be used.

The lid 101 includes an upper exterior surface 102 which is in a spaced relationship with the upper interior surface 109. Upper interior surface 109 extends to the side interior surface 111. Side interior surface 111 extends around the inner periphery of the lid 101. The side interior surface 111 is a threaded surface and used to mate with threads 133 of base 3405. A lip or rim 170 circumscribes the bottom portion of the outer perimeter of lid 101. Rim 170 includes a plurality of cavities 172 on the bottom portion of rim 170 and are spaced apart a determined distance, and are configured in shape and size to receive therein, tab 182 of spacer 3403 (see FIGS. 35-36). The spacing and shape configuration of cavities 172 ensure the receipt therein of locking tab 182 when lid 101 is secured onto base 3405 regardless of the user's alignment of spacer 3403 with respect to base 3405.

As can be appreciated, base 3405 and spacer 3403 are similar to base 105 and spacer 103 described herein above with respect to FIGS. 16-20 except that, as illustrated spacer 3403 includes a plurality of rectangular teeth 1180 that extend inward toward the center of spacer 3403 with a gap 1181 positioned between each of the plurality of teeth 1180, with teeth 1180 and gaps 1181 extending around the inner perimeter of spacer 3403. Similarly, base 3405 includes a plurality of rectangular teeth 1190 that extend outward from neck 1131 with a gap 1191 positioned between each of the plurality of teeth 1190, with teeth 1190 and gaps 1191 extending around the outer perimeter of neck 131. As illustrated, teeth 1180 and 1190, and gaps 1181 and 1191 are sized to permit the mating of spacer 3403 upon base 3405 about neck 131. The spacer 3403 further includes a flange 3104 which extends around the perimeter of the bottom portion of spacer 3403 and is configured to cooperate with the outer side surface of the base 3405 when spacer 3403 is placed upon base 3405.

The spacer 3403 includes a rigid lip or rim 180 that circumscribes a portion of the top portion of the outer perimeter of spacer 3403 and extends between the ends 180*a* and 180*b* of rim 180 (see FIG. 23). Spacer 3403 further includes a flexible tab 184 that connects between ends 180*a* and 180*b* of rim 180. Intermediate the two ends of flexile tab 184 is a locking tab 182. Locking tab 182 is a curved, elongated tab that is connected at one end thereof to flexible tab 184. Locking tab 182 is connected to flexible tab 184 in a manner that permits locking tab 182 to move in an up and down motion but is normally biased in a upwardly extending position with a portion of the end of locking tab 182 extending above the upper surfaces of flexible tab 184 and rim 180.

Figure 34:
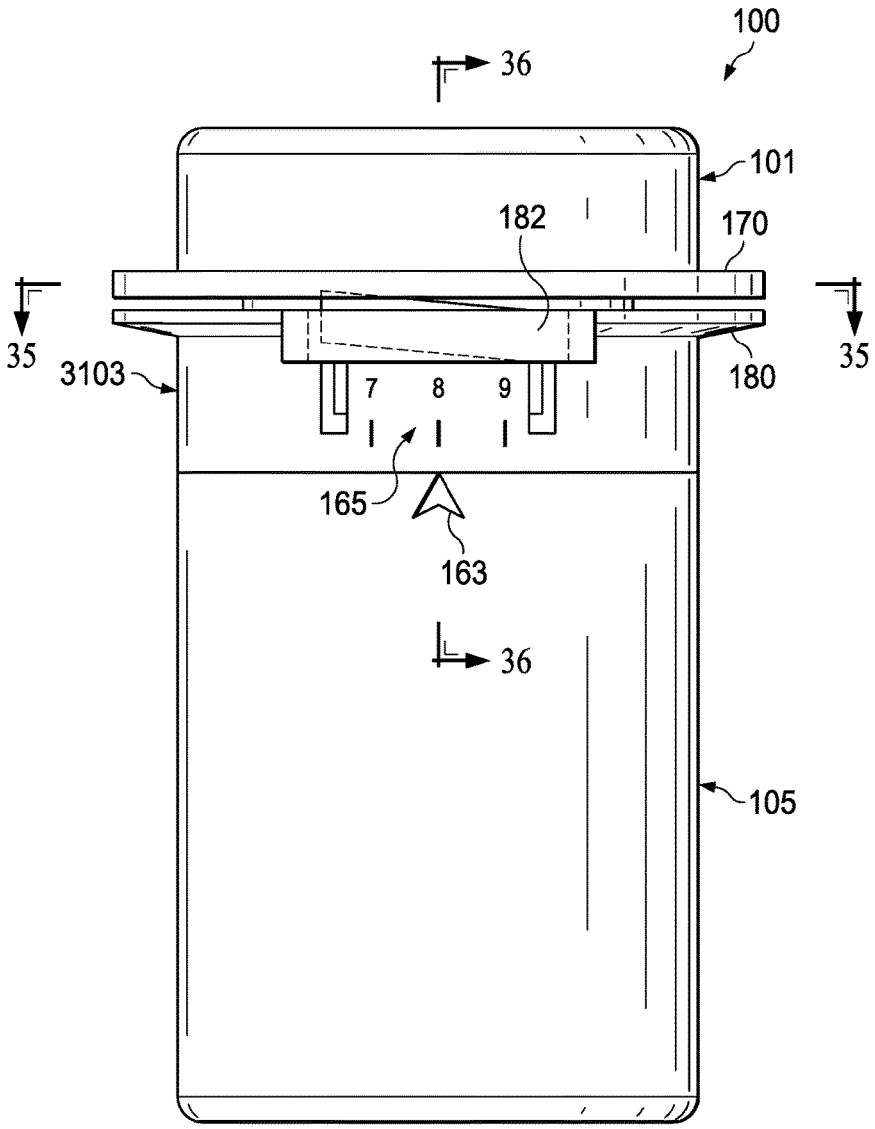
FIG. 34 illustrates a front view of still another embodiment of a time programmable container with a device for inhibiting the opening of the cap.
Figure 35:
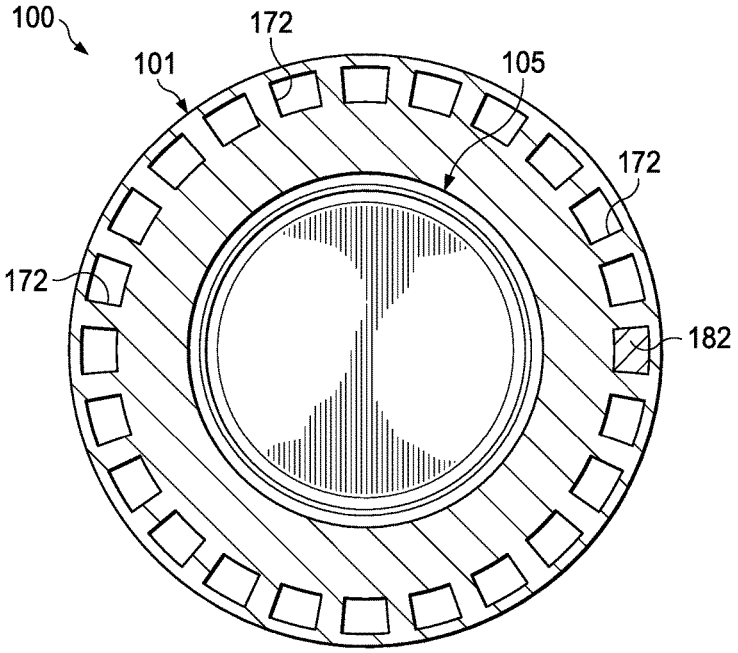
FIG. 35 illustrates a cross-sectional view taken along line 35-35 of FIG. 34.
Figure 36:
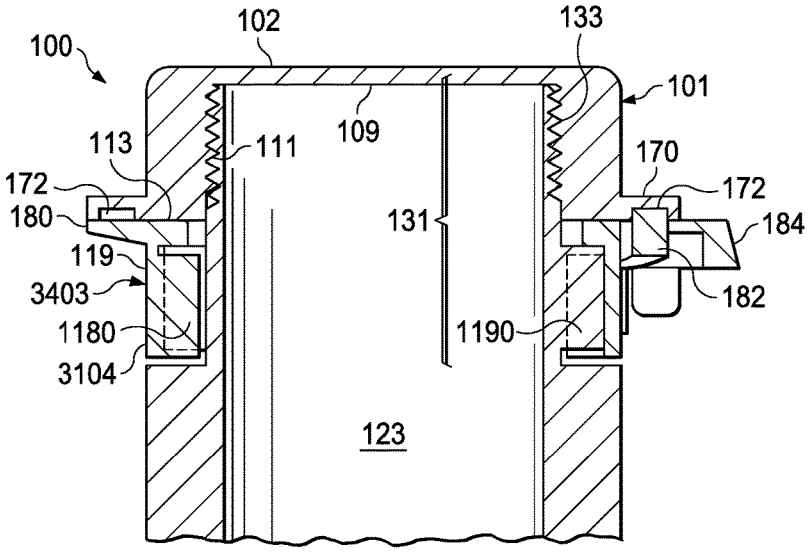
FIG. 36 illustrates a cross-sectional view taken along line 36-36 of FIG. 34.
Figure 37:
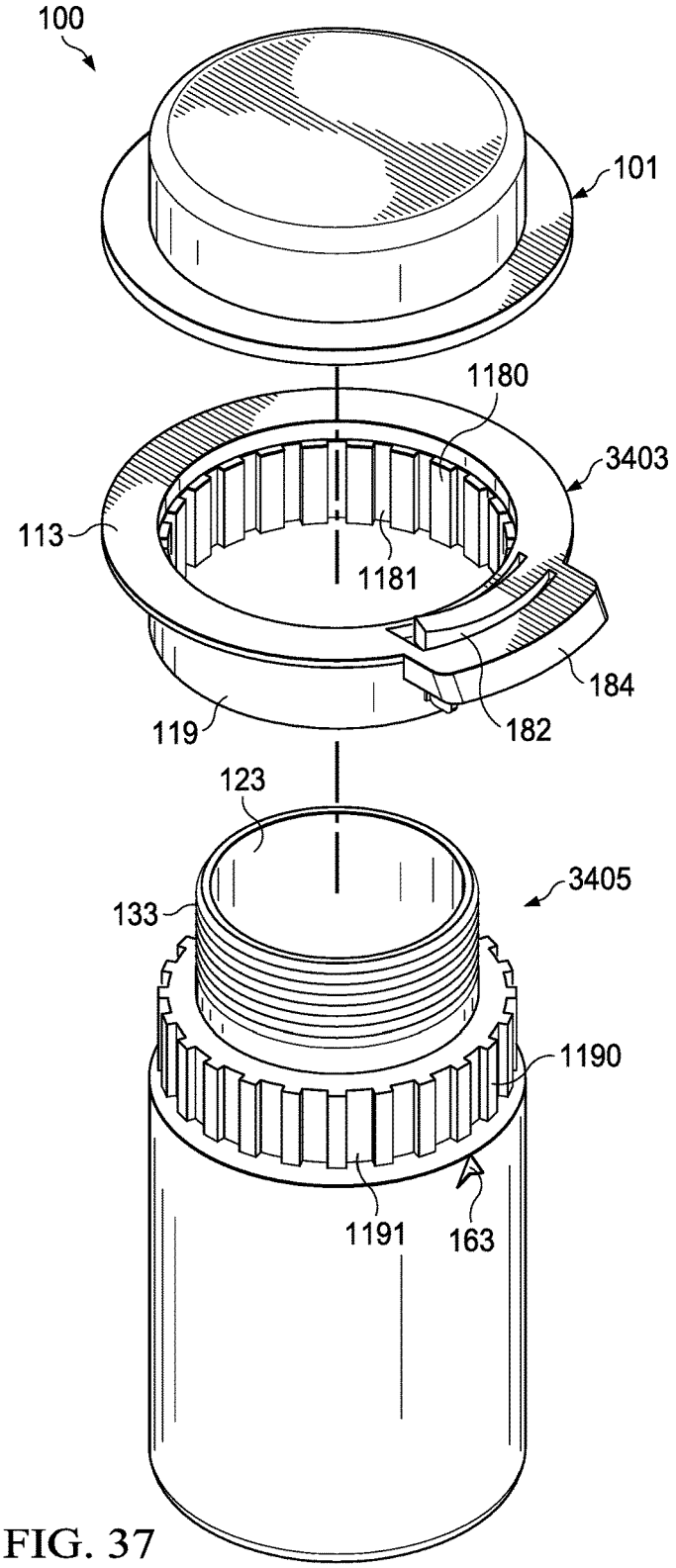
FIG. 37 illustrates an exploded perspective view of the device as similarly shown in FIG. 34.

As illustrated in FIGS. 34 and 37, teeth 1190 are recessed from the outer perimeter of base 3405 and similarly the outer perimeter of spacer 3403 is sized such that when spacer 3403 is placed over the neck of base 3405, the outer perimeters of base 3405 and spacer 3403 (not including rim 180) are flush with respect to each other.

In operation, spacer 3403 operates in a similar manner as the spacers described herein above. A user will place spacer 3403 over the neck of base 3405 and rotate spacer 3403 about the neck of base 3405 until a desired location or alignment of spacer 3403 with respect to base 3405 is achieved. Spacer 3403 is then lowered onto base 3405 such that teeth 1190 of base 3405 mate with gaps 1181 of spacer 3403 and teeth 1180 of spacer 3403 mate with gaps 1191 of base 3405. Subsequent thereto, a lid 101 is threadably engaged with base 3405 and rotated thereon. As the lid 101 is being rotated down neck 131 of base 3405 and approaches spacer 3403, a portion of the end of locking tab 182 will extend upward into one of the plurality of cavities 172 as the cavity 172 passes over locking tab 182. Locking tab 182 will flex downward as lid 101 is rotated and locking tab 182 exits from a particular cavity 172. As described above, the spacing, size and shape of each of the plurality of cavities 172 are such that regardless of the orientation of spacer 3403 with respect to base 3405, when the upper surface 129 of base 3405 engages the upper surface 109 of lid 101, at least a portion of the end of locking tab 182 will extend into one of the plurality of cavities 172 of lid 101. Locking tab 182 is configured to permit the rotation of lid 101 in only one direction. When locking tab 182 extends into one of the cavities 172, locking tab 182 prevents the rotation of lid 101 in one direction while permitting rotation in the opposite direction. Once lid is completely threaded onto base 3405, the location of lid 101 will prevent the movement of spacer 3403 off of the neck of base 3405 and will, in addition to the engagement of the teeth 1180 with gaps 1191 and teeth 1190 with gaps 1182, prevent the rotation of spacer 3403 about base 3405.

In order to remove spacer 3403 and lid 101 from base 3405, the user will depress flexible tab 184 in a downward motion. This motion removes locking tab 182 from the engaged cavity 172. Maintaining the downward depression of flexible tab 184, the lid 101 can then be rotated in a direction opposite from the installation of lid 101 onto base 3405 as described above. When the lid 101 has been sufficiently rotated such that the cavities 172 and the locking tab 182 cannot further engage when the locking tab 182 is in the normal biased position, the user may release the depression of flexible tab 184 and continue rotating lid 101 until removed from base 3405.

Figure 38:
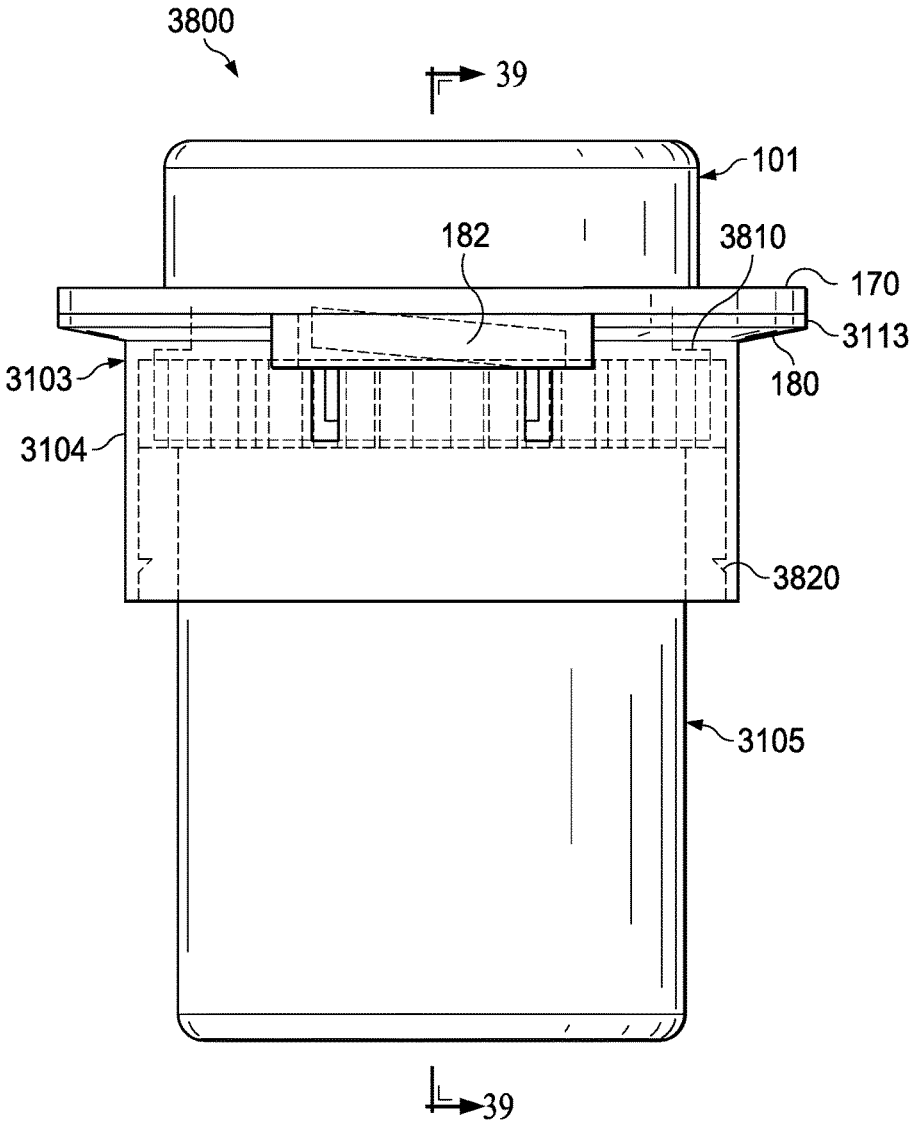
FIG. 38 illustrates a front view of yet another embodiment of a time programmable container with a device for inhibiting the opening of the cap.
Figure 39:
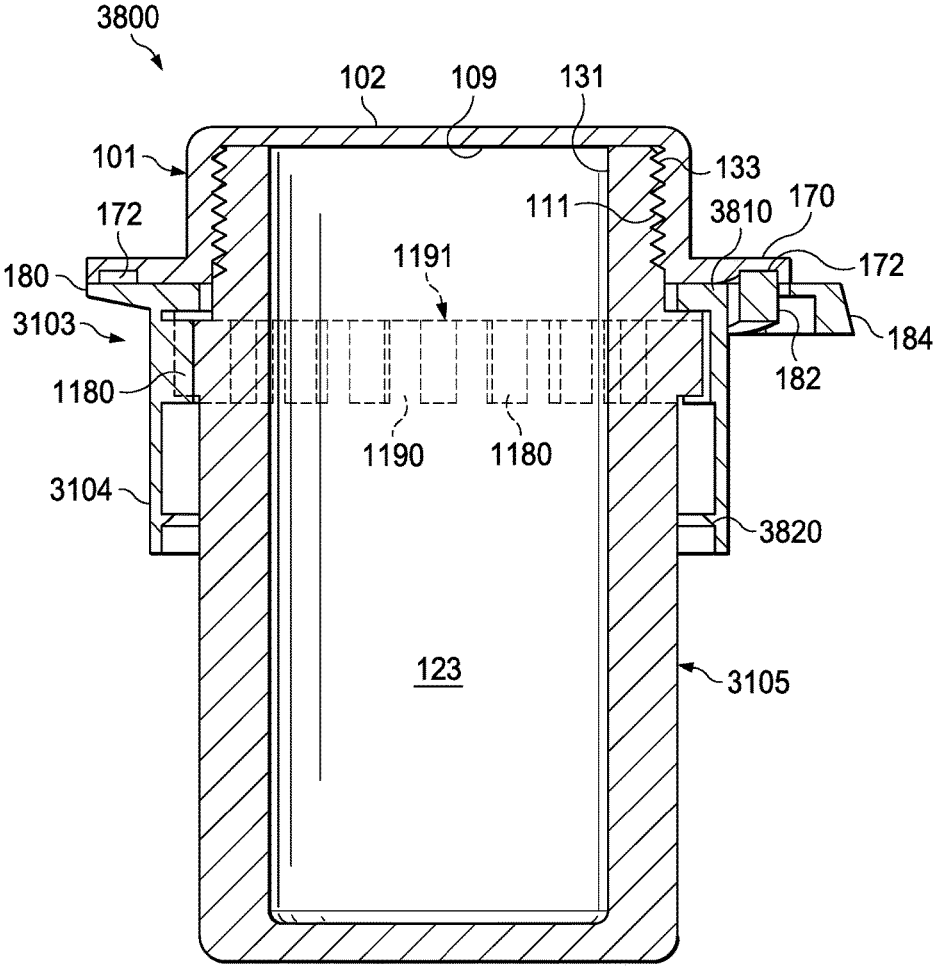
FIG. 39 illustrates a cross-sectional view of the container as similarly shown in FIG. 38.

Referring now to FIGS. 38 and 39, there is illustrated another embodiment of a time programmable container 3800. Time programmable container 3800 is similar to time programmable container 3100 as described herein above with respect to FIGS. 23, 31 and 32, with the exception that skirt portion 3104 is substantially longer with container 3800 than container 3100. As illustrated, skirt portion 3014 includes an upper limiting ring 3810 and a lower limiting ring 3820. Upper limiting ring 3810 is a ring which extends inward around upper portion of the inner opening of skirt 3104, such that when upper limiting ring 3810 is placed onto the neck of base 3105, upper limiting ring 3810 comes into contact with teeth 1190 of base 3150 allowing skirt 3104 to rest thereupon. Lower limiting ring 3810 extends inward around the lower portion of the inner opening of skirt 3104 and can be either a continuous ring or a fragmentary ring having a generally wedge shaped cross-section allowing for the skirt 3104 to be placed about base 3150 with lower limiting ring 3820 moving passed teeth 1190 in a downward axial motion. Once lower limiting ring 3820 is below teeth 1190 (and prior to lid 101 being secured to base 3105), the shape of lower limiting ring 3820 permits the axial lifting of skirt 3104 permitting teeth 1190 and 1180 to become separated and disengaged, thus permitting the rotation of skirt 3104 to be rotated about base 3105, such as to change alignment of time indicators while preventing or inhibiting the removal of lid 101 as a result of the wedge shape lower limiting ring 3820 engaging teeth 1190.

Referring now to FIGS. 40-43, there is illustrated another embodiment of a time programmable container 4000 as similarly illustrated herein and having device or mechanism that inhibits the removal of the cap or lid 4001 from the base 4005 and spacer 4003.

As illustrated in FIGS. 40-43, time programmable container 4000 includes a lid 4001, a spacer 4003 and a base 4005. Lid 4001 is used to seal the time programmable container 4000. Spacer 4003 cooperates with the lid 4001 and base 4005. Base 4005 is configured with a storage region 4023 and is used to contain time sensitive material such as solids, liquids, medicines, food and other appropriate materials.

As can be appreciated the materials from which the elements of time programmable container 4000 can be any of a number of rigid and flexible materials, such as, but not limited to various plastics, glass, and metals, or other appropriate material. Although, the time programmable container 4000 is illustrated as an elongated cylinder, it is contemplated that other shapes such as rectangle, oval or other shapes and combinations of shapes could be used.

The lid 4001 includes an upper exterior surface 4002 which is in a spaced relationship with the upper interior surface 4009. Upper interior surface 4009 extends to the side interior surface 4011. Side interior surface 4011 extends around the inner periphery of the lid 4001. The side interior surface 4011 is a threaded surface and used to mate with threads 4033 of base 4005. A lip or rim 4070 circumscribes the bottom portion of the outer perimeter of lid 4001. Rim 4070 includes a plurality of cavities 4072 on the bottom portion of rim 4070 and are spaced apart a determined distance, and are configured in shape and size to receive therein, tab 4082 of spacer 4003 (see FIG. 42). The spacing and shape configuration of cavities 4072 ensure the receipt therein of locking tab 4082 when lid 4001 is secured onto base 4005 regardless of the user's alignment of spacer 4003 with respect to base 4005.

As illustrated, spacer 4003 includes a plurality of rectangular teeth 4080 that extend inward toward the center of spacer 4003 with a gap 4081 positioned between each of the plurality of teeth 4080, with teeth 4080 and gaps 4081 extending around the inner perimeter of spacer 4003. Similarly, base 4005 includes a plurality of rectangular teeth 4090 that extend outward from base 4005 with a gap 4091 positioned between each of the plurality of teeth 4090, with teeth 4090 and gaps 4091 extending around the outer perimeter of base 4005. As illustrated, teeth 4080 and 4090, and gaps 4081 and 4091 are sized to permit the mating of spacer 4003 upon base 4005. The spacer 4003 further includes a flange 4004 which extends around the perimeter of the bottom portion of spacer 4003 and is configured to cooperate with the outer side surface of the base 4005 when spacer 4003 is placed upon base 4005.

The spacer 4003 includes a rigid lip or rim 4180 that circumscribes a portion of the top portion of the outer perimeter of spacer 4003. Spacer 4003 further includes a flexible tab 4084 attached to rim 4080. Intermediate the two ends of flexile tab 4084 is a locking tab 4082. Locking tab 4082 is a curved, elongated tab that is connected at one end thereof to flexible tab 4084. Locking tab 4082 is connected to flexible tab 4084 in a manner that permits locking tab 4082 to move in an up and down motion but is normally biased in a upwardly extending position with a portion of the end of locking tab 4082 extending above the upper surfaces of flexible tab 4084 and rim 4180.

Figure 40:
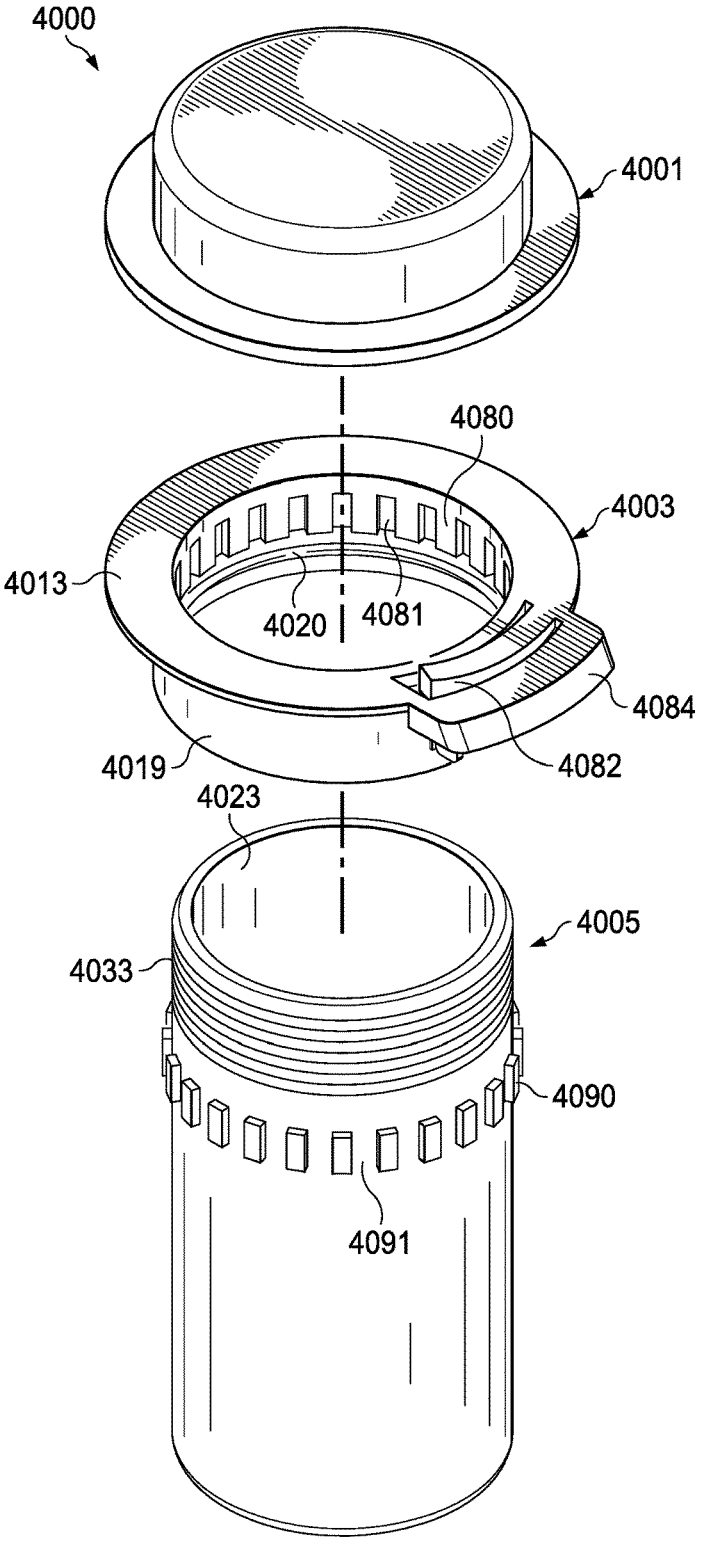
FIG. 40 illustrates an exploded perspective view of another embodiment of the present invention.
Figure 41:
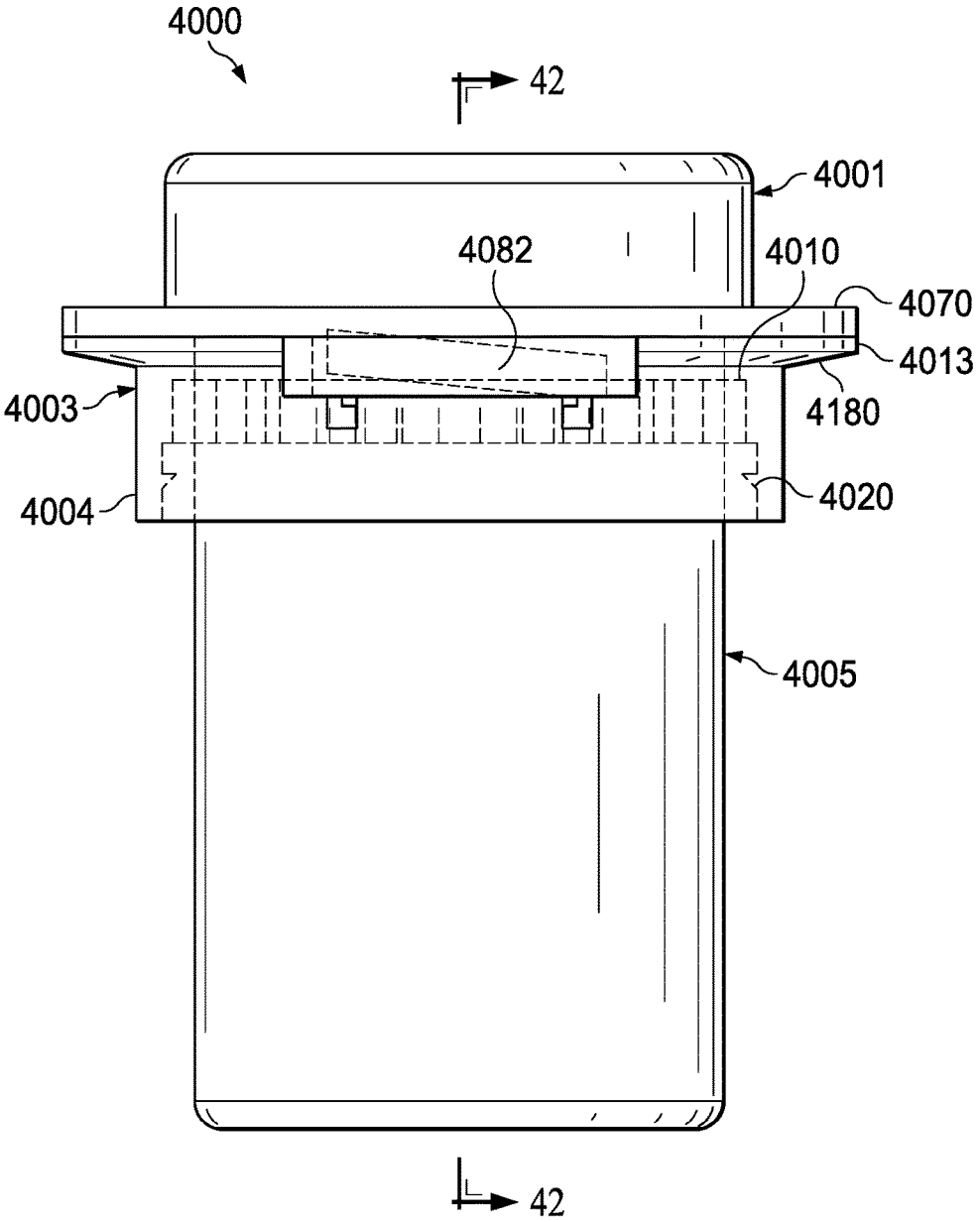
FIG. 41 illustrates a front view of the container as similarly shown in FIG. 40 in a non-exploded view.
Figure 42:
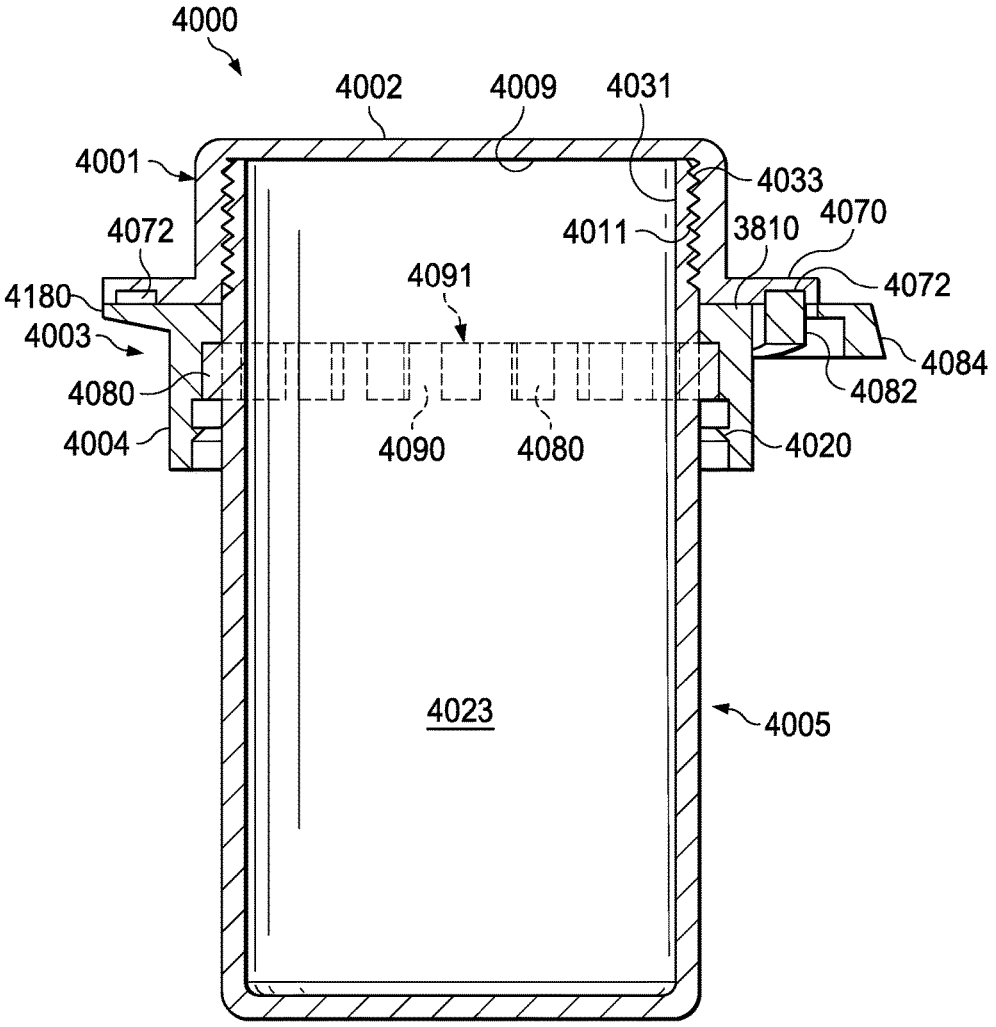
FIG. 42 illustrates a cross-section view of the container as similarly shown in FIG. 41.
Figure 43:
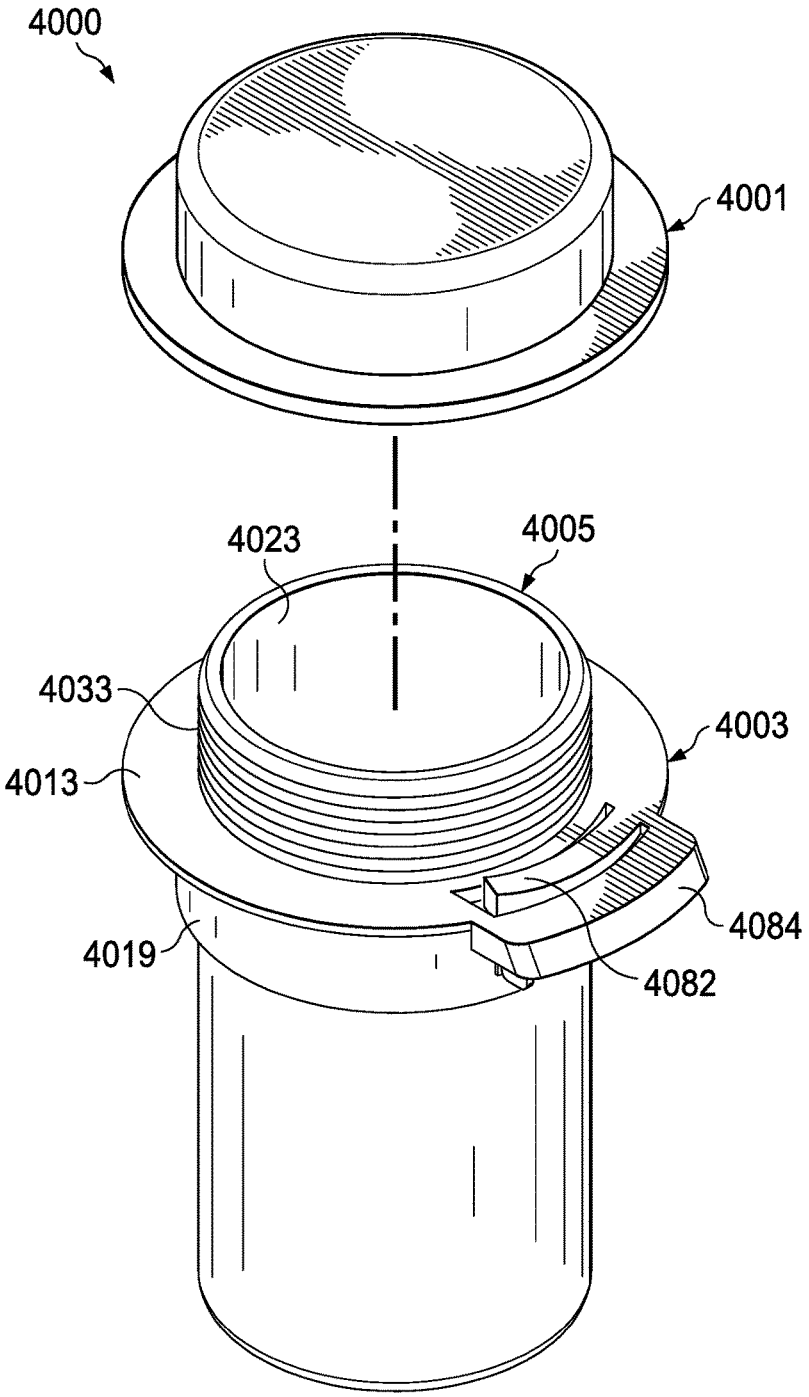
FIG. 43 illustrates a partially exploded perspective view of the container as similarly shown in FIG. 40.

As illustrated in FIGS. 40 and 42, teeth 4090 are positioned on the outer perimeter of base 4005 and similarly the outer perimeter of spacer 4003 is sized such that when spacer 4003 is placed over base 4005, the outer perimeters of base 4005 and spacer 4003 (not including rim 4180) are in coaxial alignment with respect to each other.

In operation, spacer 4003 operates in a similar manner as the spacers described herein above. A user will place spacer 4003 coaxial alignment above base 4005 and rotate spacer 4003 about the base 4005 until a desired location or alignment of spacer 4003 with respect to base 4005 is achieved. Spacer 4003 is then lowered onto base 4005 such that teeth 4090 of base 4005 mate with gaps 4081 of spacer 4003 and teeth 4080 of spacer 4003 mate with gaps 4091 of base 4005. Subsequent thereto, a lid 4001 is threadably engaged with base 4005 and rotated thereon. As the lid 4001 is being rotated down base 4005 and approaches spacer 4003, a portion of the end of locking tab 4082 will extend upward into one of the plurality of cavities 4072 as the cavity 4072 passes over locking tab 4082. Locking tab 4082 will flex downward as lid 4001 is rotated and locking tab 4082 exits from a particular cavity 4072. As described above, the spacing, size and shape of each of the plurality of cavities 4072 are such that regardless of the orientation of spacer 4003 with respect to base 4005, when the upper surface of base 4005 engages the upper surface 4009 of lid 4001, at least a portion of the end of locking tab 4082 will extend into one of the plurality of cavities 4072 of lid 4001. Locking tab 4082 is configured to permit the rotation of lid 4001 in only one direction. When locking tab 4082 extends into one of the cavities 4072, locking tab 4082 prevents the rotation of lid 4001 in one direction while permitting rotation in the opposite direction. Once lid is completely threaded onto base 4005, the location of lid 4001 will prevent the movement of spacer 4003 off of base 4005 and will, in addition to the engagement of the teeth 4080 with gaps 4091 and teeth 4090 with gaps 4082, prevent the rotation of spacer 4003 about base 4005.

In order to remove spacer 4003 and lid 4001 from base 4005, the user will depress flexible tab 4084 in a downward motion. This motion removes locking tab 4082 from the engaged cavity 4072. Maintaining the downward depression of flexible tab 4084, the lid 4001 can then be rotated in a direction opposite from the installation of lid 4001 onto base 4005 as described above. When the lid 4001 has been sufficiently rotated such that the cavities 4072 and the locking tab 4082 cannot further engage when the locking tab 4082 is in the normal biased position, the user may release the depression of flexible tab 4084 and continue rotating lid 4001 until removed from base 4005.

Referring now to FIGS. 44-47, there is illustrated another embodiment of a time programmable container 4400 as similarly illustrated in FIGS. 40-43 herein and having device or mechanism that inhibits the removal of a reversible cap or lid 4401 from the base 4405 and spacer 4403.

As illustrated in FIGS. 44-47, time programmable container 4400 includes a reversible lid 4401, a spacer 4403 and a base 4405. Lid 4401 is used to seal the time programmable container 4400. Spacer 4403 cooperates with the lid 4401 and base 4405. Base 4405 is configured with a storage region 4423 and is used to contain time sensitive material such as solids, liquids, medicines, food and other appropriate materials.

As can be appreciated the materials from which the elements of time programmable container 4400 can be any of a number of rigid and flexible materials, such as, but not limited to various plastics, glass, and metals, or other appropriate material. Although, the time programmable container 4400 is illustrated as an elongated cylinder, it is contemplated that other shapes such as rectangle, oval or other shapes and combinations of shapes could be used.

Figure 45:
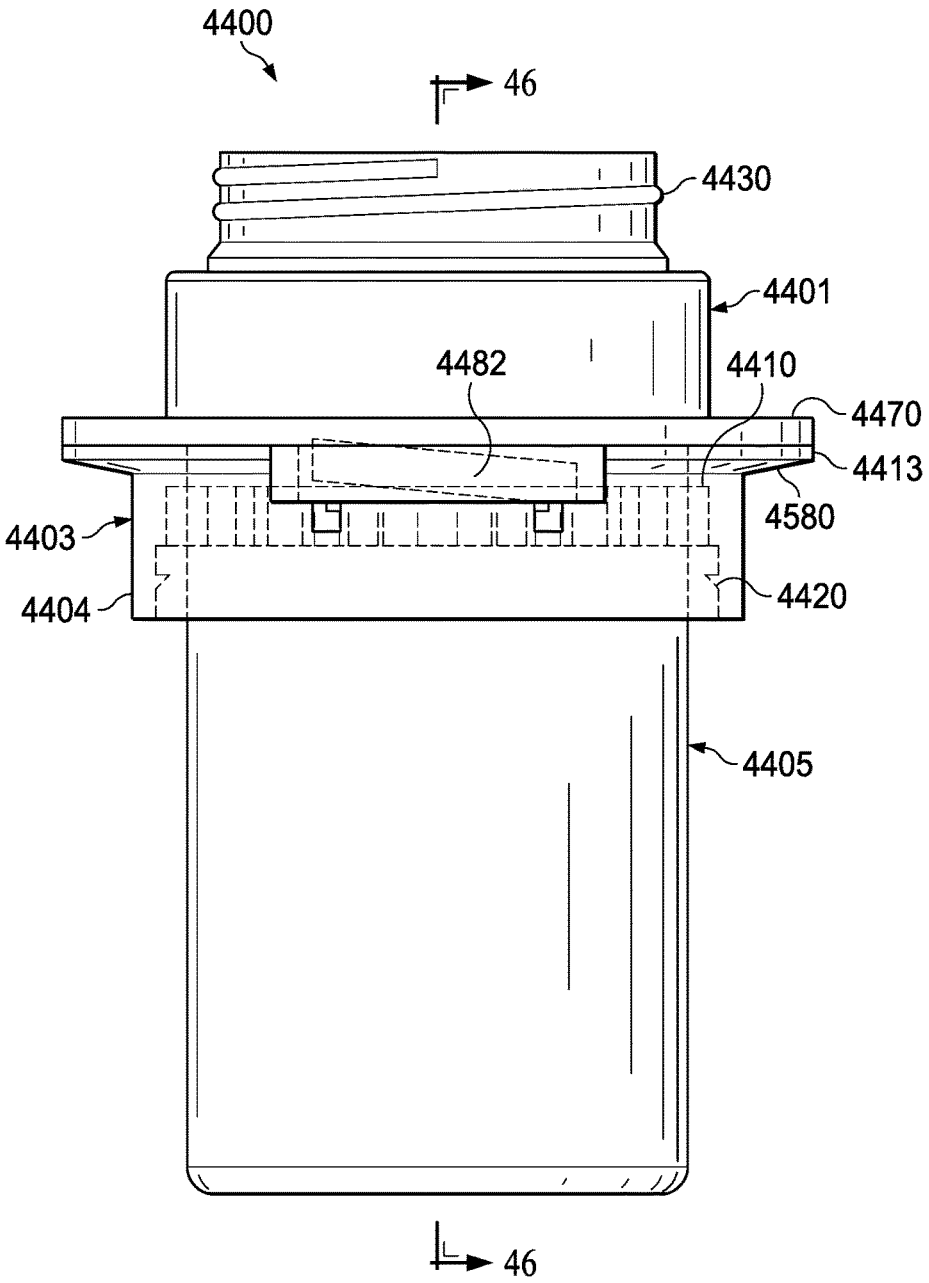
FIG. 45 illustrates a front view of the container as similarly shown in FIG. 44.
Figure 46:
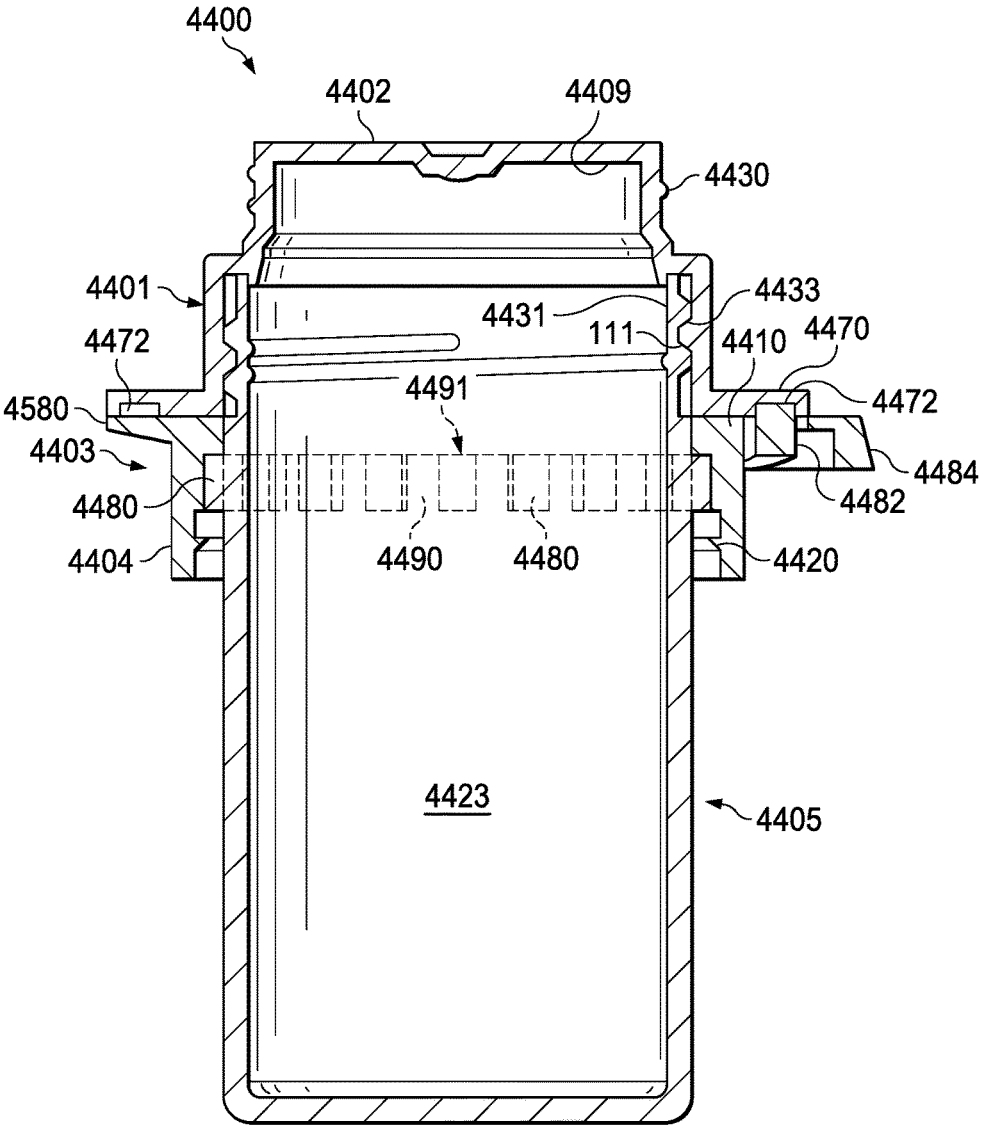
FIG. 46 illustrates a cross-section view of the container as similarly shown in FIG. 45.
Figure 47:
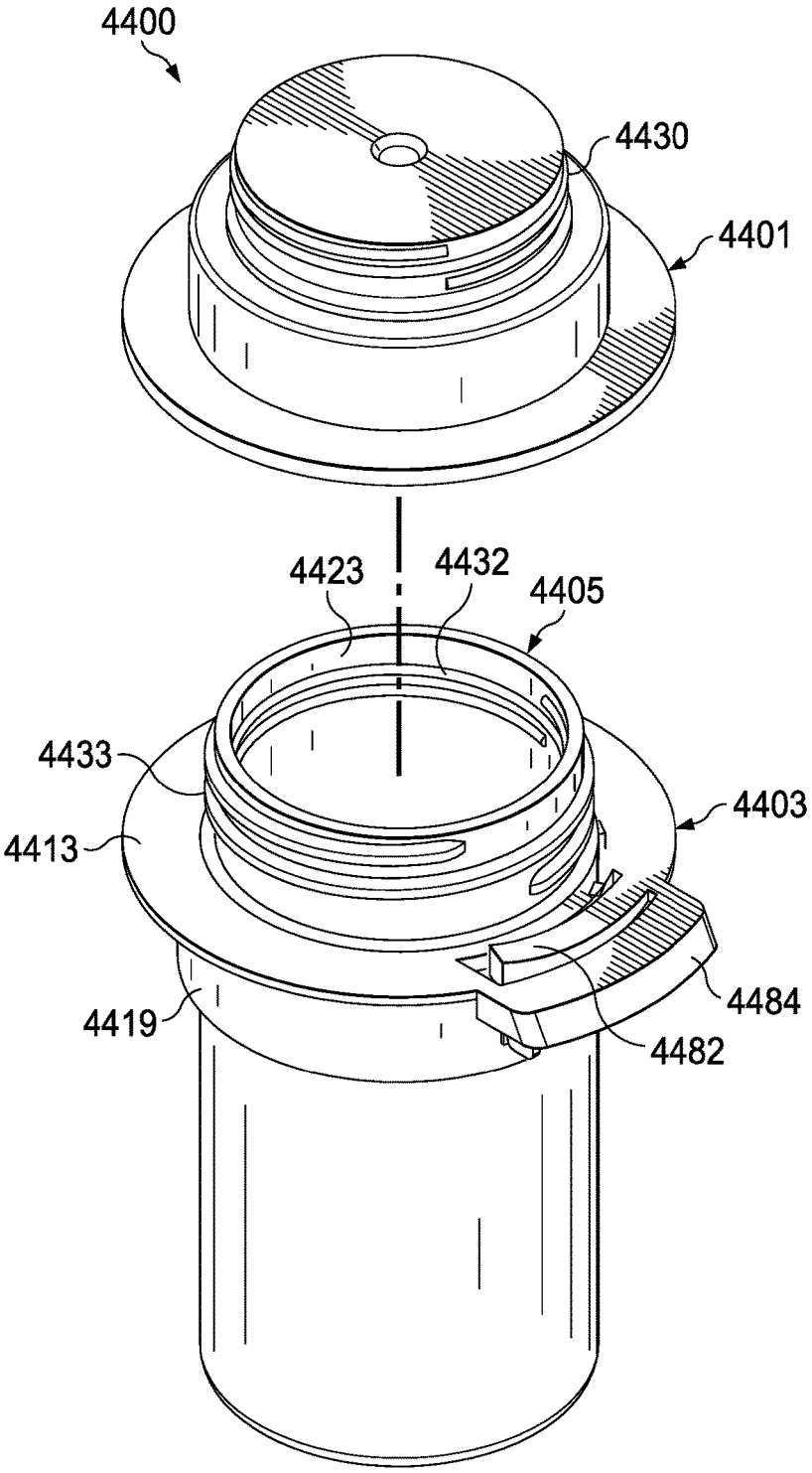
FIG. 47 illustrates a partially exploded perspective view of the container as similarly shown in FIG. 45.

The lid 4401 includes an upper exterior surface 4402 which is in a spaced relationship with the upper interior surface 4409. Proximate upper exterior surface are threads 4430. Threads 4430 engage with threads 4432 when lid 4401 is inverted from the way it is illustrated in FIGS. 45-47, and threads 4430 are inserted into the opening of container 4400 and engage with threads 4432. This provides for easy opening of and removal of lid 4401 from container 4400.

Referring now back to lid 4401, upper interior surface 4409 extends to the side interior surface 4411. Side interior surface 4411 extends around the inner periphery of the lid 4401. The side interior surface 4411 is a threaded surface and used to mate with threads 4433 of base 4405. A lip or rim 4470 circumscribes the bottom portion of the outer perimeter of lid 4401. Rim 4470 includes a plurality of cavities 4472 on the bottom portion of rim 4470 and are spaced apart a determined distance, and are configured in shape and size to receive therein, tab 4482 of spacer 4403. The spacing and shape configuration of cavities 4472 ensure the receipt therein of locking tab 4482 when lid 4401 is secured onto base 4405 regardless of the user's alignment of spacer 4403 with respect to base 4405.

As illustrated, spacer 4403 includes a plurality of rectangular teeth 4480 that extend inward toward the center of spacer 4403 with a gap 4481 positioned between each of the plurality of teeth 4480, with teeth 4480 and gaps 4481 extending around the inner perimeter of spacer 4403. Similarly, base 4405 includes a plurality of rectangular teeth 4490 that extend outward from base 4405 with a gap 4491 positioned between each of the plurality of teeth 4490, with teeth 4490 and gaps 4491 extending around the outer perimeter of base 4405. As illustrated, teeth 4480 and 4490, and gaps 4481 and 4491 are sized to permit the mating of spacer 4403 upon base 4405. The spacer 4403 further includes a flange 4404 which extends around the perimeter of the bottom portion of spacer 4403 and is configured to cooperate with the outer side surface of the base 4405 when spacer 4403 is placed upon base 4405.

The spacer 4403 includes a rigid lip or rim 4580 that circumscribes a portion of the top portion of the outer perimeter of spacer 4403. Spacer 4403 further includes a flexible tab 4484 attached to rim 4580. Intermediate the two ends of flexile tab 4484 is a locking tab 4482. Locking tab 4482 is a curved, elongated tab that is connected at one end thereof to flexible tab 4484. Locking tab 4482 is connected to flexible tab 4484 in a manner that permits locking tab 4482 to move in an up and down motion but is normally biased in a upwardly extending position with a portion of the end of locking tab 4482 extending above the upper surfaces of flexible tab 4484 and rim 4580.

Figure 44:
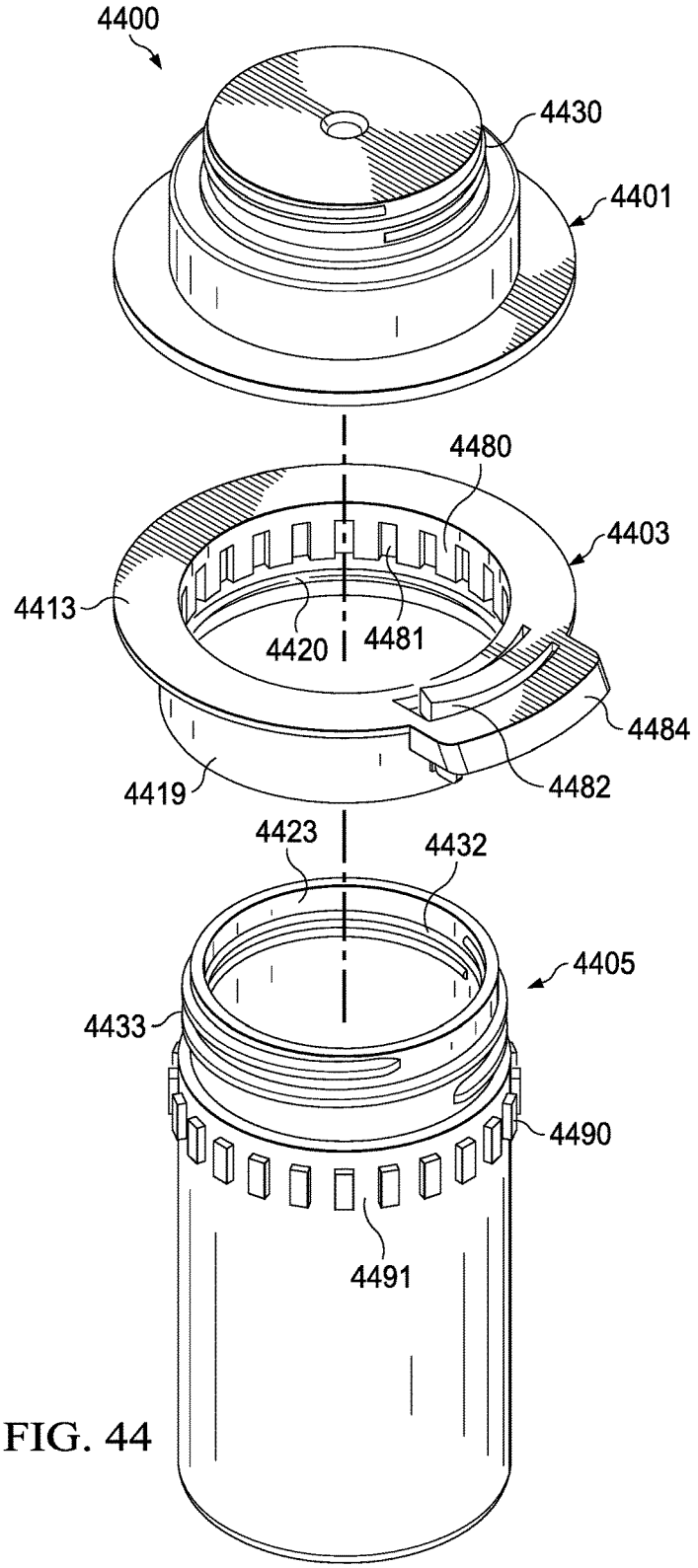
FIG. 44 illustrates an exploded perspective view a still another embodiment of the present invention.

As illustrated in FIGS. 44-46, teeth 4490 are positioned on the outer perimeter of base 4405 and similarly the outer perimeter of spacer 4403 is sized such that when spacer 4403 is placed over base 4405, the outer perimeters of base 4405 and spacer 4403 (not including rim 4580) are coaxial with respect to each other.

In operation, spacer 4403 operates in a similar manner as the spacers described herein above. A user will place spacer 4403 over base 4405 and rotate spacer 4403 about the base 4405 until a desired location or alignment of spacer 4403 with respect to base 4405 is achieved. Spacer 4403 is then lowered onto base 4405 such that teeth 4490 of base 4405 mate with gaps 4481 of spacer 4403 and teeth 4480 of spacer 4403 mate with gaps 4491 of base 4405. Subsequent thereto, a lid 4401 is threadably engaged with base 4405 and rotated thereon. As the lid 4401 is being rotated down base 4405 and approaches spacer 4403, a portion of the end of locking tab 4482 will extend upward into one of the plurality of cavities 4472 as the cavity 4472 passes over locking tab 4482. Locking tab 4482 will flex downward as lid 4401 is rotated and locking tab 4482 exits from a particular cavity 4472. As described above, the spacing, size and shape of each of the plurality of cavities 4472 are such that regardless of the orientation of spacer 4403 with respect to base 4405, when the upper surface of base 4405 engages the upper surface 4409 of lid 4401, at least a portion of the end of locking tab 4482 will extend into one of the plurality of cavities 4472 of lid 4401. Locking tab 4482 is configured to permit the rotation of lid 4401 in only one direction. When locking tab 4482 extends into one of the cavities 4472, locking tab 4482 prevents the rotation of lid 4401 in one direction while permitting rotation in the opposite direction. Once lid is completely threaded onto base 4405, the location of lid 4401 will prevent the movement of spacer 4403 off of base 4405 and will, in addition to the engagement of the teeth 4480 with gaps 4491 and teeth 4490 with gaps 4482, prevent the rotation of spacer 4403 about base 4405.

In order to remove spacer 4403 and lid 4401 from base 4405, the user will depress flexible tab 4484 in a downward motion. This motion removes locking tab 4482 from the engaged cavity 4472. Maintaining the downward depression of flexible tab 4484, the lid 4401 can then be rotated in a direction opposite from the installation of lid 4401 onto base 4405 as described above. When the lid 4401 has been sufficiently rotated such that the cavities 4472 and the locking tab 4482 cannot further engage when the locking tab 4482 is in the normal biased position, the user may release the depression of flexible tab 4484 and continue rotating lid 4401 until removed from base 4405.

Figure 48:
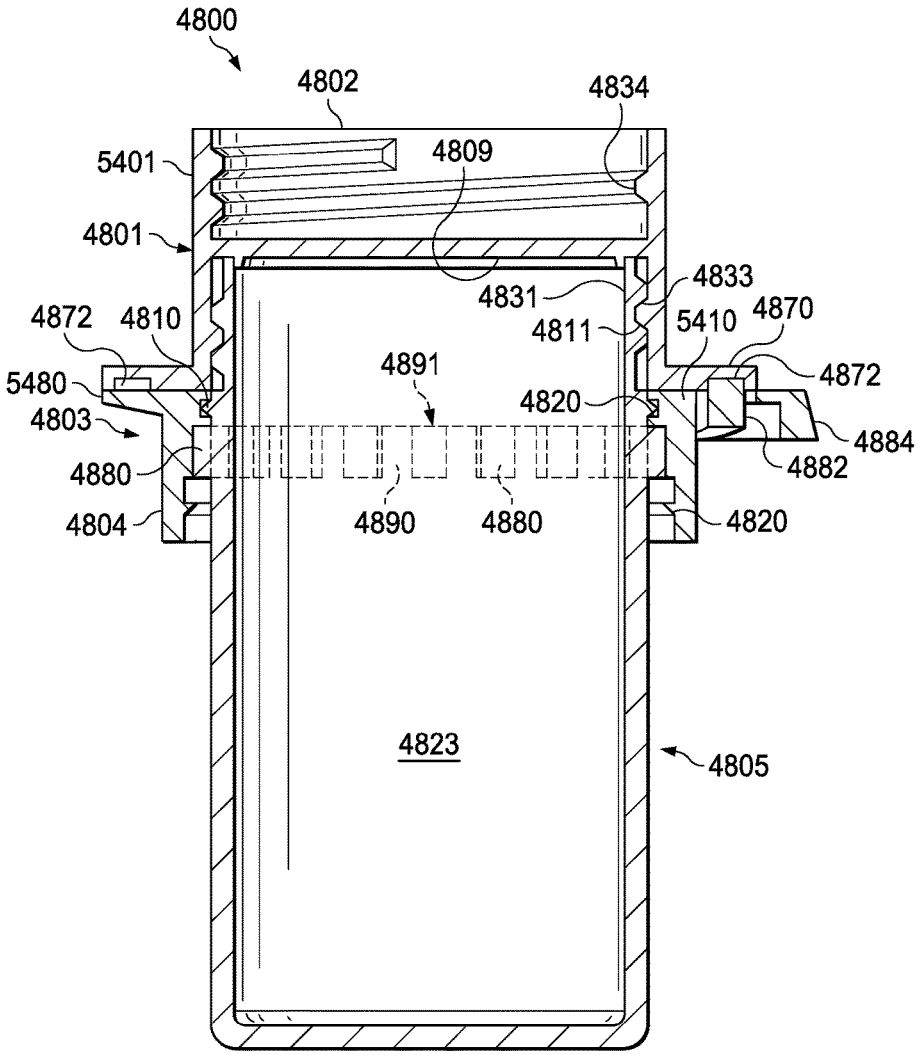
FIG. 48 illustrates a cross-section view of the container as similarly shown in FIG. 46 with an alternative embodiment of the cap.
Figure 54:
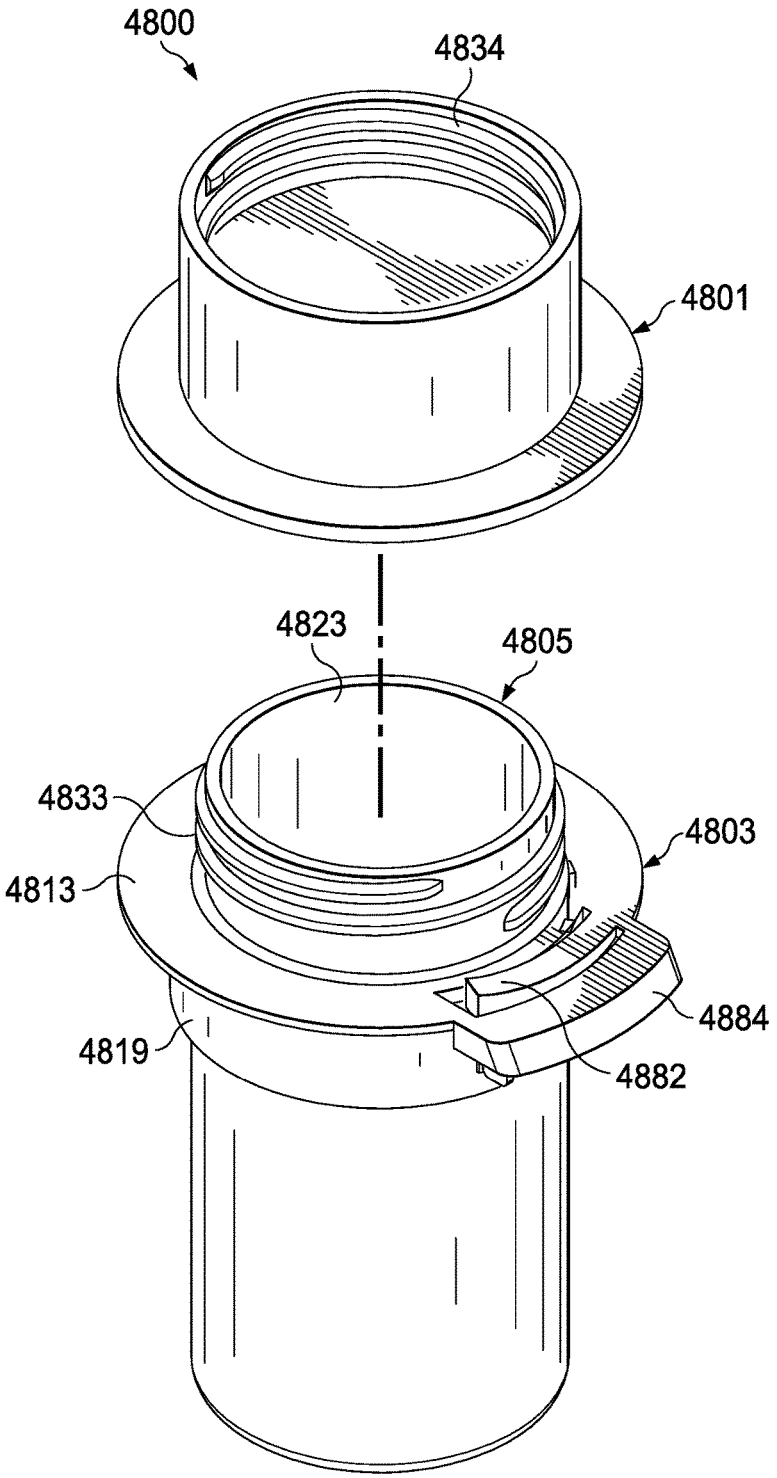
FIG. 54 illustrates a partially exploded perspective view of the present invention as similarly shown in FIG. 48.

Referring now to FIGS. 48 and 54, there is illustrated a cross-section and partial exploded view, respectively, of an alternative embodiment of a time container 4800 with a reversible lid 4801. As illustrated the bottom portion of the lid 4801 is configured and operates similar to the lid as described herein in relation to at least FIGS. 40-43. However, lid 4801 includes a threaded cavity 4834 on the end 4801 opposite threaded portion 483. Lid 4801 is configured such that either threaded end can be placed upon base 4805. When threaded end 4833 is placed and threaded upon 4805 (as described herein above with respect to FIGS. 40-43), lid 4801 will be locked upon base 4805 through the interactions of tab 4882 and cavity 4872. When threaded cavity 4834 is place and threaded upon base 4805, there is no engagement of a locking mechanism to lock lid 4801 onto base 4805. The permits the easy removal of lid 4801 from base 4805. As can be appreciated, this embodiment gives a user a choice as to whether the lid 4801 should be lock upon base 4805 or not.

Figure 49:
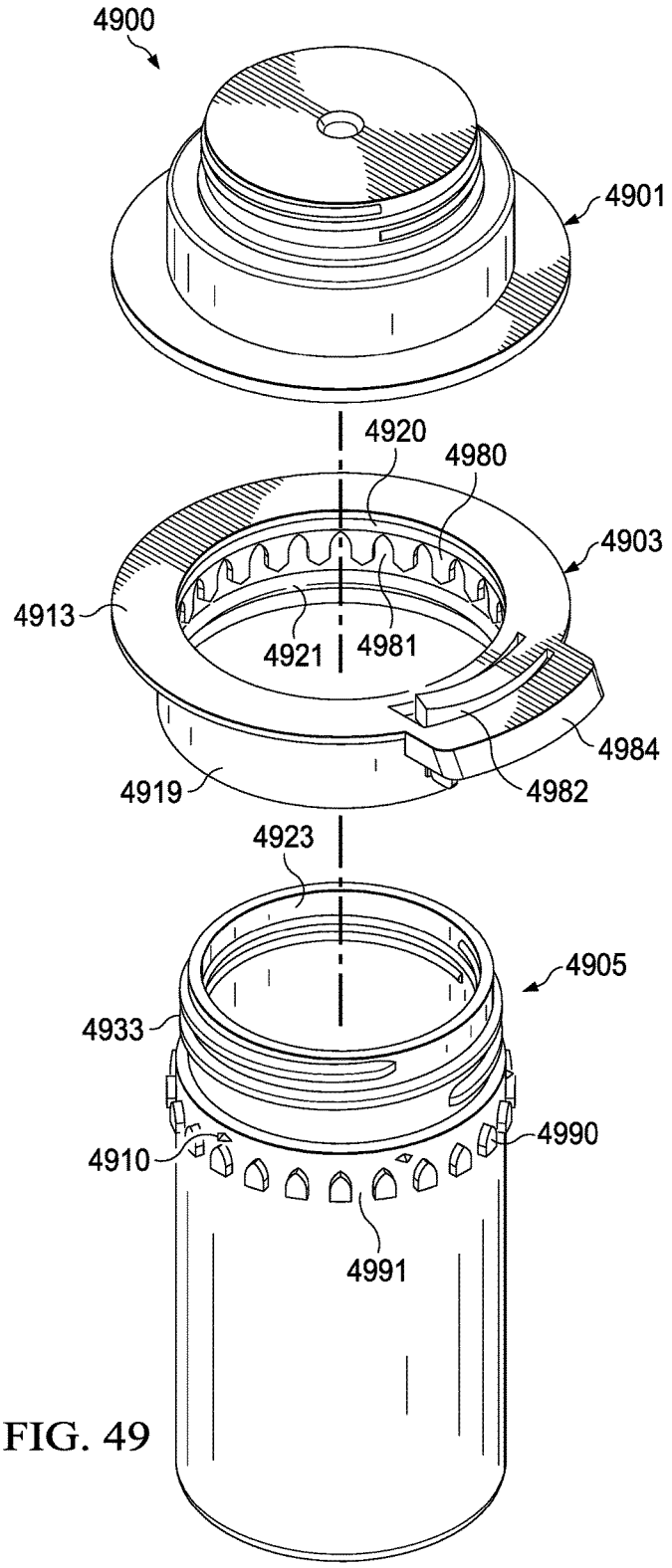
FIG. 49 illustrates an exploded perspective view of yet another embodiment of the present invention.

Referring now to FIG. 49, there is illustrated an alternative embodiment of container 4900 as similarly shown in FIGS. 44-47. As illustrated in FIG. 49, container 4900 includes a plurality of diamond shaped horizontal projections 4910 positioned about the periphery of base 4905, while spacer 4903 includes a circumferential groove 4920 which cooperates with projections 4910 when spacer 4903 is placed on base 4905.

As illustrated, spacer 4903 includes a plurality of 3 pointed arched shaped teeth 4980 that extend inward toward the center of spacer 4903 with a 3 pointed arched shaped gap 4981 positioned between each of the plurality of teeth 4980, with teeth 4980 and gaps 4981 extending around the inner perimeter of spacer 4903. Similarly, base 4905 includes a plurality of 3 pointed arched shaped teeth 4990 that extend outward the perimeter of base 4905 all point in the same direction, with each of the 3 pointed arched shaped teeth 4990 separated by a gap 4991, with teeth 4990 and gaps 4991 extending around the outer perimeter of base 4905. As illustrated, teeth 4980 and 4990, and gaps 4981 and 4991 are sized to permit the mating of spacer 4903 upon base 4905.

As can be appreciated, teeth 4990 are positioned on the outer perimeter of base 4905 and similarly the outer perimeter of spacer 4903 is sized such that when spacer 4903 is placed over base 4905, the outer perimeters of base 4905 and spacer 4903 are coaxial with respect to each other.

Additionally, spacer 4903 includes a circumferential groove 4920 that extends around the inner perimeter of spacer 4903, just above and adjacent to teeth 4980. Groove 4920 is sized and positioned to cooperate with diamond projections 4910 to prevent the disengagement of spacer 4903 from base 4905 when the use of container 4900 as a time indicator is not desired. Rotation of spacer 4903 in either direction about base 4905, with teeth 4980 sliding against teeth 4990 will disengage diamond projections 4910 from groove 4920, and thus permit the re-positioning of spacer 4903 around base 4905 to a new desired position, such as when using container 4900 as a time indicator container.

Figure 50:
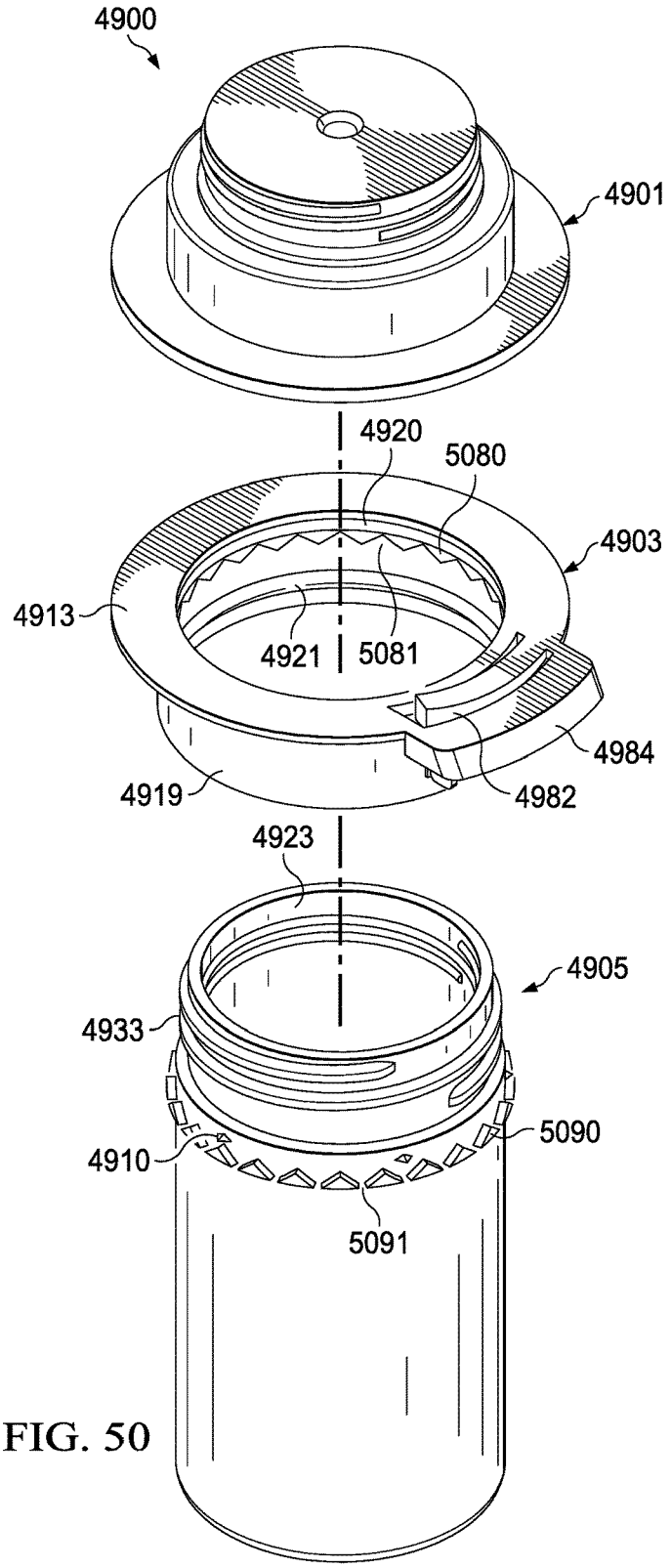
FIG. 50 illustrates an exploded perspective view of another embodiment of the present invention.

Referring now to FIG. 50, there is illustrated an alternative embodiment of container 4900 as similarly shown in FIGS. 44-47 and 48. As illustrated in FIG. 50, container 4900 includes a plurality of diamond shaped horizontal projections 4910 positioned about the periphery of base 4905, while spacer 4903 includes a circumferential groove 4920 which cooperates with projections 4910 when spacer 4903 is placed on base 4905.

As illustrated, spacer 4903 includes a plurality of triangular shapes teeth 5080 that extend inward toward the center of spacer 4903 with an inverted triangular shaped gap 5081 positioned between each of the plurality of teeth 5080, with teeth 5080 and gaps 5081 extending around the inner perimeter of spacer 4903. Similarly, base 4905 includes a plurality of triangular shaped teeth 5090 that extend outward the perimeter of base 4905 all point in the same direction, with each of the 3 pointed triangular shaped teeth 5090 separated by a gap 5091, with teeth 5090 and gaps 5091 extending around the outer perimeter of base 4905. As illustrated, teeth 5080 and 5090, and gaps 5081 and 5091 are sized to permit the mating of spacer 4903 upon base 4905.

As can be appreciated, teeth 5090 are positioned on the outer perimeter of base 4905 and similarly the outer perimeter of spacer 4903 is sized such that when spacer 4903 is placed over base 4905, the outer perimeters of base 4905 and spacer 4903 are coaxial with respect to each other.

Additionally, spacer 4903 includes a circumferential groove 4920 that extends around the inner perimeter of spacer 4903, just above and adjacent to teeth 5080. Groove 4920 is sized and positioned to cooperate with diamond projections 4910 to prevent the disengagement of spacer 4903 from base 4905 when the use of container 4900 as a time indicator is not desired. Rotation of spacer 4903 in either direction about base 4905, with teeth 5080 sliding against teeth 5090 will disengage diamond projections 4910 from groove 4920, and thus permit the re-positioning of spacer 4903 around base 4905 to a new desired position, such as when using container 4900 as a time indicator container.

Figure 51:
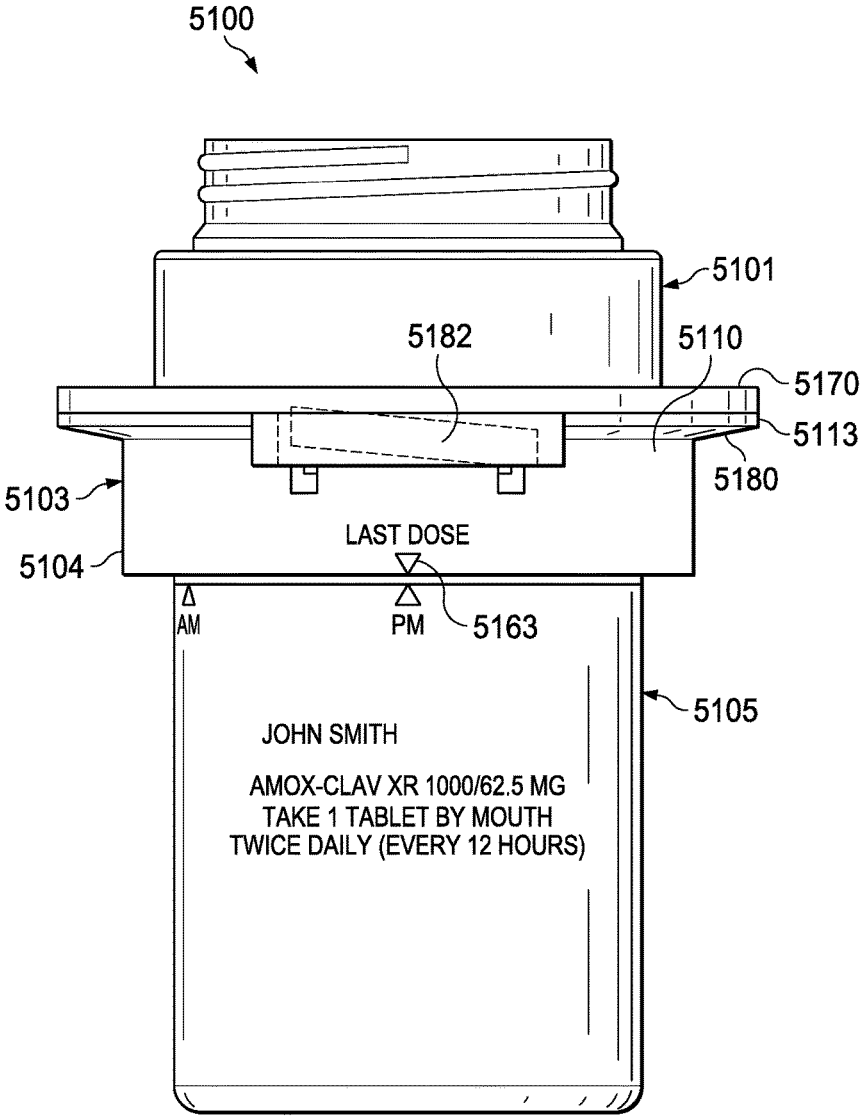
FIG. 51 illustrates a frontal view of an embodiment of the present invention illustrating a configuration of the indicators on the external portions of the container.
Figure 52:
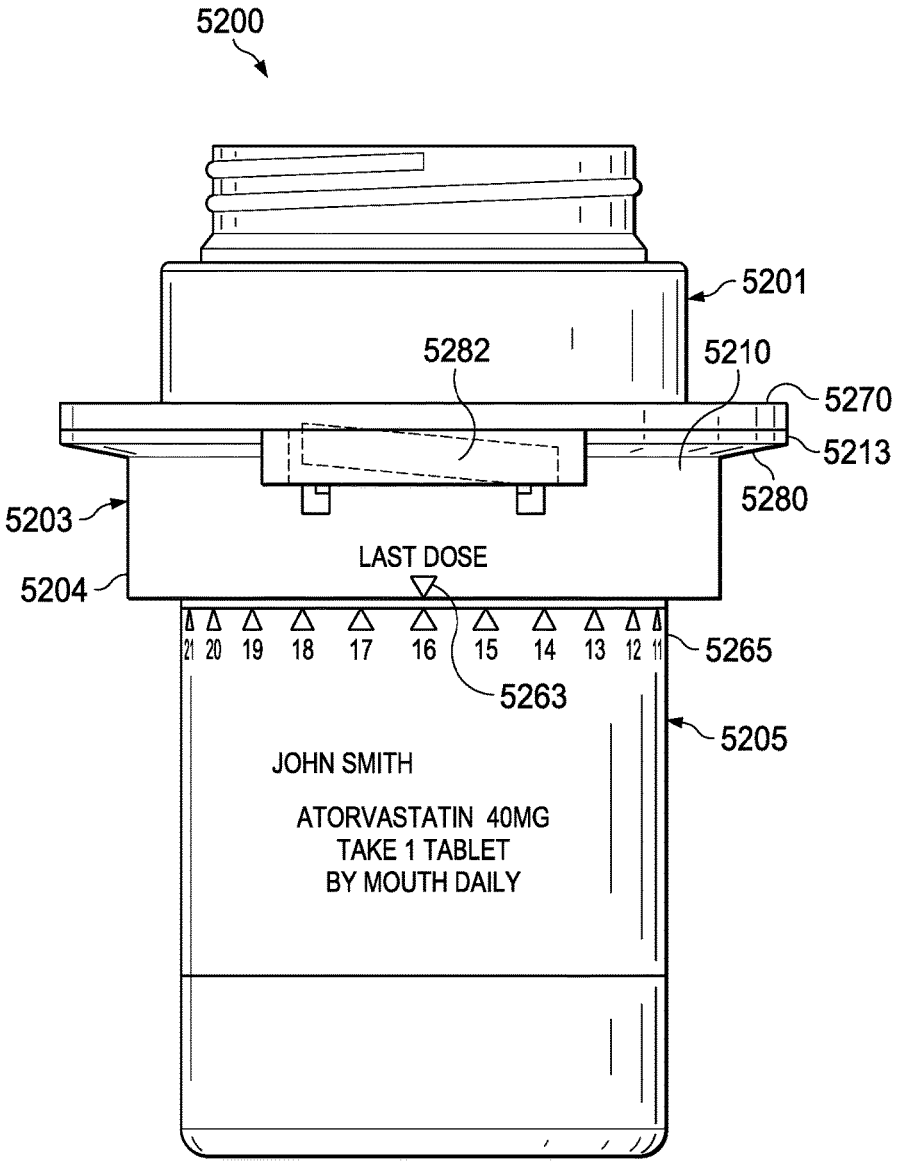
FIG. 52 illustrates a frontal view of an embodiment of the present invention illustrating another configuration of the indicators on the external portions of the container.

Referring now to FIGS. 51 and 52, there are illustrated embodiments of containers 5100 and 5200 utilizing time indicia.

Referring to FIG. 51, time programmable container 5100 includes a reversible lid 5101, a spacer 5103 and a base 5105. Lid 5101 is used to seal the time programmable container 5100. Spacer 5103 cooperates with the lid 5101 and base 5105.

Referring now back to lid 5101, a lip or rim 5170 circumscribes the bottom portion of the outer perimeter of lid 5101. Rim 5170 includes a plurality of cavities on the bottom portion of rim 5170 and are spaced apart a determined distance, and are configured in shape and size to receive therein, tab 5182 of spacer 5103. The spacing and shape configuration of cavities ensure the receipt therein of locking tab 5182 when lid 5101 is secured onto base 5105 regardless of the user's alignment of spacer 5103 with respect to base 5105.

As illustrated in FIG. 51, container 5100 includes an inverted arrow, i.e. indicator 5163 pointing to a similar opposing arrow which, the arrows being used to indicate time indicia, AM or PM in this embodiment, of when a user took the Last Dose of medicine contained therein.

Referring now to FIG. 52, time programmable container 5200 includes a reversible lid 5201, a spacer 5203 and a base 5205. Lid 5201 is used to seal the time programmable container 5200. Spacer 5203 cooperates with the lid 5201 and base 5205.

Referring now back to lid 5201, a lip or rim 5270 circumscribes the bottom portion of the outer perimeter of lid 5201. Rim 5270 includes a plurality of cavities on the bottom portion of rim 5270 and are spaced apart a determined distance, and are configured in shape and size to receive therein, tab 5282 of spacer 5203. The spacing and shape configuration of cavities ensure the receipt therein of locking tab 5282 when lid 5201 is secured onto base 5205 regardless of the user's alignment of spacer 5203 with respect to base 5205.

As illustrated in FIG. 52, container 5200 includes a single inverted arrow, i.e. indicator 5263 on spacer 5203, with a plurality of numbered inverted arrows on base 5265, with the coinciding of the arrow on the spacer and the base use to indicate the day of the month when the user took their Last Dose of medicine contained therein.

Figure 53:
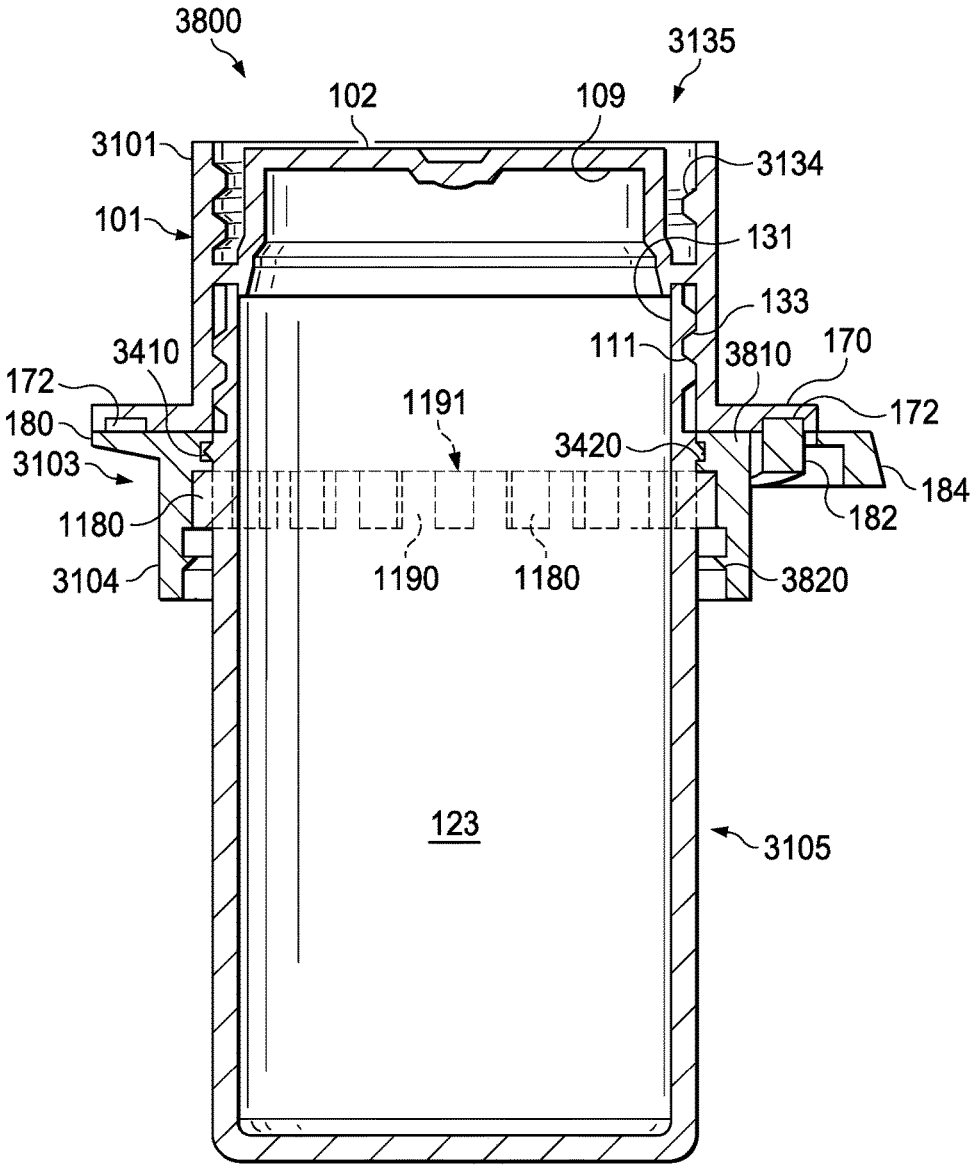
FIG. 53 illustrates a cross-sectional view of the container as similarly shown in FIG. 46 with another alternative embodiment of a cap.
Figure 55:
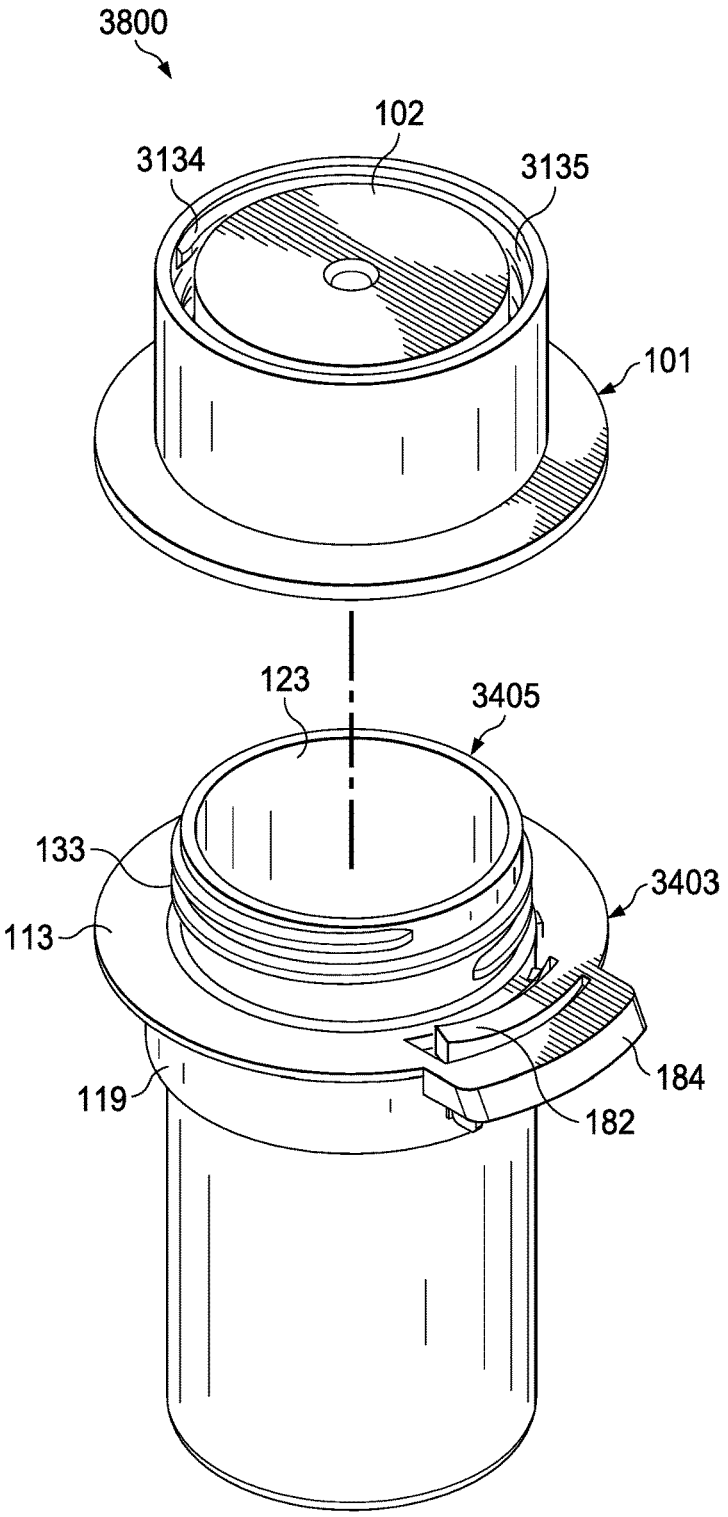
FIG. 55 illustrates a partially exploded perspective view of the present invention as similarly shown in FIG. 53.

Referring now to FIGS. 53 and 55, there is illustrated a cross-section and partial exploded view, respectively, of an alternative embodiment of a time container 3800 with a reversible lid 101 as similarly shown herein above. As illustrated the bottom portion of the lid 101 is configured and operates similar to the lid as described herein in relation to at least FIGS. 40-43. However, lid 101 includes a channel 3135 which separates the top portion 102 of lid 101 and the outer wall of lid 101. As illustrated lid 101 includes threads 3134 on the end 3101 opposite threaded portion 133. Lid 101 is configured such that either threaded end can be placed upon base 105. When threaded end 133 is placed and threaded upon 105 (as described herein above with respect to FIGS. 40-43), lid 101 will be locked upon base 3105 through the interactions of tab 182 and cavity 172. When lid 101 is placed such that channel 3135 fits over the top of base 3405, threads 3134 engages with threads 133 and top surface 102 of lid 101 is placed into base 3405, there is no engagement of a locking mechanism to lock lid 101 onto base 105. The permits the easy removal of lid 101 from base 3405. As can be appreciated, this embodiment gives a user a choice as to whether the lid 101 should be lock upon base 3405 or not.

Figure 56:
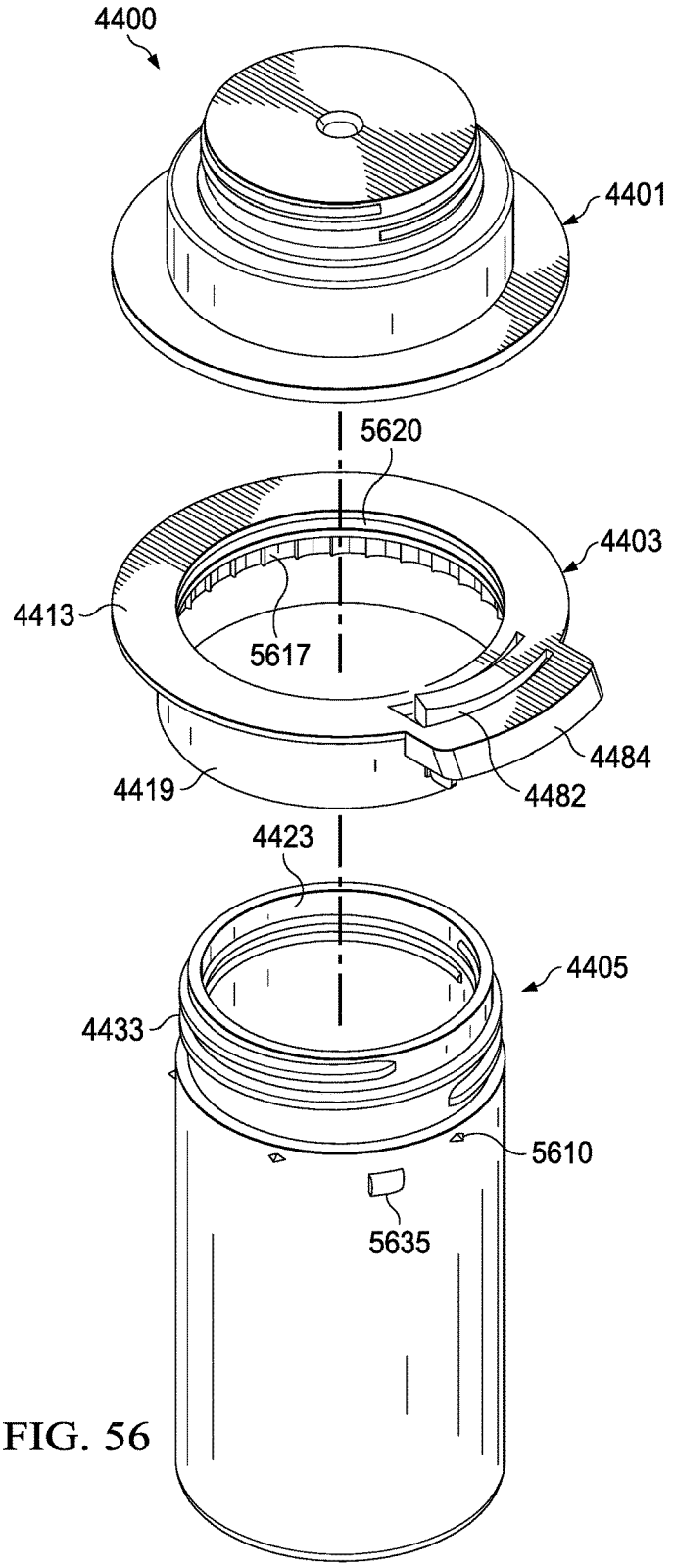
FIG. 56 illustrates a perspective exploded view of another embodiment of the present invention.

Referring now to FIG. 56, there is illustrated an exploded view of an alternative embodiment of container 4400 as similarly shown in FIGS. 44-47. As illustrated in FIG. 56, container 4400 includes a plurality of diamond shaped horizontal projections 5610 positioned about the periphery of base 4405. As further illustrated in FIG. 56, container 4400 includes ratcheting teeth 5617 having a plurality of horizontal arcuate depressions on spacer 4403 that extend around the inner perimeter of spacer 4403, and container 440 further includes a horizontal positioned finger 5635 that extends outward from the perimeter of base 4405. Finger 5635 of base 4405 and ratcheting teeth 5617 are shaped and sized to cooperate together, such that when spacer 4403 is placed onto base 4405, finger 5635 engages ratcheting teeth 5617, thus facilitating the turning of spacer 4403 about 4405 in a single direction only, in a ratcheting manner. Spacer 4403 further includes a circumferential groove 5620 that extends around the inner perimeter of spacer 4403, just above and adjacent to ratcheting teeth 5617. Groove 5620 is sized and positioned to cooperate with diamond projections 5610 to prevent the disengagement of finger 5635 from ratcheting teeth 5617 when spacer 4403 has been properly placed upon base 4405.

Figure 57:
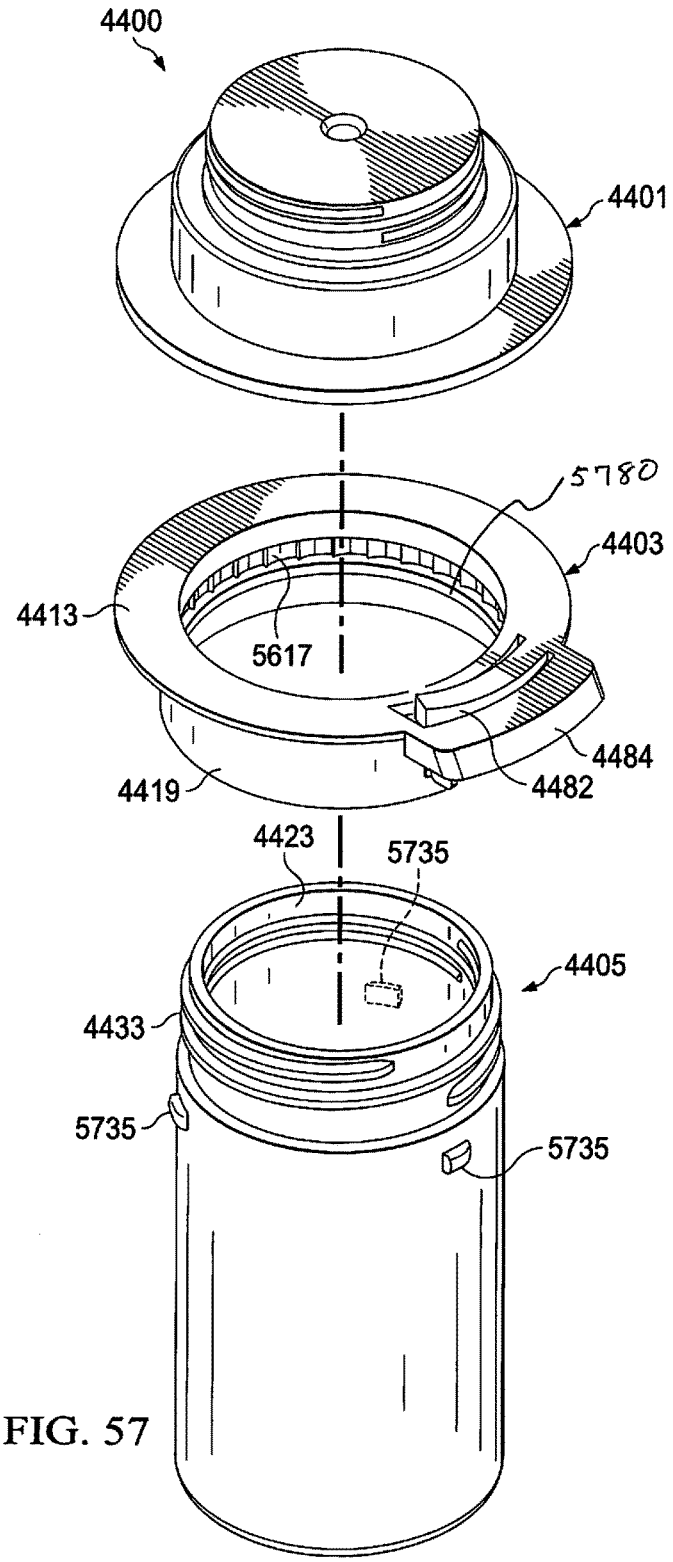
FIG. 57 illustrates a perspective exploded view of yet another embodiment of the present invention.

Referring now to FIG. 57, there is illustrated an exploded view of an alternative embodiment of container 4400 as similarly shown in FIGS. 44-47 and 56. As illustrated in FIG. 57, container 4400 includes ratcheting teeth 5617 having a plurality of horizontal arcuate depressions on spacer 4403 that extend around the inner perimeter of spacer 4403, and container 440 further includes three horizontal positioned fingers 5735 with each finger 5735 extending outward from the perimeter of base 4405 and being positioned equidistant about the perimeter of base 4405. Fingers 5735 of base 4405 and ratcheting teeth 5617 are shaped and sized to cooperate together, such that when spacer 4403 is placed onto base 4405, each finger 5735 engages ratcheting teeth 5617, thus facilitating the turning of spacer 4403 about 4405 in a single direction only in a ratcheting manner. Spacer 4403 further includes a circumferential rim 5780 that extends around the inner perimeter of spacer 4403, just below and adjacent to ratcheting teeth 5617. Rim 5780 prevents the disengagement of fingers 5735 from ratcheting teeth 5617 when spacer 4403 has been properly placed upon base 4405.

In another embodiment (not shown) spacer 3403 includes at least one horizontal flexible tab that extends inwards from the inner perimeter of spacer 3403. Base 3405 includes a plurality of horizontally positioned fingers/cavities/stops that extends outward from the perimeter of base 3405. Fingers/cavities/stops of base 3405 and horizontal flexible tab are sized to cooperate therewith, such that when spacer 3403 is placed onto base 3405, the flexible tab engages fingers/cavities/stops and allows the turning of spacer 3403 about 3405 in a single direction only in a ratcheting manner.

In another embodiment (not shown), spacer 3403 includes a plurality of horizontally positioned fingers/cavities/stops that extend inwards from the inner perimeter of spacer 3403. Base 3405 includes at least one horizontal flexible tab that extends outward from the perimeter of base 3405. Fingers/cavities/stops of spacer 3403 and horizontal flexible tab are sized to cooperate therewith, such that when base 3405 is placed onto base 3405, the flexible tab engages fingers/cavities/stops and allows the turning of spacer 3403 about 3405 in a single direction only in a ratcheting manner.

In the above illustrated embodiments, it is contemplated that, in addition to the time indicators on the spacers, other types of indicators could be used to convey or identify other information regarding the contents of the container or the user of the container. Such additional indicators could include numbers, letters, codes, shapes, names/identifies and colors thereof or even combinations thereof. Additionally, even various colors for the spacer themselves could also be used. Such could be used to quickly identify a particular user of the contents, e.g. a particular user in a group or family could have a corresponding colored spacer to be able to quickly identify their particular container(s).

Although representative embodiments and advantages have been described in detail, it should be understood that various changes, substitutions and alterations can be made herein without departing from the spirit and scope of the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure that processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

The invention claimed is:

1. A container comprising:

a base having a first end and a second end with the second end being cylindrical in shape, the second end having a perimeter, the base having threads at the second end, the base further including at least one projection positioned on the perimeter of the second end;

a spacer having a first end, a second end and a perimeter, the spacer having an aperture extending from the first end of the spacer to the second end of the spacer, the aperture having a perimeter greater that the perimeter of the second end of the base, the spacer including at least one shape positioned on the perimeter of the aperture, the at least one shape of the spacer configured to mate with the at least one projection of the base, the aperture of the spacer to be placed over the second end of the base and positioned so that the at least one projection of the base mates with the at least one shape of the spacer;

a lid having a first end and a second end, the first end of the lid having a threaded cavity with the threaded cavity of the first end configured to threadably mate with the threads at second end of the base, the threaded cavity of the first end having a perimeter, the second end of the lid having a threaded cavity with the threaded cavity of the second end configured to threadably mate with the threads at the second end of the base;

a locking device operable between a first position and a second position, the locking device for locking the lid onto the base, such that when the spacer is placed on the base and subsequent thereto the first end of the lid has been threaded onto the base the locking device operates in the first position and locks the lid onto the base and further when the locking device operates in the second position, the lid is unlocked from the base and removable therefrom;

the locking device including at least one cavity positioned around the perimeter of the threaded cavity of the first end of the lid;

the locking device including a first tab positioned on the perimeter of the first end of the spacer, the first tab moveable between a first position and a second position, the tab being normally biased in the first position, wherein the cavity of the perimeter of the first end of the lid is shaped to receive the first tab of the spacer, such that when the spacer has been placed on the base and the first end of the lid has been threaded onto the base, the locking device is in the first position with the first tab of the spacer extending into the at least one cavity positioned around the perimeter of the first end of the lid; and the locking device including a flexible second tab connected to the perimeter of the first end of the spacer and the first tab, such that when the second tab is flexed the first tab is removed from the at least one cavity positioned around the perimeter of the first end of the lid, thereby permitting removal of the lid from the base.

2. The container of claim 1, wherein, the second end of the lid being configured to threadably engage the threads of the second end of the base, such that when the second end of the lid engages the second end of the base, the locking device does not inhibit removal of the lid from the base.

3. A container comprising:

a base having a cylindrical first end and a cylindrical second end, the second end having a circumference, the base being threaded at the second end, the base further including at least one locking member positioned on the circumference of the second end;

a cylindrical spacer having a first end and a second end, the spacer having an aperture extending from the first end of the spacer to the second end of the spacer, the aperture having a circumference greater that the circumference of the second end of the base, the spacer including at least one depression positioned on the circumference of the aperture, the at least one depression configured to fit over the at least one locking member of the base and shaped to complement the at least one locking member, the aperture of the spacer to be placed over the second end of the base and positioned so that the at least one locking member of the base mates with the at least one depression of the spacer;

a reversible lid having a first end and a second end, with each of the first end and second end having a threaded cavity with each threaded cavity configured to threadably mate with the threaded second end of the base; and a lid locking device operable between a first position and a second position, the locking device for locking the lid onto the base, such that when the spacer is placed on the base and subsequent thereto the first end of the lid has been threaded onto the base the locking device operates in the first position and locks the lid onto the base and further when the locking device operates in the second position, the lid is unlocked from the base and removable therefrom;

the lid locking device including at least one cavity positioned around the perimeter of the threaded cavity of the first end of the lid; and the lid locking device including a first tab positioned on the perimeter of the first end of the spacer, the first tab moveable between a first position and a second position, the first tab being normally biased in the first position, wherein the at least one cavity on the perimeter of the first end of the lid is shaped to receive the first tab of the spacer, such that when the spacer has been placed on the base and the first end of the lid has been threaded onto the base, the lid locking device is in the first position with the first tab of the spacer extending into the at least one cavity of the perimeter of the first end of the lid; and the lid locking device including a flexible second tab connected to the perimeter of the first end of the spacer and the first tab, such that when the second tab is flexed, the first tab is removed of the at least one cavity on the perimeter of the first end lid, thereby permitting removal of the lid from the base.

4. The container of claim 3, wherein, when the second end of the lid engages the second end of the base, the locking device does not inhibit removal of the lid from the base.

5. The container of claim 4, and further including time indicia on the spacer.

6. The container of claim 5, and further including an alignment indicator on the base, the alignment indicator to indicate a selected one of the time indicia on the spacer.

* * * * *